US011206901B2

(12) United States Patent
Tung et al.

(10) Patent No.: US 11,206,901 B2
(45) Date of Patent: Dec. 28, 2021

(54) SLIDE FASTENER-ATTACHED PRODUCT, ELEMENT MEMBER AND MANUFACTURING METHOD OF SLIDE FASTENER-ATTACHED PRODUCT

(71) Applicant: YKK Corporation, Tokyo (JP)

(72) Inventors: Yu Chen Tung, Toyama (JP); Yoshiyuki Sho, Toyama (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 16/480,508

(22) PCT Filed: Oct. 6, 2017

(86) PCT No.: PCT/JP2017/036534
§ 371 (c)(1),
(2) Date: Jul. 24, 2019

(87) PCT Pub. No.: WO2018/142672
PCT Pub. Date: Aug. 9, 2018

(65) Prior Publication Data

US 2019/0380454 A1 Dec. 19, 2019

(30) Foreign Application Priority Data

Feb. 2, 2017 (WO) ..... PCT/JP2017/003840

(51) Int. Cl.
*A44B 19/28* (2006.01)
*A44B 19/40* (2006.01)
(Continued)

(52) U.S. Cl.
CPC ..... *A44B 19/403* (2013.01); *A44B 19/08* (2013.01); *A44B 19/26* (2013.01); *A44B 19/28* (2013.01); *A44B 19/38* (2013.01)

(58) Field of Classification Search
CPC ..... A44B 19/403; A44B 19/38; A44B 19/08; A44B 19/26; A44B 19/28
See application file for complete search history.

(56) References Cited

U.S. PATENT DOCUMENTS 1,813,434 A 7/1931 Bennett
2,067,734 A 1/1937 Silberman
(Continued)

FOREIGN PATENT DOCUMENTS

CN 2688116 Y 3/2005
CN 1275555 C 9/2006
(Continued)

OTHER PUBLICATIONS

Office Action, Japanese Patent Application No. 2018-565923, dated Mar. 10, 2020.
(Continued)

*Primary Examiner* — Robert Sandy
(74) *Attorney, Agent, or Firm* — Kilpatrick Townsend & Stockton LLP

(57) ABSTRACT

A slide fastener-attached product has a first element member in which an insert pin portion is attached to a fixing member, a second element member in which a box portion is attached to a fixing member and fastener attached members having a pair of element attaching edge portions in a position facing to each other. The first element member and the second element member have an element holding portion and a component holding portion in which the insert pin portion or the box portion is attached with respect to the length direction of the fixing member, and at least the component holding portion is fixed to the element attaching edge portion of the fastener attached member with a component sewn portion which is formed of sewing threads and pierces the fastener attached member. The product provides weight
(Continued)

saving, improved softness, and an easily separable rear end stop.

28 Claims, 19 Drawing Sheets

(51) Int. Cl.
*A44B 19/38* (2006.01)
*A44B 19/08* (2006.01)
*A44B 19/26* (2006.01)

(56) References Cited

U.S. PATENT DOCUMENTS

| | | | | |
|---|---|---|---|---|
| 2,858,592 | A | 11/1958 | Schwartz | |
| 3,132,398 | A | 5/1964 | Schwendt et al. | |
| 3,302,259 | A | 2/1967 | Waldes | |
| 3,503,102 | A | 3/1970 | Inazawa | |
| 3,696,473 | A | 10/1972 | Jones | |
| 3,750,260 | A | 8/1973 | Jakob | |
| 3,849,841 | A | 11/1974 | Borzner | |
| 3,874,038 | A | 4/1975 | Takamatsu | |
| 3,955,247 | A | 5/1976 | Takamatsu | |
| 3,977,053 | A | 8/1976 | Takamatsu | |
| 4,033,014 | A | 7/1977 | Manning | |
| 4,134,184 | A | 1/1979 | Motta | |
| 4,175,104 | A | 11/1979 | Moertel | |
| 4,187,791 | A | 2/1980 | Moertel | |
| 4,257,839 | A | 3/1981 | Yoshida et al. | |
| 4,291,440 | A | 9/1981 | Yoshida | |
| 4,297,770 | A | 11/1981 | Wulz | |
| 4,418,449 | A | 12/1983 | Heimberger et al. | |
| 4,425,683 | A * | 1/1984 | Hata | A44B 19/38 24/381 |
| 4,425,684 | A * | 1/1984 | Akashi | A44B 19/38 24/434 |
| 4,425,685 | A * | 1/1984 | Ogihara | A44B 19/38 24/434 |
| 4,458,391 | A | 7/1984 | Scarpini | |
| 4,485,532 | A * | 12/1984 | Yoshida | A44B 19/38 24/381 |
| 4,490,890 | A * | 1/1985 | Yoshida | A44B 19/38 24/434 |
| 4,495,679 | A | 1/1985 | Scarpini | |
| 4,639,981 | A | 2/1987 | Yoshida et al. | |
| 4,922,584 | A | 5/1990 | Funakawa et al. | |
| 5,008,986 | A | 4/1991 | Laudet et al. | |
| 5,297,319 | A | 3/1994 | Akashi et al. | |
| 5,469,605 | A | 11/1995 | Horikawa | |
| 5,678,285 | A | 10/1997 | Germani | |
| 6,065,192 | A | 5/2000 | Wang | |
| 6,352,044 | B1 | 3/2002 | Peng | |
| 8,572,816 | B2 | 11/2013 | Dono et al. | |
| 2002/0100148 | A1 | 8/2002 | Tominaga et al. | |
| 2004/0018919 | A1 | 9/2004 | Mizuhara et al. | |
| 2004/0181919 | A1 | 9/2004 | Mizuhara et al. | |
| 2005/0034284 | A1 | 2/2005 | Yu | |
| 2005/0235466 | A1 | 10/2005 | Segawa et al. | |
| 2005/0257350 | A1 | 11/2005 | Takamatsu et al. | |
| 2009/0013505 | A1 | 1/2009 | Hasegawa et al. | |
| 2011/0005042 | A1 | 1/2011 | Thomas et al. | |
| 2012/0110795 | A1 | 5/2012 | Daijogo | |
| 2012/0246888 | A1 | 10/2012 | Matsushima et al. | |
| 2013/0133161 | A1 | 5/2013 | Ren | |
| 2015/0033512 | A1 | 2/2015 | Kojima et al. | |
| 2016/0095405 | A1 | 4/2016 | Wang | |
| 2016/0206054 | A1 | 7/2016 | Ni | |
| 2017/0265605 | A1 | 9/2017 | Davis | |
| 2017/0280832 | A1 | 10/2017 | Kojima et al. | |
| 2019/0357638 | A1 | 11/2019 | Sho et al. | |

FOREIGN PATENT DOCUMENTS

| | | | |
|---|---|---|---|
| CN | 103153122 | A | 6/2013 |
| CN | 103269616 | A | 8/2013 |
| CN | 104334785 | A | 2/2015 |
| CN | 108236164 | A | 7/2018 |
| EP | 0107113 | A1 | 5/1984 |
| EP | 1459643 | A2 | 9/2004 |
| EP | 2764790 | A1 | 8/2014 |
| FR | 2247999 | A1 | 5/1975 |
| GB | 2083548 | A | 3/1982 |
| GB | 2319806 | A | 6/1998 |
| JP | 40-13870 | A | 5/1965 |
| JP | 52-141747 | A | 11/1977 |
| JP | 56-089204 | A | 7/1981 |
| JP | 62-299205 | A | 12/1987 |
| JP | 2004-283300 | A | 10/2004 |
| TW | 201609016 | A | 3/2016 |
| WO | 2010/032331 | A1 | 3/2010 |
| WO | 2011/077534 | A1 | 6/2011 |
| WO | 2012/090276 | A1 | 7/2012 |
| WO | 2014/102941 | A1 | 7/2014 |

OTHER PUBLICATIONS

Office Action, Japanese Patent Application No. 2018-565922, dated Mar. 10, 2020.
Office Action, Japanese Patent Application No. 2018-565921, dated Mar. 10, 2020.
International Search Report, PCT Application No. PCT/JP2017/036534, dated Dec. 12, 2017.
International Search Report, PCT Application No. PCT/JP2017/003840, dated Apr. 25, 2017.
PCT International Application No. PCT/JP2017/036533, International Search Report dated Dec. 12, 2017.
PCT International Application No. PCT/JP2017/036535, International Search Report dated Dec. 12, 2017.
Office Action, Chinese Patent Application No. 201711285372.3, dated Apr. 3, 2020.
Office Action, Chinese Patent Application No. 201810120807.7, dated Mar. 23, 2020.
Office Action, Chinese Patent Application No. 201810090675.8, dated Mar. 27, 2020.
European Supplementary Search Report, European Patent Application No. 17894796.6, dated Oct. 6, 2020, 10 pages.
European Supplementary Search Report, European Patent Application No. 17894731.3, dated Oct. 8, 2020, 9 pages.
Office Action, Chinese Patent Application No. 201810120807.7, dated Sep. 30, 2020, 34 pages.
U.S. Appl. No. 16/476,754, Non-Final Office Action, dated Oct. 14, 2020, 6 pages.
U.S. Appl. No. 16/480,430, Non-Final Office Action, dated Nov. 9, 2020, 13 pages.
U.S. Appl. No. 16/476,754, Notice of Allowance, dated Jan. 22, 2021, 7 pages.
U.S. Appl. No. 16/480,394, Non-Final Office Action, dated Jan. 6, 2021, 15 pages.
European Patent Application No. 17894888.1, Extended European Search Report, dated Dec. 1, 2020, 9 pages.
Office Action, Chinese Patent Application No. 201810120863.0, dated Apr. 17, 2020, 17 pages.
Office Action, Taiwanese Patent Application No. 106119596, dated Nov. 27, 2017, 17 pages.
Office Action, Chinese Patent Application No. 201810120807.7, dated Mar. 2, 2021, 43 pages.
U.S. Appl. No. 16/476,754 , Notice of Allowance, dated Apr. 29, 2021, 7 pages.
U.S. Appl. No. 16/480,394 , Notice of Allowance, dated Apr. 19, 2021, 9 pages.
U.S. Appl. No. 16/480,394 , Supplemental Notice of Allowability, dated Apr. 29, 2021, 2 pages.
U.S. Appl. No. 16/480,430, Final Office Action, dated May 6, 2021, 11 pages.
U.S. Appl. No. 16/480,430, Non-Final Office Action, dated Aug. 24, 2021, 14 pages.

* cited by examiner

SLIDE FASTENER-ATTACHED PRODUCT, ELEMENT MEMBER AND MANUFACTURING METHOD OF SLIDE FASTENER-ATTACHED PRODUCT

TECHNICAL FIELD

The invention relates to a slide fastener-attached product formed by attaching left and right element members in which a plurality of fastener elements and an insert pin portion or a box portion forming a separable rear end stop are attached to fixing members directly to fastener-attached members of products such as clothes, and also relates to an element member used for the slide-fastener attached product and a manufacturing method of the slide fastener-attached product.

BACKGROUND ART

A slide fastener is often and generally used as an opening and closing tool for products such as clothes, commodities and industrial materials and also for products such as various kinds of seats for automobiles, trains and aircrafts. The slide fastener used for such various kinds of products generally has a left and right pair of fastener stringers in which element rows are formed at tape side edge parts of fastener tapes and a slider sliding along the left and right element rows.

For Example, a fastener stringer in which continuous fastener elements are formed by molding monofilaments made of thermoplastic resin in a coiled or zigzag shape and element rows are formed by sewing the continuous fastener elements on the tape side edge part of the fastener tape is known as a general one. In addition, a fastener stringer in which element rows are formed by forming a plurality of independent fastener elements at predetermined intervals by injection molding of synthetic resin directly or by die-casting of metal to the tape side edge part of the fastener tape is also known.

Further, such an example of the slide fastener which is formed by sewing an element member in which a plurality of fastener elements are connected with a supporting string to an edge of the fastener tape with overlock stitches (over-edge chain stitches) is disclosed in Japanese Utility Model Publication No. S40-13870 (Patent Document 1).

It should be noted that, for example, in a case that the element member is sewn to the fastener tape by using an overlock sewing machine as above, a sewing thread disposed on a tape top surface side of the fastener tape (needle thread) is disposed so as not to overlap the fastener elements. On the other hand, a sewing thread disposed on a tape back surface side (looper thread) tends to overlap with the fastener elements on the tape back surface side due to a movement of the looper of the overlock sewing machine. Thus, in a case that the fastener stringer is formed using the overlock stitches as in Patent Document 1, high technical capability not to overlap the looper thread with the fastener elements is needed.

Meanwhile, in the conventional slide fastener or the fastener stringer, the element rows are formed at the tape side edge parts of the fastener tapes by attaching coil-shaped continuous fastener elements or fastener elements made of synthetic resin by injection-molding are attached to the tape side edge parts. In addition, in a case that the slide fastener is attached to fastener attached members such as clothes, it is common to sew a part other than the tape side edge part of the fastener tape (generally called as "tape main body portion") and a fastener attaching portion of the fastener attached member together in a state that the part other than the tape side edge part of the fastener tape overlaps the fastener attaching portion of the fastener attached member. Therefore, in a general slide fastener, a fastener tape is generally used as an essential member (parts) for consisting a slide fastener.

On the other hand, in order to improve visual quality (appearance quality) such as a color of a slide fastener-attached product and for weight saving, an example that an element member in which continuous fastener elements or a plurality of fastener elements are fixed with core yarn are directly woven-fixed or knitted-fixed to a cloth of a product when weaving or knitting the cloth is disclosed in Japanese Patent Publication No. S62-299205 (Patent Document 2). Thus, it is possible to attach the fastener elements to the cloth of the product directly without using a fastener tape.

In a case that the fastener elements are woven or knitted to the cloth of the product as in Patent Document 2, it is possible to reduce working processes in manufacturing the slide fastener-attached products, for example, in comparison with a case that after the slide fasteners are manufactured, the slide fastener-attached products are manufactured by sewing the fastener tapes of the slide fasteners to the cloth of the product. Thus, acceleration of a production line and cost reduction can be expected.

Further, since the fastener elements can be woven-fixed or knitted-fixed directly to the cloth of the product, the fastener tape as an essential component of the slide fastener becomes unnecessary. Thus, weight saving and improvement of softness of the slide fastener-attached products can be also expected.

On the other hand, a slide fastener in which a separable rear end stop is provided at an end part of a fastener stringer so as left and right fastener stringers themselves to be uncoupled and separated with each other when left and right element rows are uncoupled is known as a kind of slide fasteners.

In this case, as generally known separable rear end stops for a slide fastener are: a type having at least an insert pin formed at a fastener tape of a fastener stringer on one side and an box body formed at a fastener tape of a fastener stringer on the other side and having an insert pin accommodating portion capable of inserting and accommodating the insert pin therein (a type of having a box body portion) and a type having an insert pin formed at a fastener tape of a fastener stringer on one side and a box pin formed at a fastener tape of a fastener stringer on the other side and attaching two sliders to element rows in a posture that respective rear mouths are faced to each other (open reverse type, or no-box body portion type).

An example of a slide fastener having a separable rear end stop with a box body portion is described in International Publication No. 2014/102941 (Patent Document 3) and so on. Further, in above-mentioned both two types of separable rear end stops, it is necessary to provide at least the insert pin at one end part of the fastener tape on one side and a box body or a box pin at one end part of the fastener tape on the other side. In this case, to couple and uncouple the element rows smoothly, it is necessary to provide the insert pin and the box body or the box pin with high precision at a predetermined position with respect to respective left and right element rows.

PRIOR ART DOCUMENTS

Patent Documents

Patent Document 1: Japanese Utility Model Publication No. S40-13870

Patent Document 2: Japanese Patent Publication No. JP S62-299205

Patent Document 3: International Publication No. 2014/102941

SUMMARY OF INVENTION

Problem to be Solved by the Invention

Recently, added values of products like clothing such as clothes, bags and shoes are enhanced by improving a nature corresponding to their uses and by applying various functions. For example, further weight saving and improvement of softness are required for clothing and bags used on a daily basis.

However, for the conventional slide fasteners including the ones described in the above-mentioned Patent Documents 1 and 3, a fastener tape as a component of the slide fastener is essential. Therefore, as for a slide fastener-attached product to which a conventional and general slide fastener is attached, weight saving of the slide fastener is limited. In addition, since the fastener tape is attached to a fastener attaching portion of the product by sewing processing using a sewing machine, softness of the product may be deteriorated.

On the other hand, for example, as described in Patent Document 2, in a case of manufacturing a slide fastener-attached product by woven-fixing or knitted-fixing the fastener elements or the element members directly to a cloth of the product, the fastener tapes become unnecessary, which enables weight saving of the slide fastener-attached product to be easily achieved.

However, to woven-fix or knitted-fix the fastener elements directly to the cloth of the product, high technology and designated equipments are necessary. As a result, equipment cost increases and securing and training matured engineers are needed. In addition, since an explanation about a separable rear end stop is not described in Patent Document 2, it was not easy to manufacture a slide fastener-attached product without a fastener tape and with a separable rear end stop by utilizing technology described in Patent Document 2.

Further, desired functions are provided to the cloth by coating the cloth of the product with synthetic resin, for example, corresponding to a use of the product in some cases. However, in a case of woven-fixing or knitted-fixing the fastener elements directly in weaving or knitting the cloth of the product as in Patent Document 2, it is often difficult to add the desired functions stably by coating the cloth with synthetic resin.

The present invention is invented in light of the above conventional problems, and its specific object is to provide a slide fastener-attached product in which a plurality of fastener elements and a separable rear end stop can be directly and easily attached to a fastener attached member of a product and from which weight saving and improvement of softness can be expected in comparison with the conventional and general slide fastener-attached products, and also to provide element members used for the slide fastener-attached products and manufacturing method of the slide fastener-attached products.

Means for Solving the Problem

To achieve the above object, a slide fastener-attached product provided by the present invention has a first element member in which fastener elements and an insert pin portion forming a separable rear end stop for a slide fastener are attached to a fixing member, a second element member in which fastener elements and a box portion forming the separable rear end stop are attached to a fixing member and fastener attached members having a pair of element attaching edge portions to which a pair of the first element member and the second element member are attached in a position facing to each other, the first element member and the second element member have element holding portions in which the fastener elements are attached to the fixing member and component holding portions in which the insert pin portion or the box portion is attached to the fixing member with respect to a length direction of the fixing member, and at least the component holding portions of the first element member and the second element member are fixed to the element attaching edge portions with component sewn portions formed of sewing threads and piercing the fastener attached members, as a most principal configuration.

In the slide fastener-attached product according to the present invention, it is preferable that the component sewn portion is formed in at least a part of a directly-attached region within which the insert pin portion or the box portion is attached directly to the fixing member with respect to the length direction.

Further in the slide fastener-attached product according to the present invention, it is preferable that the component sewn portion is disposed so as to extend continuously to an element holding portion side beyond a position corresponding to an end edge on a near side to the element holding portion of the directly-attached region within which the insert pin portion or the box portion is attached directly to the fixing member with respect to the length direction.

Further in the slide fastener-attached product according to the present invention, it is preferable that the fixing member has an extending part extending from the insert pin portion or the box portion in a direction away from the element holding portion in the length direction.

In this case, it is preferable that the component sewn portion is disposed so as to extend continuously to an opposite side to the element holding portion side beyond a position corresponding to an end edge on a far side from the element holding portion of the directly-attached region within which the insert pin portion or the box portion is attached directly to the fixing member with respect to the length direction.

In the slide fastener-attached product according to the present invention, it is preferable that the insert pin portion and the box portion have thread accommodating portions accepting and accommodating the sewing threads of the component sewn portion, and the component sewn portion is formed so as at least a part of the sewing threads of the component sewn portion to be accommodated in the thread accommodating portion of the insert pin portion or the box portion.

Further in the slide fastener-attached product according to the present invention, it is preferable that the component holding portion of the first element member or the second element member is fixed to the element attaching edge portion with the sewing threads of the component sewn portion holding the fixing member disposed on the component holding portion, or holding a part of the insert pin portion or the box portion.

In this case, it is preferable that the insert pin portion or the box portion has at least two divided bodies which are divided, and the sewing threads of the component sewn portion are accommodated in a gap or a concave portion formed between the divided bodies.

Further in the present invention, the component holding portion may be fixed to the element attaching edge portion with the sewing threads of the component sewn portion penetrating and sewing directly the insert pin portion or the box portion to the element attaching edge portion.

In this case, it is preferable that the insert pin portion or the box portion has a component main body portion wrapping the fixing member along the fixing member and a fin portion extending from the component main body portion in a width direction and disposed on one surface of the element attaching edge portion in which an accommodating concave groove portion or an accommodating concave portion accommodating the sewing threads of the component sewn portion is disposed, or a hole portion which makes the sewing threads passed through and penetrated into the fin portion is disposed in advance on the fin portion, and in which the fin portion is sewn to the element attaching edge portion.

In the slide fastener-attached product according to the present invention, it is preferable that the fastener elements and the insert pin portion or the box portion are formed of synthetic resin and also formed integrally to the fixing member in a predetermined shape, and a plurality of fastener elements are formed independently and disposed on the fixing member respectively at regular intervals.

In the slide fastener-attached product according to the present invention, it is preferable that the element holding portions of the first element member and the second element member are fixed directly to the element attaching edge portions with element sewn portions piercing the fastener attached members.

In this case, it is preferable that the element sewn portion and the component sewn portion are formed continuously to be bent in a zigzag shape with respect to the length direction of the fixing member, the element sewn portion is formed of the sewing threads repeating a predetermined stitch pattern per fastener element and the component sewn portion is formed by repeating the stitch pattern in the element sewn portion.

Further in the present invention, the element sewn portion may be formed to be bent in a zigzag shape with respect to the length direction of the fixing member while the component sewn portion may be formed linearly.

In addition, in the slide fastener-attached product according to the present invention, it is preferable that the first element member and the second element member are fixed to the element attaching edge portions at a position along the element attaching edge portion at an outside in the width direction.

In the slide fastener-attached product according to the present invention, it is preferable that the box portion has at least a box body portion which has an insert pin accommodating portion capable of inserting and accommodating the insert pin portion therein and stops a slider by contacting, and the slider is slidably attached to an element row formed of the fastener elements in a posture that a rear mouth of the slider faces to the box body portion.

In the present invention, a first slider and a second slider may be slidably attached to element rows formed of the fastener elements in a posture that rear mouths of respective sliders face to each other, and the box portion may have a box pin portion inserted into the first slider and the second slider and a stopper portion which stops either the first slider or the second slider by contacting.

Next, an element member according to the present invention has a fixing member, fastener elements attached to the fixing member and an insert pin portion or a box portion which is disposed so as to continue to element rows formed of the fastener elements and forms a separable rear end stop for a slide fastener, the fastener elements and the insert pin portion or the box portion are fixed to the fixing member, and a component holding portion in which the insert pin portion or the box portion is fixed to the fixing member has a structure able to be fixed with a component sewn portion formed of the sewing threads and piercing a fastener attached member, as a most principal configuration.

In the element member of the present invention, it is preferable that the insert pin portion or the box portion has a thread accommodating portion capable of accepting and accommodating the sewing threads sewing the insert pin portion or the box portion to the fastener attached member.

In the element member of the present invention, it is preferable that the fixing member has an extending part extending from the insert pin portion or the box portion in a direction away from the fastener element in the length direction.

In the element member of the present invention, it is preferable that the insert pin portion or the box portion has at least two divided bodies which are divided, and a gap or a concave portion as a thread accommodating portion capable of inserting and accommodating the sewing threads is therein disposed between the divided bodies adjacent to each other in the length direction of the fixing member.

In the present invention, the insert pin portion or the box portion may have a component main body portion wrapping the fixing member along the fixing member and a fin portion extending from the component main body portion in the width direction. In this case, it is preferable that an accommodating concave groove portion or an accommodating concave portion as a thread accommodating portion accommodating the sewing threads of the component sewn portion is disposed, or a hole portion which makes the sewing threads passed through and penetrated into the fin portion is disposed in advance on the fin portion.

Another element member provided by the present invention has a fixing member, fastener elements attached to the fixing member and an insert pin portion or a box portion which is disposed so as to continue to element rows formed of the fastener elements and forms a separable rear end stop for a slide fastener, the fastener elements and the insert pin portion or the box portion are fixed to the fixing member, and the insert pin portion or the box portion has a thread accommodating portion capable of accepting and accommodating the sewing threads sewing the insert pin portion or the box portion to the fastener attached member as a most principal configuration.

In the element member of the present invention, it is preferable that the fixing member has an extending part extending from the insert pin portion or the box portion in a direction away from the fastener element in the length direction.

In the element member of the present invention, it is also preferable that the insert pin portion or the box portion has at least two divided bodies which are divided and a gap or a concave portion as the thread accommodating portion capable of inserting and accommodating the sewing threads therein is disposed between the divided bodies adjacent to each other in the length direction of the fixing member.

In the present invention, the insert pin portion or the box portion may have a component main body portion wrapping the fixing member along the fixing member and a fin portion extending from the component main body portion in the width direction. In this case, it is preferable that an accommodating concave groove portion or an accommodating concave portion as the thread accommodating portion accommodating the sewing threads of the component sewn portion is disposed, or a hole portion which makes the sewing threads passed through and penetrated into the fin portion is disposed in advance on the fin portion.

Next, a manufacturing method provided by the present invention includes, in a manufacturing method for manufacturing a slide fastener-attached product, forming a first element member in which fastener elements and an insert pin portion forming a separable rear end stop for a slide fastener are attached to a fixing member and having an element holding portion in which the fastener elements are attached to the fixing member and a component holding portion in which the insert pin portion is attached to the fixing member with respect to a length direction of the fixing member; forming a second element member in which fastener elements and a box portion forming the separable rear end stop are attached to a fixing member and having an element holding portion in which the fastener elements are attached to the fixing member and a component holding portion in which the box portion is attached to the fixing member with respect to the length direction of the fixing member; forming fastener attached members having a pair of element attaching edge portions in a position facing to each other; and forming component sewn portions piercing the fastener attached members and fixing at least the component holding portions of the first element member and the second element member to the element attaching edge portions with component sewn portions by conducting a sewing processing on the first element member, the second element member and the corresponding element attaching edge portions of the fastener attached members by using a sewing machine, as a most principal configuration.

Effects of the Invention

The slide fastener-attached product according to the present invention has an opening and closing portion capable of opening and closing by a sliding operation of a slider and is formed to be able to attach a separable rear end stop having at least an insert pin portion and a box portion at one end part in a length direction of the opening and closing portion. It should be noted that, in the present invention, a box portion collectively means a box body portion having an insert pin accommodating portion, a box pin portion in which an insert pin accommodating portion is not provided and which has a stopper portion stopping a slider and a box pin-box body portion in which the box pin portion and the box body portion are integrally formed.

The slide fastener-attached product according to the present invention has a first element member in which a plurality of fastener elements for a slide fastener and an insert pin portion of a separable rear end stop for a slide fastener are attached to a fixing member, a second element member in which a plurality of fastener elements for a slide fastener and a box portion of a separable rear end stop for a slide fastener are attached to a fixing member and a fastener attaching members of a product having a pair of element attaching edge portions to which a pair of the first element member and the second element member are attached in a position facing to each other. In this case, the fixing member is a flexible and long member, especially a string-shaped member.

In the slide fastener-attached product according to the present invention, each of the first element member and the second element member has an element holding portion in which the fastener elements are attached to the fixing member and a component holding portion disposed at one end part in the length direction of the first element member and the second element member and in which the insert pin portion or the box portion is attached to the fixing member with respect to the length direction of the fixing member. In this case, the component holding portion extends to one direction in the length direction further than an end part fastener element disposed on an end part on one side in the length direction among a plurality of fastener elements of the first element member or the second element member.

Further, in the present invention, the first element member and the second element member are respectively fixed to the element attaching edge portions of the fastener attached members disposed in an opposing manner, and particularly at least component holding portions of the first element member and the second element member are fixed to the element attaching edge portions with component sewn portions formed by sewing with a sewing machine. In this case, the component sewn portion of the present invention is formed of a plurality of sewing threads and also formed so as to pierce the fastener attached member to which the first element member or the second element member is attached.

In the slide fastener-attached product as described above, the first element member having the insert pin portion and the second element member having the box portion are easily and stably fixed to the fastener attached members. Moreover, a fixed state of the first element member and the second element member with respect to the fastener attached members can be stably maintained.

Further, in the slide fastener-attached product of the present invention, a slide fastener can be structured without using a fastener tape which was an essential component for a conventional and general slide fastener, and a separable rear end stop having an insert pin portion and a box portion can be stably formed at a predetermined position.

Accordingly, in the slide fastener-attached product of the present invention, the fastener tape becomes unnecessary, thereby weight saving and improvement of softness of the slide fastener-attached product can be achieved. Moreover, by providing the separable rear end stop, it becomes possible to uncouple and separate left and right fastener attached members easily.

Further in the present invention, the first element member and the second element member can be fixed later and directly to the fastener attached member to which, for example, a desired function such as waterproofness is added. Therefore, it also becomes possible to manufacture a slide fastener-attached product in which the fastener attached member (cloth) has a particular function at low cost and easily.

Accordingly, in the slide fastener-attached product of the present invention, ease of use and convenience of the slide fastener can be substantially improved. Therefore, the products according to the present invention is more preferably used for commodities such as clothing, shoes and bags, and as for other than commodities, also preferably used for products for industrial materials and various kinds of seats for automobiles and aircrafts.

In the above-mentioned slide fastener-attached product of the present invention, the component sewn portion which fixes the component holding portions of the first element member and the second element member to the element attaching edge portions is formed, with respect to the length direction, within at least a part of a directly-attached region within which the insert pin portion or the box portion is attached to the fixing member so as to directly contact intermittently or continuously, preferably within 90% or more of the region, particularly preferably within the whole directly-attached region. Thereby, the component holding portion of the first element member and the second element member can be firmly fixed to the element attaching edge portion of the fastener attached members. In addition, a fixed state of the component holding portion can be stably maintained.

In the slide fastener-attached product of the present invention, the component sewn portion is, with respect to the length direction, disposed so as to extend continuously from the directly-attached region within which the insert pin portion or the box portion is directly attached to the fixing member to the element holding portion side beyond a position corresponding to an end edge (front end edge) on a near side to the element holding portion of the directly-attached region. Thereby, the component holding portions of the first element member and the second element member can be more firmly fixed to the element attaching edge portions. Moreover, a fixed state of the component holding portion can be more stably maintained. In this case, it is enough that the component sewn portion is formed continuously at least at a part beyond a position corresponding to the front end edge of the directly-attached region. In a part other than the part beyond the position, the component sewn portion may be formed of a plurality of sewn portions (sewing lines) separated with each other or a plurality of sewn portions (sewing lines) overlapping with each other in part.

Further, in the slide fastener-attached product of the present invention, the fixing member has an extending part extending from the insert pin portion or the box portion to a direction away from the element holding portion in the length direction. Thereby, the component holding portions of the first element member and the second element member can be firmly fixed to the element attaching edge portions to a rear end part.

In this case, the component sewn portion is disposed so as to extend continuously from the directly-attached region within which the insert pin portion or the box portion is directly attached to the fixing member to an opposite side to the element holding portion side beyond a position corresponding to an end edge (rear end edge) on a far side from the element holding portion of the directly-attached region. Thereby, the component holding portions of the first element member and the second element member can be more firmly fixed to the element attaching edge portions. Moreover, a fixed state of the component holding portion can be more stably maintained. In this case, it is enough that the component sewn portion is formed continuously at least at a part beyond a position corresponding to the rear end edge of the directly-attached region. In a part other than the part beyond the position, the component sewn portion may be formed of a plurality of sewn portions (sewing lines) separated with each other or a plurality of sewn portions (sewing lines) overlapping with each other in part.

In the slide fastener-attached product of the present invention as described above, the insert pin portion and the box portion have a gap-shaped, an opening-shaped, a concave-shaped, a groove-shaped or a hole-shaped thread accommodating portion accepting and accommodating the sewing threads of the component sewn portion. Further, the component sewn portion is formed so as to accommodate at least a part of the sewing threads of the component sewn portion in the thread accommodating portion of the insert pin portion or the box portion.

The thread accommodating portion as described above is provided on the insert pin portion and the box portion, thereby when the component holding portions of the first element member and the second element member are attached to the element attaching edge portions of the fastener attached members by using a sewing machine, the sewing threads are introduced to the thread accommodating portion of the insert pin portion or the box portion and can be easily accommodated. Further, since sewing can be conducted by making the thread accommodating portion provided on the insert pin portion and the box portion as a guide (mark), the insert pin portion and the box portion can be stably attached to the element attaching edge portions of the fastener attached members. In addition, the sewing threads of the component sewn portion are stably held within the thread accommodating portions of the insert pin portion and the box portion and are also protected by the thread accommodating portion from other members to be less likely to contact from an outside. Therefore, thread breakage becomes less likely to occur on the component sewn portion, and a state that the insert pin portion and the box portion are attached to the element attaching edge portions of the fastener attached members can be stably maintained.

In the slide fastener-attached product of the present invention, the component holding portions of the first element member and the second element member are fixed to the element attaching edge portions of the fastener attached members with the sewing threads of the component sewn portion holding and wrapping the fixing member disposed on the component holding portion while contacting with an outer peripheral surface of the fixing member, or holding and wrapping a part of the insert pin portion or the box portion while contacting with the outer peripheral surface thereof. Thus, the component holding portion of the first element member or the second element member can be firmly and stably fixed to the element attaching edge portion with the sewing threads of the component sewn portion.

In this case, the insert pin portion or the box portion has at least two divided bodies which are divided and the sewing threads of the component sewn portion are accommodated in a gap or a concave portion formed between the divided bodies. Therefore, the insert pin portion or the box portion can be firmly fixed to the element attaching edge portion of the fastener attached member with the sewing threads of the component sewn portion, and a fixed state of the insert pin portion or the box portion can be stably maintained. Further, since the sewing threads are accommodated and held between the divided bodies of the insert pin portion or the box portion, the sewing threads can be stably maintained at a predetermined position, and since the accommodated sewing threads is less likely to be contacted with other members from an outside, thread breakage can be less likely to occur.

In the slide fastener-attached product of the present invention, the component holding portion of the first element member or the second element member may be fixed to the element attaching edge portion with the sewing threads of the component sewn portion penetrating through the insert pin portion or the box portion and sewn directly to the element attaching edge portion. Here, the case that the sewing threads of the component sewn portion penetrate the insert pin portion or the box portion includes not only the one that when the first element member or the second element member is sewn to the fastener attached member with a sewing machine, a sewing needle of a sewing machine pierces the insert pin portion or the box portion to make the sewing threads penetrated, but also the one that, for example, a penetration hole or an opening portion through which a sewing needle can be inserted is provided on the insert pin portion or the box portion in advance, then a sewing needle passes the penetration hole or an opening portion to make the sewing threads penetrated. The insert pin portion or the box portion is sewn directly to the element attaching edge portion of the fastener attached member with the sewing threads of the component sewn portion as above, thereby the component holding portion of the first element member or the second element member can be firmly and stably fixed to the element attaching edge portion, too.

In this case, the insert pin portion or the box portion has a component main body portion wrapping the fixing member along the fixing member and a fin portion extending from the component main body portion in the width direction and disposed on one surface of the element attaching edge portion. An accommodating concave groove portion or an accommodating concave portion accommodating the sewing threads of the component sewn portion is disposed, or a hole portion making the sewing threads passed through and penetrated into the fin portion of the insert pin portion or the box portion is disposed in advance on the fin portion, and the fin portion of the insert pin portion or the box portion is sewn to the fastener attached member with the sewing threads of the component sewn portion.

Therefore, the insert pin portion or the box portion can be firmly fixed to the element attaching edge portion of the fastener attached member with the sewing threads of the component sewn portion, and a fixed state of the insert pin portion or the box portion can be stably maintained. Particularly, the above-mentioned accommodating concave groove portion, accommodating concave portion or hole portion is provided on the fin portion, thereby when the component holding portion of the first element member or the second element member is sewn to the fastener attached member, a sewing needle of a sewing machine can be easily penetrated into the fin portion and the sewing with a sewing machine can be stably conducted to a predetermined position. Further, the sewing threads of the component sewn portion is accommodated in the accommodating concave groove portion or the accommodating concave portion of the fin portion and stably held, and the sewing threads accommodated in the accommodating concave groove portion or the accommodating concave portion can be protected so as other members to be less likely to contact from an outside.

It should be noted that, the above-mentioned component main body portion means an insert pin main body portion disposed so as to wrap the fixing member in a case of the insert pin portion, a box body main body portion and/or a box pin main body portion disposed so as to wrap the fixing member in a case of the box portion. Further, the state that the component main body portion wraps the fixing member means that the component main body portion (insert pin main body portion or box body main body portion and the like) is attached to the fixing member in a state that the component main body portion covers at least a part of an outer peripheral surface of the fixing member. In this case, it is enough that at least a part of the outer peripheral surface of the fixing member is wrapped by the component main body portion, and the state includes not only the case that, for example, whole periphery of the outer peripheral surface of the fixing member is completely wrapped but also the case only a part of the outer peripheral surface of the fixing member is wrapped.

Further, the above-mentioned accommodating concave groove portion is formed on a surface of the fin portion having a groove width of a certain degree, and means, for example, a groove-shaped part concaving continuously in a linear or a curved shape. The accommodating concave portion is a part formed concavely on the surface of the fin portion having a size capable of accommodating the sewing threads, and does not need to be formed in a groove shape. The accommodating concave portion includes the above-mentioned accommodating concave groove portion and other forms of concave portions.

In the slide fastener-attached product of the present invention, the fastener elements and the insert pin portion or the box portion are fixed integrally to the fixing member in a predetermined shape by injection-molding synthetic resin. A plurality of fastener elements are formed independently and disposed on the fixing member at regular intervals. Thereby, left and right element rows and a separable rear end stop in the slide fastener can be stably formed. Moreover, the left and right element rows can be stably coupled and separated, and a stable performance and function of the separable rear end stop can be secured.

In the present invention, the element holding portions of the first element member and the second element member are fixed directly to the element attaching edge portions with element sewn portions piercing the fastener attached members. In this case, the sewing threads of the element sewn portion hold the fixing member so as to wrap while contacting the outer peripheral surface of the fixing member in the element member. Thereby, the element holding portions of the first element member and the second element member are easily and stably fixed with the element sewn portions along the element attaching edge portion of the fastener attached member.

It is preferable that a position at which the element sewn portion pierces the element attaching edge portion is disposed separately from the fastener elements inside of the element attaching edge portion in the width direction of the first element member and the second element member. In other words, a predetermined space is formed between the position at which the element sewn portion pierces the fastener attached member and the fastener elements of the element member in the width direction of the first element member and the second element member. Thereby, damage such as breakage of the element attaching edge portion of the fastener attached member can be less likely to occur due to the sewing threads of the element sewn portion.

In this case, the element sewn portion and the component sewn portion fixing the first element member or the second element member are formed continuously bending in a zigzag shape with respect to the length direction of the fixing member, for example, by lock stitching with a sewing machine. The element sewn portion is formed of the sewing threads repeating a predetermined stitch pattern per fastener element, and the component sewn portion is formed by repeating a stitch pattern in the element sewn portion.

Therefore, the element holding portion of the first element member or the second element member and the component holding portion having the insert pin portion or the box portion can be sewn to the element attaching edge portion of the fastener attached member stably and continuously by using a sewing machine, and both of the element holding portion and the component holding portion can be smoothly and stably attached to the fastener attached member.

In the present invention, the element sewn portion and the component sewn portion of the first element member or the second element member are formed with continuous lock stitches or individual lock stitches with a sewing machine. The element sewn portion fixing the element holding portion is formed bending in a zigzag shape with respect to the length direction of the fixing member, while the component sewn portion fixing the component holding portion may be formed linearly. Also in such a manner, both of the element holding portion and the component holding portion of the first element member or the second element member can be smoothly and stably attached to the fastener attached member by using a sewing machine.

In the slide fastener-attached product of the present invention, the first element member and the second element member are stably fixed to the element attaching edge portions of the fastener attached members with the above-mentioned element sewn portion and the component sewn portion at a position along the element attaching edge portion at an outside in the width direction, thereby the slide fastener can be stably formed to the fastener attached member.

Further in the slide fastener-attached product of the present invention, the box portion has at least a box body portion which has an insert pin accommodating portion capable of inserting and accommodating the insert pin portion therein and stops a slider by contacting. The slider is attached to the element rows formed of a plurality of fastener elements slidably in a posture that the rear mouth of the slider faces to the box body portion. That is, in the present invention, a separable rear end stop which is a type of having at least an insert pin portion and a box body portion (a type having a box body portion) can be provided to a slide fastener-attached product without fastener tapes. In this case, a box pin-a box body portion in which a box pin portion is formed integrally to the box body portion may be formed, or only the box body portion may be formed, as a box portion.

In the present invention, it is also possible that a first slider and a second slider are attached to the element rows formed of fastener elements slidably in a posture that the rear mouths of respective sliders face to each other, and the box portion has a box pin portion inserted into the first slider and the second slider and a stopper portion which stops either the first slider or the second slider by contacting. That is, in the present invention, a separable rear end stop which is an open reverse type in which the insert pin portion and the box portion are disposed so as to face to each other and not having the box body portion (a type without a box body portion) can be provided to the slide fastener-attached product without fastener tapes.

Next, the element member according to the present invention has a fixing member, a plurality of independent fastener elements which are attached to the fixing member at regular intervals and an insert pin portion or a box portion which is disposed continuously to an element row formed of the plurality of fastener elements and forms a separable rear end stop for a slide fastener. Respective fastener elements and the insert pin portion or the box portion are formed integrally and fixed to the fixing member by injection-molding synthetic resin to the fixing member. Further, the component holding portion in which the insert pin portion or the box portion is fixed to the fixing member has a structure able to be fixed with a component sewn portion formed of the sewing threads and piercing the fastener attached member.

With such an element member as in the present invention, the element member, particularly the component holding portion of the element member can be easily and stably fixed to the element attaching edge portion of the fastener attached member by using a sewing machine. Moreover, a fixed state of the element member to the fastener attached member can be stably maintained.

In addition, by manufacturing a slide fastener-attached product using the above-mentioned element member of the present invention, it is possible that the slide fastener can be structured without using a fastener tape which was an essential component for a conventional and general slide fastener, and the separable rear end stop having the insert pin portion and the box portion can be stably formed at a predetermined position.

Particularly in the element member of the present invention, the insert pin portion or the box portion has a gap-shaped, an opening-shaped, a concave-shaped, a groove-shaped, or a hole-shaped thread accommodating portion capable of accepting and accommodating the sewing threads which sew the insert pin portion or the box portion to the fastener attached member. Thereby, when the insert pin portion or the box portion is attached to the fastener attached member by using a sewing machine, sewing can be conducted smoothly by making the thread accommodating portion as a guide (mark), and the sewing threads of the sewing machine are introduced to the thread accommodating portion of the insert pin portion or the box portion and can be easily accommodated.

Therefore, the insert pin portion and the box portion can be stably attached to a predetermined position of the element attaching edge portion of the fastener attached member. In addition, the sewing threads fixing the insert pin portion or the box portion to the fastener attached member is stably held in the thread accommodating portions of the insert pin portion and the box portion and are protected by the thread accommodating portion from other members to be less likely to contact from an outside. Thus, breakage of the sewing threads is less likely to occur and an attached state of the insert pin portion or the box portion can be stably maintained.

In such an element member as in the present invention, the fixing member has an extending part extending from the insert pin portion or the box portion toward a direction away from the fastener element in the length direction. Thereby, the component holding portions of the first element member and the second element member can be firmly fixed to the element attaching edge portions to the rear end part.

In the element member of the present invention, the insert pin portion or the box portion has at least two divided bodies which are divided. A gap or a concave portion capable of inserting and accommodating the sewing threads therein as a thread accommodating portion is disposed between the divided bodies adjacent to each other in the length direction of the fixing member in the element member Thus, the element member of the present invention is attached to the element attaching edge portion of the fastener attached member by using a sewing machine, thereby the insert pin portion or the box portion can be firmly fixed to the fastener attached member with the sewing threads and a fixed state of the insert pin portion or the box portion can be stably maintained. Further, since the sewing threads are accommodated and held between the divided bodies of the insert pin portion or the box portion, the sewing threads can be stably maintained at a predetermined position, and thread breakage can be less likely to occur since other members are less likely to contact with the sewing threads.

In the present invention, the insert pin portion or the box portion may have a component main body portion wrapping the fixing member along the fixing member and a fin portion extending from the component main body portion in the width direction. The insert pin portion or the box portion has the fin portion, thereby the insert pin portion or the box portion can be easily attached to the fastener attached member by using a sewing machine. In addition, the insert pin portion or the box portion can be stably and easily fixed to the fastener attached member with the sewing threads.

In this case, it is preferable that, as a thread accommodating portion, an accommodating concave groove portion or an accommodating concave portion capable of inserting and accommodating the sewing threads therein, or a hole portion capable of making the sewing threads passed through and penetrated into the fin portion of the insert pin portion or the box portion is disposed on the fin portion.

Thereby, the insert pin portion or the box portion can be firmly fixed to the fastener attached member with the sewing threads, and a fixed state of the insert pin portion or the box portion can be stably maintained. Particularly, the above-mentioned accommodating concave groove portion, accommodating concave portion or hole portion is provided on the fin portion, thereby when the element member is sewn to the fastener attached member by using a sewing machine, a sewing needle of a sewing machine can easily penetrate the fin portion, and sewing with a sewing machine can be stably conducted to a predetermined position. Further, the sewing threads can be accommodated in the accommodating concave groove portion or the accommodating concave portion of the fin portion and can be stably held, and since other members can be less likely to contact with the sewing threads accommodated in the accommodating concave groove portion or the accommodating concave portion from an outside, thread breakage can be less likely to occur.

Next, an element member according to another embodiment of the present invention has a fixing member, a plurality of independent fastener elements which are attached to the fixing member at regular intervals and an insert pin portion or a box portion which is disposed continuously to an element row formed of the plurality of fastener elements and forms a separable rear end stop for a slide fastener. Respective fastener elements and the insert pin portion or the box portion are formed integrally and fixed to the fixing member by injection-molding synthetic resin to the fixing member. Further, the insert pin portion or the box portion has a gap-shaped, an opening-shaped, a concave-shaped, a groove-shaped or a hole-shaped thread accommodating portion capable of accepting and accommodating the sewing threads which sew the insert pin portion or the box portion to the fastener attached member.

With such an element member as in the present invention, the element member, particularly the component holding portion of the element member can be easily and stably fixed to the element attaching edge portion of the fastener attached member by using a sewing machine. In addition, a fixed state of the element member to the fastener attached member can be stably maintained. Particularly, the insert pin portion or the box portion has the above-mentioned thread accommodating portion, thereby when the insert pin portion or the box portion is attached to the fastener attached member by using a sewing machine, sewing can be conducted smoothly by making the thread accommodating portion as a guide (mark), and the sewing threads are introduced to the thread accommodating portion of the insert pin portion or the box portion and can be easily accommodated.

Thus, the insert pin portion and the box portion can be stably attached to a predetermined position of the element attaching edge portion of the fastener attached member. Further, the sewing threads fixing the insert pin portion or the box portion to the fastener attached member is stably held in the thread accommodating portions of the insert pin portion and the box portion and are protected by the thread accommodating portion from other members to be less likely to contact from an outside. Thus, breakage of the sewing threads becomes less likely to occur, and an attached state of the insert pin portion or the box portion can be stably maintained.

By manufacturing a slide fastener-attached product using the above-mentioned element member of the present invention, it is possible that the slide fastener can be structured without using a fastener tape which was an essential component for a conventional and general slide fastener, and the separable rear end stop having the insert pin portion and the box portion is stably formed at a predetermined position.

In such an element member as in the present invention, the fixing member has an extending part extending from the insert pin portion or the box portion to a direction away from the fastener element in the length direction. Thereby, the component holding portions of the first element member and the second element member can be firmly fixed to the element attaching edge portions to the rear end part.

In the element member of the present invention, the insert pin portion or the box portion has at least two divided bodies which are divided. A gap or a concave portion capable of inserting and accommodating the sewing threads therein as a thread accommodating portion is disposed between the divided bodies adjacent to each other in the length direction of the fixing member in the element member.

Therefore, the element member of the present invention is attached to the element attaching edge portion of the fastener attached member by using a sewing machine, thereby the insert pin portion or the box portion can be firmly fixed to the fastener attached member with the sewing threads, and a fixed state of the insert pin portion or the box portion can be stably maintained. Further, since the sewing threads are accommodated and held between the divided bodies of the insert pin portion or the box portion, the sewing threads can be stably maintained at a predetermined position. Also, since other members can be less likely to contact with the sewing threads from an outside, thread breakage can be less likely to occur.

In the present invention, the insert pin portion or the box portion may have a component main body portion wrapping the fixing member along the fixing member and a fin portion extending from the component main body portion in the width direction. The insert pin portion or the box portion has the fin portion, thereby the insert pin portion or the box portion can be easily attached to the fastener attached member by using a sewing machine. In addition, the insert pin portion or the box portion can be stably and easily fixed to the fastener attached member with the sewing threads.

In this case, it is preferable that, as a thread accommodating portion, an accommodating concave groove portion or an accommodating concave portion capable of inserting and accommodating the sewing threads therein, or a hole portion capable of making the sewing threads passed through and penetrated into the fin portion of the insert pin portion or the box portion is disposed on the fin portion.

Thereby, the insert pin portion or the box portion can be firmly fixed to the fastener attached member with the sewing threads, and a fixed state of the insert pin portion or the box portion can be stably maintained. Particularly, the above-mentioned accommodating concave groove portion, accommodating concave portion or hole portion is provided on the fin portion, thereby when the element member is sewn to the fastener attached member by using a sewing machine, a sewing needle of the sewing machine can easily penetrate the fin portion, and sewing with a sewing machine can be stably conducted at a predetermined position. Further, the sewing threads can be accommodated in the accommodating concave groove portion or the accommodating concave portion of the fin portion and can be stably held, and since other members can be less likely to contact with the sewing threads accommodated in the accommodating concave groove portion or the accommodating concave portion from an outside, thread breakage can be less likely to occur.

Next, a manufacturing method of a slide fastener-attached product according to the present invention is forming a first element member in which fastener elements having a predetermined shape and an insert pin portion forming a separable rear end stop for a slide fastener are attached to a fixing member, for example, by injection-molding synthetic resin to the fixing member and also which has an element holding portion in which the fastener elements are attached to the fixing member and a component holding portion in which the insert pin portion is attached to the fixing member with respect to the length direction of the fixing member.

Then, a second element member in which fastener elements having a predetermined shape and an box portion forming a separable rear end stop for a slide fastener are attached to a fixing member by injection-molding synthetic resin to the fixing member and also which has an element holding portion in which the fastener elements are attached to the fixing member and a component holding portion in which the box portion is attached to the fixing member with respect to the length direction of the fixing member. Other than the first element member and the second element member, a fastener attached member having a pair of element attaching edge portions in a position facing to each other is formed.

Then, a sewing processing is conducted on the formed first element member, the second element member and the corresponding element attaching edge portions of the fastener attached members, thereby component sewn portions piercing the fastener attached members are formed, and at least the component holding portions of the first element member and the second element member are fixed respectively to the element attaching edge portions of the fastener attached members with the component sewn portions.

Therefore, the first element member having the insert pin portion and the second element member having the box portion can be directly and easily fixed to the fastener attached member. In addition, a fixed state of the first element member and the second element member with respect to the fastener attached member can be stable. As a result, a separable rear end stop having the insert pin portion and the box portion at a predetermined position of the slide fastener-attached product can be easily formed, and since a stable performance and function of the formed separable rear end stop can be secured, the left and right fastener attached members can be easily uncoupled and separated. Further, a slide fastener-attached product without a fastener tape can be easily manufactured, and reduction of manufacturing cost, weight saving and improvement of softness of the slide fastener-attached product becomes possible.

DESCRIPTION OF EMBODIMENT

Hereinafter, preferred embodiments of the present invention are described in detail with Embodiments referring to drawings. It should be noted that the present invention is not limited thereto, and various changes can be made as far as they have a substantially same structure and same functional effects.

For example, in the Embodiments below, cases that a slide fastener-attached product means a slide fastener-attached clothing item are explained, but the slide fastener-attached product according to the present invention is not limited to clothing item (clothes) and includes various products such as commodities like shoes and bags, products such as industrial materials, and various kinds of seats for automobiles, trains and aircrafts.

Moreover, in a separable rear end stop explained in the following Embodiments, an insert pin portion is disposed on a left side and a box portion such as a box body portion or a box pin portion is disposed on a right side when viewing clothing item as a product from a front side, that is, the separable rear end stop is formed as so-called right feed one which a person wearing the clothing item operates with his right hand. However, in the present invention by reversing a position relationship between an insert pin portion and a box portion in a left and right direction with respect to the following Embodiments, for example, a so-called left feed separable rear end stop can be formed on a slide fastener-attached product.

Embodiment 1

Figure 1:
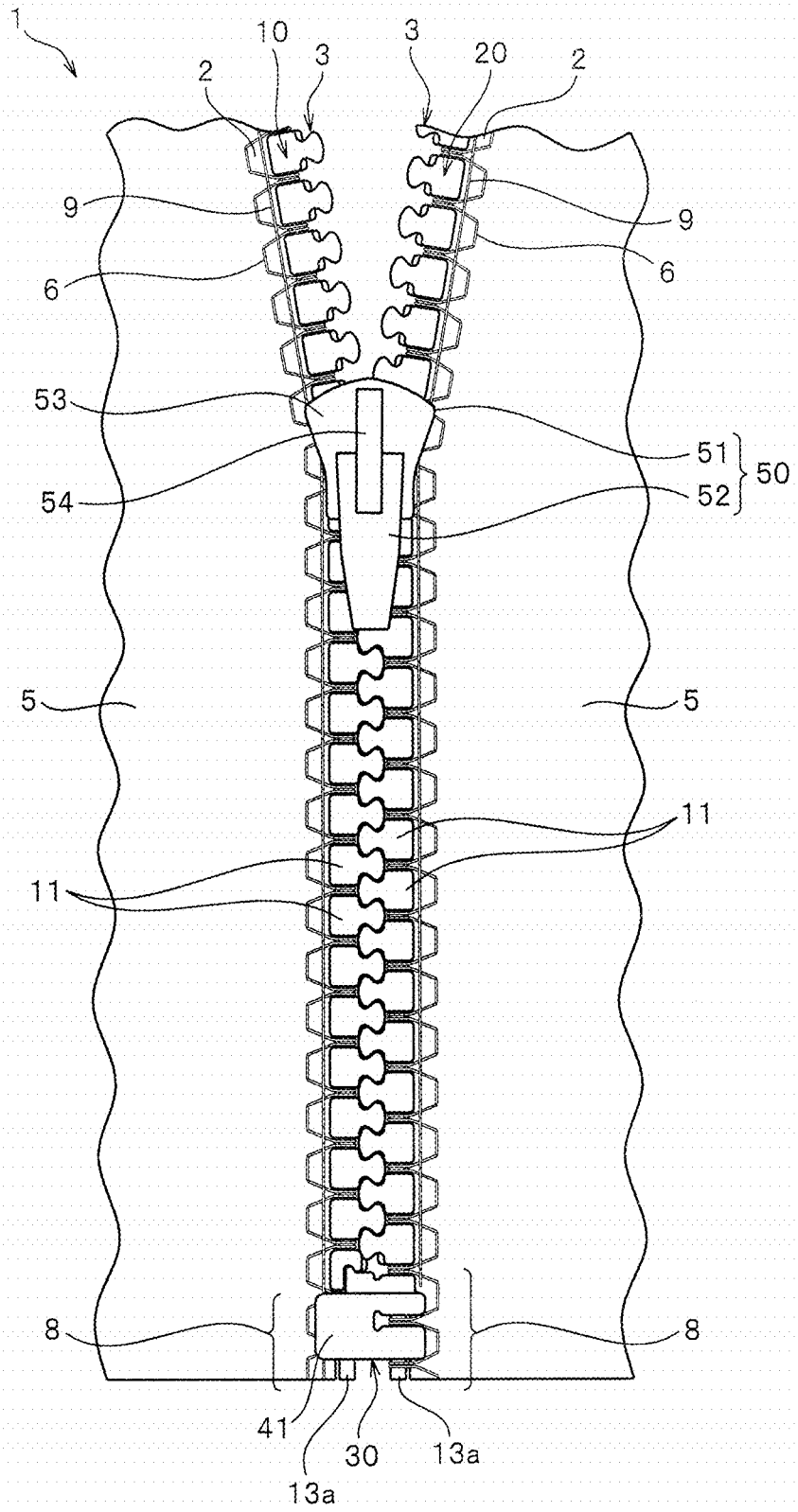
FIG. 1 is a plan view illustrating a main part of a slide fastener-attached product (clothing item) according to Embodiment 1 of the invention schematically.
Figure 2:
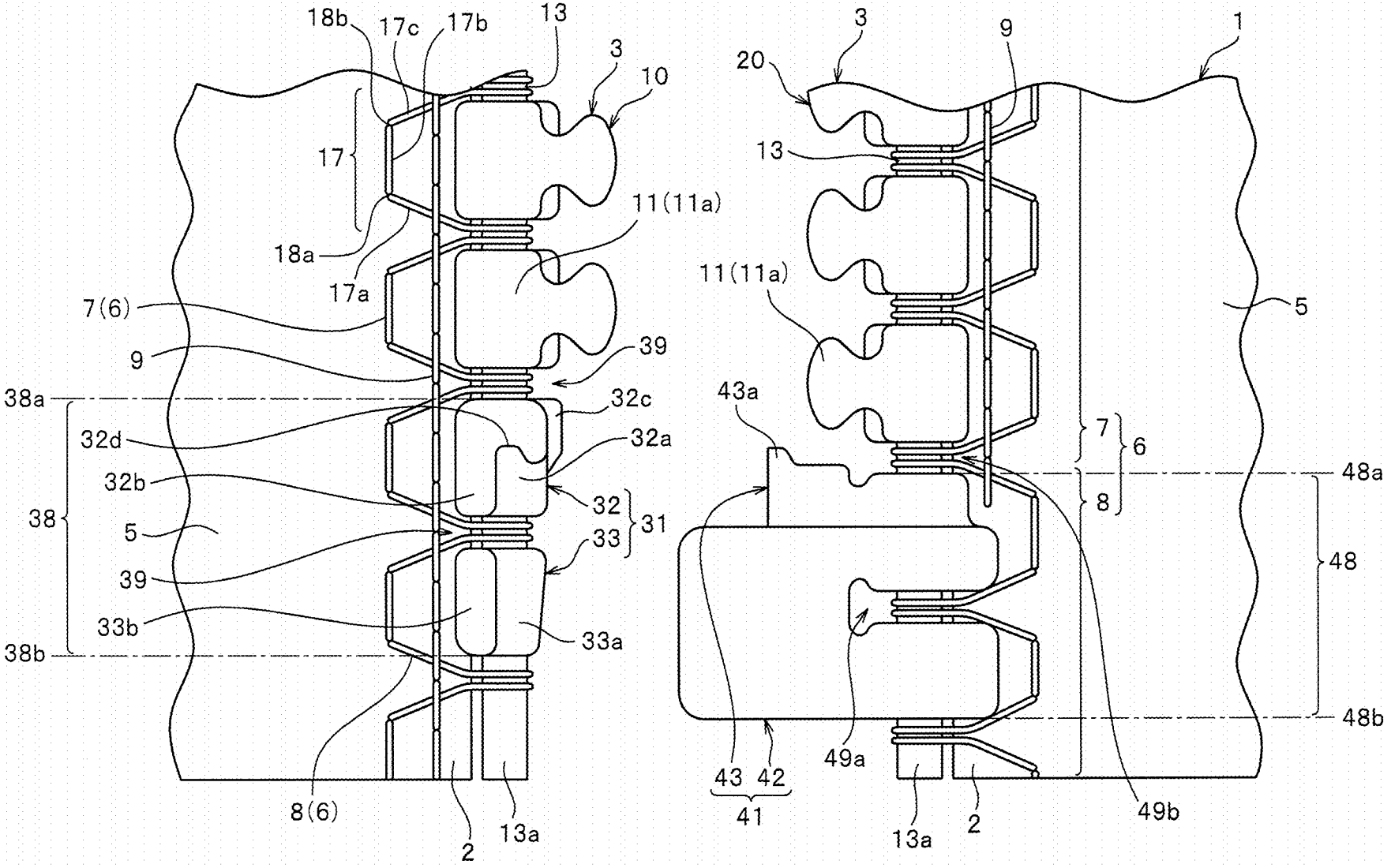
FIG. 2 is a plan view illustrating a main part of the slide fastener-attached product (clothing item) in a state that a separable rear end stop is separated.
Figure 3:
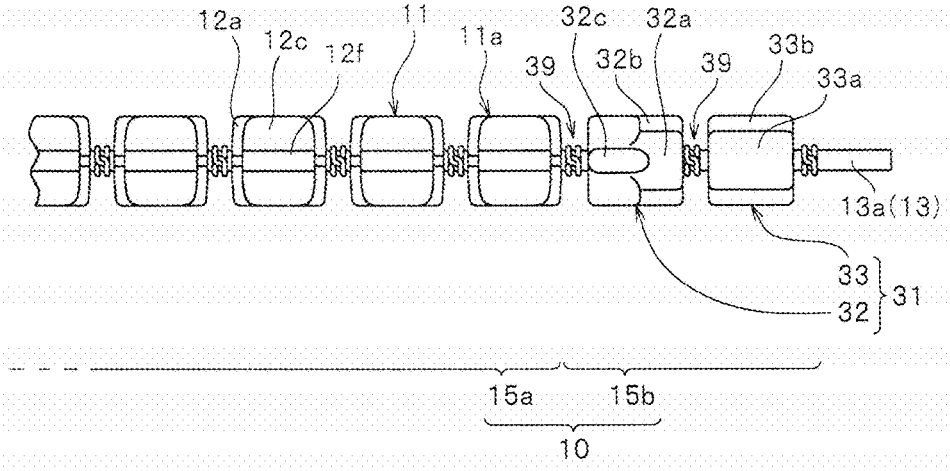
FIG. 3 is a side view of a product on a side to which an insert pin portion of the separable rear end stop is attached.
Figure 4:
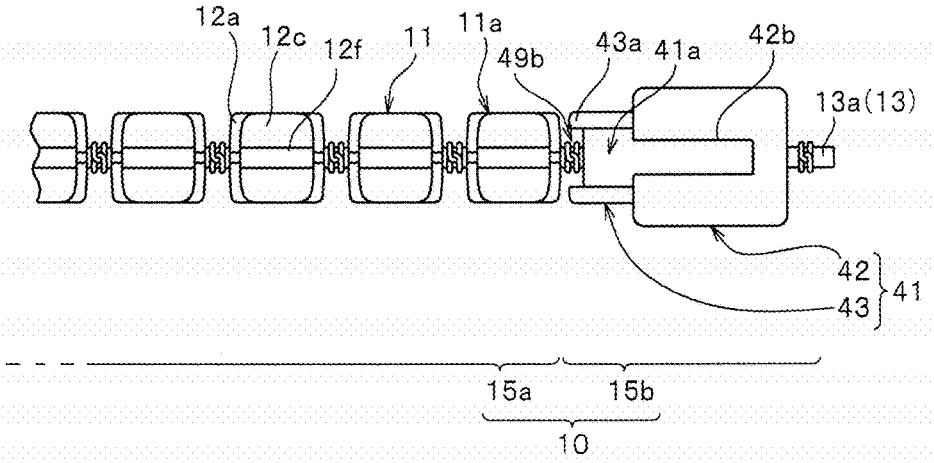
FIG. 4 is a side view of a product on a side to which a box portion of the separable rear end stop is attached.
Figure 5:
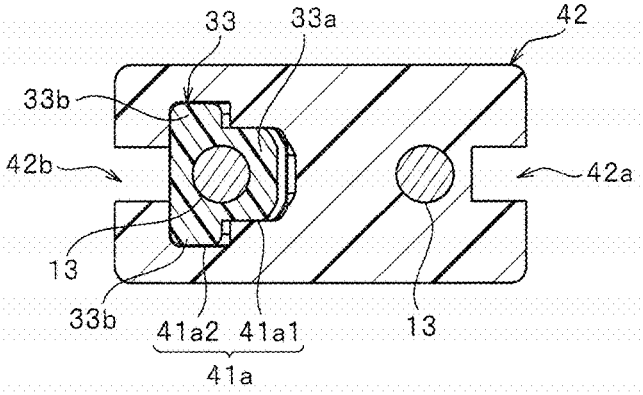
FIG. 5 is a cross-sectional view of the separable rear end stop.

FIG. 1 shows a plan view illustrating a main part of a slide fastener-attached clothing item according to Embodiment 1 of the invention schematically. FIG. 2 is a plan view illustrating a main part of the clothing item in a state that a separable rear end stop is separated. FIGS. 3 and 4 are side views of front placket parts of the clothing item on which an insert pin portion and a box body portion of the separable rear end stop are respectively provided from counterpart side of coupling. FIG. 5 is a cross-sectional view of the separable rear end stop.

In the following explanation, a front and rear direction means a length direction of a first element member and a second element member parallel to a slider sliding direction. Particularly, the direction in which the slider slides so as left and right element rows to be coupled means a frontward, and the direction in which the slider slides so as the left and right element rows to be separated means a rearward. In other words, the frontward and the rearward means directions away from and approaching to the separable rear end stop.

A left and right direction means a width direction of the first element member and the second element member (or a width direction of a cloth to be a fastener attached member), and for example, a direction perpendicular to the slider sliding direction and parallel to a top surface and a back surface of the cloth. An upper and lower direction means a direction perpendicular to the front and rear direction and the left and right direction, and for example, a thickness direction of the element member perpendicular to the top surface and the back surface of the cloth. Particularly in the following cases, a direction in which a tab of the slider is disposed with respect to the element member means upper and the opposite direction means lower.

A slide fastener-attached product 1 according to Embodiment 1 is a slide fastener-attached clothing item (clothes) 1, and left and right element attaching edge portions 2 to which a pair of first element member 10 and second element member 20 are attached are disposed on cloths 5 forming front bodies (particularly front placket parts) which becomes an opening and closing part of the clothing item 1.

The first element member 10 and the second element member 20 are respectively attached to the left and right element attached portions 2 of such clothing item by sewing, and left and right element rows 3 are formed of a plurality of fastener elements 11 disposed on the left and right first element member 10 and second element member 20.

A separable rear end stop 30 having an insert pin portion 31 and a box portion 41 is formed on a rear end part (lower end part in FIG. 1) of the left and right element attaching edge portions 2 in the clothing item 1. Further, a single slider 50 is attached slidably to and along the left and right element rows 3. By sliding the slider 50 along the element rows 3 in a front or rear direction, the left and right element rows 3 are coupled or separated, thereby front placket parts (opening and closing part) of left and right front bodies in the clothing item can be closed or opened.

In this case, cloths composing the front bodies of the clothing item (garment cloth) becomes fastener attached members 5 to which the first element member 10 and the second element member 20 are attached. Accordingly, the slide fastener structured in Embodiment 1 has a left and right pair of fastener stringer portions having left and right element rows 3 formed by fixing the first element member 10 and the second element member 20 directly to the cloth 5 of the clothing item, the slider 50 capable of coupling and separating the element rows 3 of the left and right fastener stringer portions and a separable rear end stop 30 disposed adjacent to rear end parts of the left and right element rows 3.

The cloth 5 to be the fastener attached member has an ability and a nature necessary for clothing item (softness, thickness, texture and color). In embodiment 1, the cloth 5 to which the element member is sewn is cut in a predetermined shape and dimension corresponding to a form or a design of the clothing item. The left and right element attaching edge portions 2 provided on the cloths 5 of the clothing item (fastener attached members) are disposed linearly and continuously in a position facing to each other in the front bodies of the clothing item (that is, at the opposing edge parts of the front placket parts).

Figure 7:
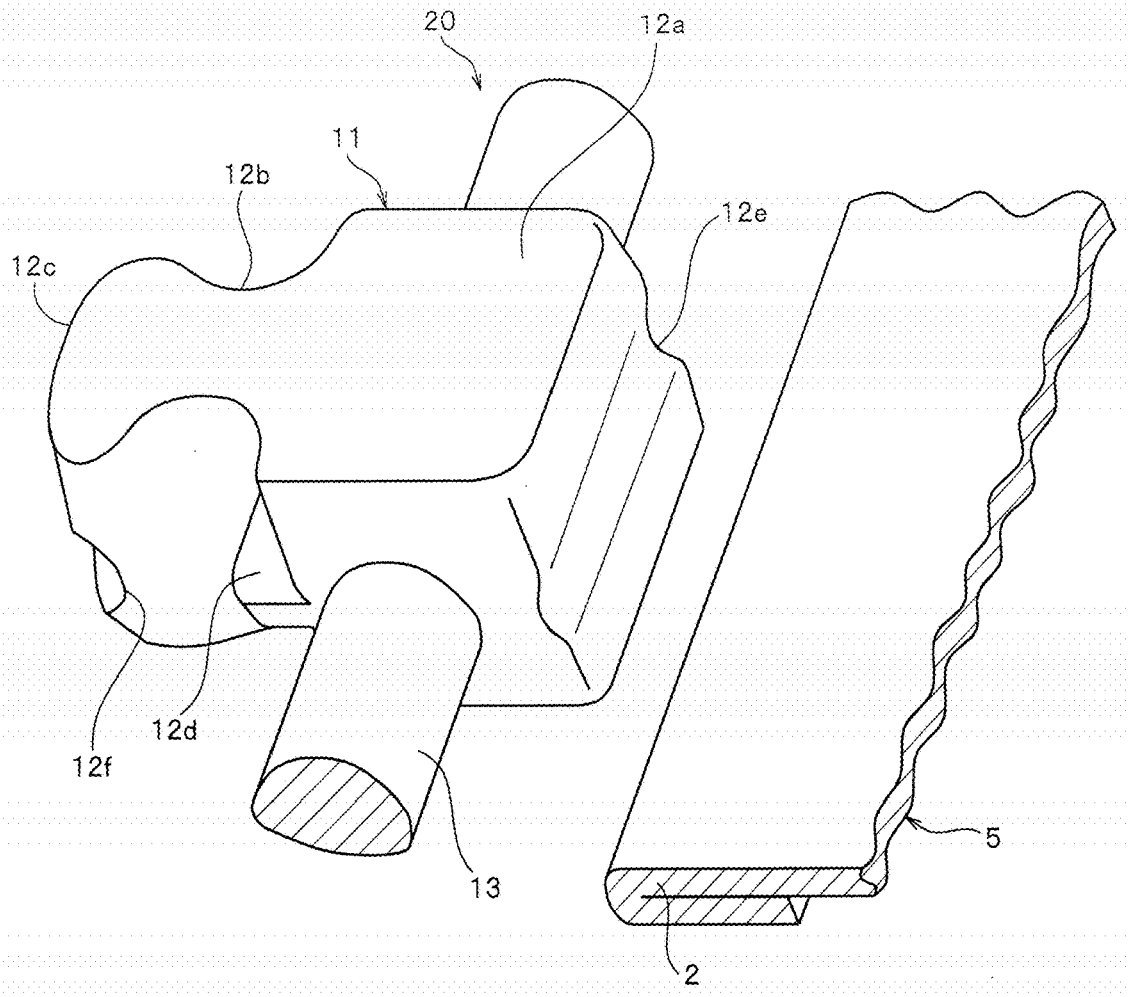
FIG. 7 is a perspective and expanded view illustrating a state before the element member is attached to a fastener attaching edge portion of a product.
Figure 8:
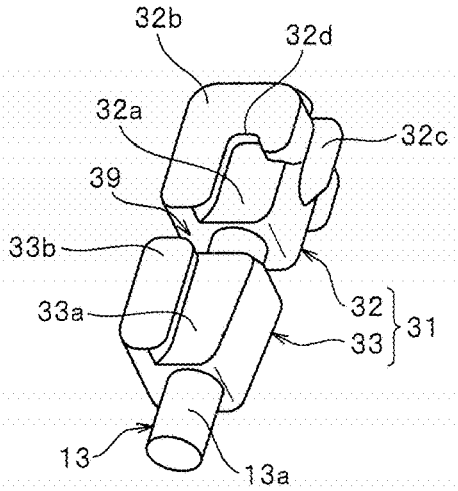
FIG. 8 is a perspective view illustrating an insert pin portion of the first element member.
Figure 9:
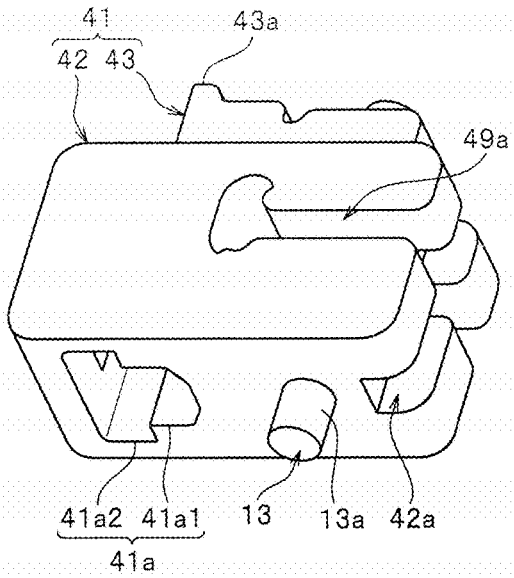
FIG. 9 is a perspective view illustrating a box portion of the second element member.

In this case, the left and right element attaching edge portions 2 are, as shown in FIG. 7, formed such that a side edge part to be a cut end part of the cloth 5 is folded in a U-shape in a width direction of the element member. The element attaching edge portions 2 are formed as above, thereby strength of the element attaching edge portion 2 can be enhanced. Therefore the element attaching edge portion 2 becomes less likely to be cut, and durability of the element attaching edge portion 2 can be enhanced. Further, by enhancing strength of the element attaching edge portion 2, the first element member 10 and the second element member 20 can be firmly fixed to the element attaching edge portions 2.

Further, by folding the side edge part of the cloth 5 in a U-shape, for example, even when a fraying occurs at the side end edge of the cloth 5, the fraying can be hidden at a rear surface side of the element attaching edge portion 2 and can be made not to be exposed outside. Thereby, the slide fastener-attached clothing item 1 can have good appearance quality (visual quality). Further, it can be prevented that a coupling state of the left and right element rows 3 becomes worsen and slidability of the slider 50 deteriorates caused by the fraying occurred at the side end edge of the cloth 5.

The left side first element member 10 in Embodiment 1 has one string-shaped fixing member 13 (also referred to as a core string member), a plurality of independent fastener elements 11 (also referred to as a single fastener element) fixed to the fixing member 13 at constant intervals (attaching pitch) and an insert pin portion 31 fixed to the rear end part of the fixing member 13. Here, the interval (attaching pitch) between the fastener elements 11 means an interval (dimension) in a length direction between predetermined positions (for example, central positions) in the length direction of respective fastener elements 11 in the fastener elements 11 adjacent in the length direction.

The right side second element member 20 has one string-shaped fixing member 13, a plurality of independent fastener elements 11 fixed to the fixing member 13 at constant intervals and a box portion 41 fixed to the rear end part of the fixing member 13. In this case, though each fastener element 11 disposed on the left side first element member 10 and each fastener element 11 disposed on the right side second element member 20 are formed in a left and right-symmetrical shape, both have a substantially same structure.

A plurality of fastener elements 11 disposed respectively on the first element member 10 and the second element member 20 are in a line along the length direction in a state of being connected with the fixing member 13 at regular intervals. These fastener elements 11 are formed integrally to the fixing member 13 in a predetermined shape by injection-molding thermoplastic resin such as, for example, polyacetal, polyamide, polypropylene and polybutylene terephthalate to one fixing member 13.

Here, among a plurality of fastener elements 11 disposed on the fixing members 13 of the first element member 10 and the second element member 20, the fastener element 11 disposed on the far end in the length direction on a side where the separable rear end stop 30 (the insert pin portion 31 or the box portion 41) is disposed is prescribed as an end part fastener element 11*a* (also often referred to as a first fastener element).

It should be noted that, in the present invention, a material of the fastener element 11 is not limited to the above-mentioned synthetic resin, and the fastener element 11 can be formed of, for example, other synthetic resin or metals. Further, the first element member 10 and the second element member 20 in Embodiment 1 are not limited to the ones that the fastener element 11 is formed by injection-molding thermoplastic resin to the fixing member 13, and include, for example, the one that the fastener elements formed by injection-molding thermoplastic resin in a predetermined shape are fixed to the fixing member by welding or adhesion.

Further, the first element member and the second element member of the present invention are not limited to the ones that the fastener elements 11 made of synthetic resin and injection-molded as in Embodiment 1 are formed integrally and connected to the fixing member 13. The first element member and the second element member of the present invention include, for example, the one that fastener elements are formed by die-casting metal to a string-shaped fixing member, the one that fastener elements (also referred to as element components) are manufactured by cutting a linear material (so-called Y bar) whose cross-sectional surface appears as an approximately Y-shape and the fastener elements are attached to the fixing member by pressing deformation, and the one that the fastener elements (also referred to as element components) are manufactured by punching a thin plate-shaped flat plate member and the fastener elements are attached to the fixing member by pressing deformation.

The fastener element 11 of Embodiment 1 has, as shown in FIG. 7, a body portion 12*a* fixed to the fixing member 13, a neck portion 12*b* extending continuously from the body portion 12*a* in the width direction of the first element member 10 (or the second element member 20) and having a constricted shape so as a dimension in the length direction to be narrow, a coupling head portion 12*c* further extending continuously from the neck portion 12*b* in the width direction and appearing as an approximately oval shape in a plan view and protruded piece portions 12*d* (also referred to as shoulder portion) protruding frontward and rearward from the neck portion 12*b*.

The body portion 12*a* of the fastener element 11 has an approximately rectangular parallelepiped form having a constant thickness dimension. An insertion concave portion 12*e* in which a part of the element attaching edge portion 2 of the cloth 5 is inserted is provided on a side surface part (cloth-facing side surface part) of the body portion 12*a* facing to the cloth 5 along the length direction. The first element member 10 (or the second element member 20) is fixed to the element attaching edge portion 2 with a sewn portion for fixing 6 as described later in a state that the element attaching edge portion 2 of the cloth 5 is inserted into the insertion concave portion 12*e*, thereby respective fastener elements 11 can be firmly and stably fixed to the element attaching edge portion 2 in a predetermined aspect.

The fixing member 13 penetrates into the body portion 12*a* of the fastener element 11 in a wrapped state by the body portion 12*a* along the length direction. In this case, the fixing member 13 is held at a center part in a thickness direction of the body portion 12*a* and whole outer peripheral surface of the fixing member 13 is covered by the body portion 12*a* of the fastener element 11 at a part holding the fastener element 11 in the fixed member 13.

A concave groove portion 12*f* fitting a protruded piece portion 12*d* of a counterpart fastener element 11 to be coupled when the left and right element rows 3 are coupled is formed on a top end part (tip end part) of the coupling head portion 12*c* along the length direction. It should be noted that a shape or a size of the fastener element 11 is not limited in particular, and can be changed arbitrarily in the invention.

The left and right fixing members (core string members) 13 of Embodiment 1 have flexibility and are formed of a same string-shaped member whose cross section perpendicular to the length direction appears as an approximately circular shape. Particularly, it is preferable that each fixing member 13 is a member which has a circular cross section and whose cross sectional area is constant in the length direction. As such a fixing member 13, for example, a monofilament, twisted threads (twisted strings) or a string body (also referred to as knit cord) which is formed by wrapping a core yarn made of a plurality of paralleled multifilaments with a hollow weave portion knitted with a plurality of knitted yarn and the like can be used.

It should be noted that the fixing member 13 used in the present invention is not limited in particular as far as a plurality of fastener elements 11 and the insert pin portion 31 or the box portion 41 can be attached thereto. In addition, a cross sectional shape of the fixing member 13 can be changed arbitrarily, if necessary. Further, the first element member 10 and the second element member 20 of the present invention may be formed by connecting a plurality of elements with two or more string-shaped fixing members 13.

Figure 6:
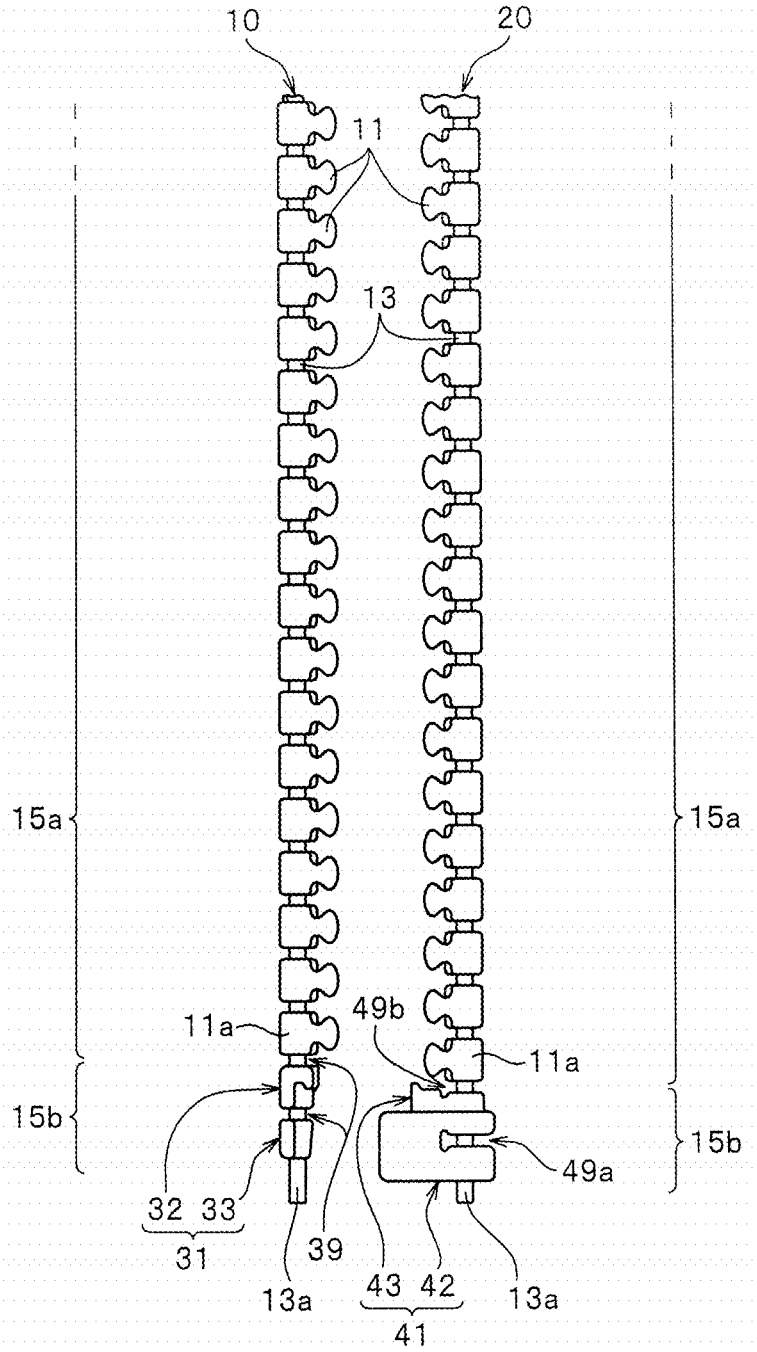
FIG. 6 is a plan view illustrating a first element member on a left side and a second element member on a right side.

The first element member 10 and the second element member 20 of Embodiment 1 has, as shown in FIG. 6, an element holding portion 15*a* to which a plurality of fastener elements 11 are attached at regular intervals and a component holding portion 15*b* extending rearward further than the above-mentioned end part fastener element 11*a* and to which composing parts (in the case of Embodiment 1, they mean the insert pin portion 31 and the box portion 41) forming a separable rear end stop 30 with respect to the length direction (or the length direction of the fixing member 13).

In Embodiment 1, the separable rear end stop 30 provided on the rear end part of the slide fastener has an insert pin portion 31 disposed on the component holding portion 15*b* of the left side first element member 10 and a box portion 41 disposed on the component holding portion 15*b* of the right side second element member 20. The insert pin portion 31 and the box portion 41 are formed integrally to the fixing member 13 in a predetermined shape by injection-molding thermoplastic resin such as polyacetal to respective fixing members 13. In this case, it is preferable that the insert pin portion 31 and the box portion 41 are formed of the same synthetic resin as the fastener element 11.

The left side insert pin portion 31 has a first insert pin divided body 32 (front side insert pin divided body) disposed on a rear side of and separated from the end part fastener element 11*a* and a second insert pin portion divided body 33 (rear side insert pin divided body) disposed separately on a rear side of the first insert pin divided body 32. In this case, the first insert pin divided body 32 and the second insert pin divided body 33 are disposed at the same attaching pitch as the one of the fastener elements 11 from the end part fastener element 11*a* of the first element member 10 rearward.

In Embodiment 1, a front surface and a rear surface of respective first insert pin divided body 32 and second insert pin divided body 33 are disposed perpendicular to the length direction. A length dimension (a dimension in the length direction) of each of the first insert pin divided body 32 and the second insert pin divided body 33 is set to be within ±20% of the length dimension of the fastener element 11, preferably the same size as the length dimension of the fastener element 11.

Left side side surfaces (cloth-facing side surfaces) contacting with the cloth 5 in the first insert pin divided body 32 and the second insert pin divided body 33 and left side side surfaces (cloth-facing side surface) contacting with the cloth 5 in the body portions 12*a* of the fastener elements 11 are disposed perpendicular to the width direction. Each left side side surface of the fastener element 11, the first insert pin divided body 32 and the second insert pin divided body 33 are disposed so as to be in a line in a plan view of the first element member 10.

In this case, a maximum value of each of the width dimension (the dimension in the width direction) of the first insert pin divided body 32 and the second insert pin divided body 33 is set to be smaller than the width dimension from a tip end of the coupling head portion 12*c* to the cloth-facing side surface of the body portion 12*a* of the fastener element 11 (that is, a maximum value of the width dimension of the fastener element 11). Further, thickness dimensions (dimensions in the thickness direction) of the first insert pin divided body 32 and the second insert pin divided body 33 are set to be the same size of the thickness dimension of the fastener element 11.

The first insert pin divided body 32 and the second insert pin divided body 33 of Embodiment 1 have an upper-lower symmetrical shape about a central position in the upper and lower direction (the thickness direction). The first insert pin divided body 32 has a first insert pin main body portion 32*a* which is hexahedral-shaped (cube- or rectangular parallelepiped-shaped), a first raised portion 32*b* raised from the upper surface and the lower surface of the first insert pin main body portion 32*a* in the upper and lower direction and a protruded piece portion 32*c* protruding from an opposing surface of the first insert pin main body portion 32*a* facing to the box portion 41 in the left and right direction (width direction). The second insert pin divided body 33 has a second insert pin main body portion 33*a* which is hexahedral-shaped and a second raised portion 33*b* raised from the upper surface and the lower surface of the second insert pin main body portion 33*a* in the upper and lower direction.

The first insert pin main body portion 32*a* of the first insert pin divided body 32 is formed by inserting the fixing member 13 therein and so as to cover the outer peripheral surface of the fixing member 13. The first raised portion 32*b* is provided so as to form steps between the upper surface and lower surface of the first insert pin main body portion 32*a* and the upper surface and the lower surface of the first raised portion 32*b*. The first raised portion 32*b* has a shape appearing as a J-shape or a hook-shape in a plan view or in a bottom view of the first element member 10 and also has an engaging portion 32*d* capable of engaging with respect to a box extending portion 43 as described later in the box portion 41 of the second element member 20. The protruded piece portion 32*c* of the first insert pin divided body 32 is formed so as to be able to be inserted into the above-mentioned concave groove portion 12*f* formed on the end part fastener element 11*a* of the second element member 20 when the left and right element rows 3 are coupled.

The second insert pin main body portion 33*a* of the second insert pin divided body 33 is formed by inserting the fixing member 13 therein and so as to cover the outer peripheral surface of the fixing member 13. The second insert pin main body portion 33*a* has a gradually-decreasing portion decreasing the width dimension gradually rearward in a plan view or a bottom view. The second raised portion 33*b* is disposed along the length direction. Steps are formed between the upper surface and the lower surface of the second insert pin main body portion 33*a* and the upper surface and the lower surface of the second raised portion 33*b*.

In Embodiment 1, accommodating space portions (accommodating gaps) 39 as thread accommodating portions (thread accepting portions) accepting and accommodating the sewing threads of a component sewn portion 8 as described later are formed between the end part fastener element 11*a* of the first element member 10 and the first insert pin divided body 32, and between the first insert pin divided body 32 and the second insert pin divided body 33, and the fixing member 13 is exposed in the accommodating space portions 39. By providing such accommodating space portions 39, when sewing is conducted on the first element member 10 and the element attaching edge portion 2 of the cloth 5 by using a sewing machine, the sewing threads (sewing machine threads) can be passed through and be accommodated in the accommodating space portion 39, which enables a position of the sewing threads to be stable.

Further, the fixing member 13 of Embodiment 1 is disposed so as to extend rearward from the second insert pin divided body 33. In this case, it is preferable that a length of an extending part 13*a* extending from the second insert pin divided body 33 in the fixing member 13 has a size of ⅓ or more of the length dimension of a unit running area 17 as described later, so as fraying to less occur in a rear end part of a sewn portion for fixing 6 as described later for example. Thereby, the extending part 13*a* of the fixing member 13 can be stably fixed to the element attaching edge portion 2 of the cloth 5.

It should be noted that, in Embodiment 1, the extending part 13*a* of the fixing member 13 extending from the second insert pin divided body 33 is cut with a predetermined length dimension. However, in the present invention, it is also possible that, for example, the length dimension of the extending part 13*a* of the fixing member 13 extending from the second insert pin divided body 33 is secured long, and when the element attaching edge portion 2 of the cloth 5 is folded and terminal processing of the cloth 5 is conducted, a part of the extending part 13*a* of the fixing member 13 is bent to the element attaching edge portion 2 side of the cloth 5 and the bent part is wrapped by a part on which the terminal processing of the cloth 5 is conducted. Thereby, the extending part 13*a* of the fixing member 13 is finished neatly, which enables appearance quality of the slide fastener-attached clothing item 1 to be enhanced.

In Embodiment 1, the first insert pin divided body 32 and the second insert pin divided body 33 are disposed at the same attaching pitch as the one from the end part fastener element 11*a* to the fastener element 11 as described above. Therefore, in the first element member 10, an exposed part of the fixing member 13 exposed at a gap between the fastener elements 11 adjacent to each other, an exposed part of the fixing member 13 exposed at a gap (accommodating space portion 39) between the end part fastener element 11*a* and the first insert pin divided body 32, an exposed part of the fixing member 13 exposed at a gap (accommodating space portion 39) between the first insert pin divided body 32 and the second insert pin divided body 33 and an extending part 13*a* of the fixing member 13 extending from the second insert pin divided body 33 in the rear direction are disposed at constant intervals in the length direction of the fixing member 13.

Therefore, in a case that the insert pin portion 31 of Embodiment 1 is attached to the element attaching edge portion 2 of the cloth 5 by forming the component sewn portion 8, as described later, the sewing threads of the component sewn portion 8 are inserted and accommodated in the accommodating space portion 39 between the end part fastener element 11*a* and the first insert pin divided body 32 and in the accommodating space portion 39 between the first insert pin divided body 32 and the second insert pin divided body 33. At the same time, the sewing threads of the component sewn portion 8 wrap the fixing member 13 exposed in the accommodating space portions 39 and the fixing member 13 extending in the rear direction of the second insert pin divided body 33 while contacting with the outer peripheral surface of the fixing member 13, thereby the fixing member 13 can be supported at constant intervals. Thereby, the insert pin portion 31 is fixed to the element attaching edge portion 2 of the cloth 5.

The right side box portion 41 has a box body portion 42 which is rectangular parallelepiped-shaped and a box extending portion 43 extending frontward from the box body portion 42 while narrowing the thickness dimension and the width dimension. The box portion 41 of Embodiment 1 has an upper-lower symmetrical shape about a central position of the upper and lower direction (thickness direction).

In this case, the length dimension of the box body portion 42 is set to be larger than the one of the second insert pin divided body 33 so as at least the second insert pin divided body 33 of the insert pin portion 31 to be inserted and accommodated in the box body portion 42. The thickness dimension between an upper surface and a lower surface in the box body portion 42 and the width dimension between a cloth-facing side surface (right side surface) and an insert pin-facing side surface (left side surface) are respectively set to be larger than at least the ones of an element guide path as described later in a rear mouth side end part of the slider 50 so as the box body portion 42 to be able to contact with and stop the slider 50.

The box extending portion 43 is formed so as to be able to be inserted into the element guide path of the slider 50 when the box body portion 42 contacts with the slider 50. Particularly in Embodiment 1, the upper surface and the lower surface of the box extending portion 43 are formed as flat surfaces parallel to the length direction and the width direction and the thickness dimension between the upper surface and the lower surface of the box extending portion 43 is set to be from 80% to 120% of the thickness dimension of the fastener element 11, preferably the same thickness dimension of the fastener element 11 so as the upper surface and the lower surface of the box extending portion 43 to contact with or be close to a guide surface (inner surfaces of an upper blade 53 and a lower blade 55 as described later) of the element guide path of the slider 50 when the box extending portion 43 is inserted into the element guide path of the slider 50.

The box portion 41 of Embodiment 1 is formed so as the fixing member 13 to be inserted into an inside of a right side half portion (cloth side half portion) of the box portion 41 and covers an outer peripheral surface of the fixing member 13. A concave groove portion 42*a* into which a part of the element attaching edge portion 2 of the cloth 5 can be inserted is formed on the right side side surface part (cloth-facing side surface part) of the box body portion 42 along the length direction.

Further, an insert pin accommodating portion 41*a* capable of inserting and accommodating the insert pin portion 31 therein is disposed on a left side half portion (an insert pin side half portion) of the box portion 41 over the box body portion 42 and the box extending portion 43 along the front and rear direction. Particularly, the insert pin accommodating portion 41*a* of Embodiment 1 penetrates the box portion 41 in the front and rear direction.

Figure 10:
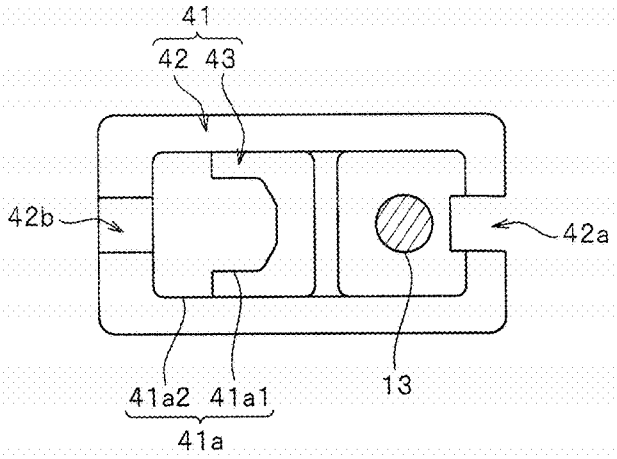
FIG. 10 is a front view viewing the box portion from a fastener element side (front side).

The insert pin accommodating portion 41*a* of Embodiment 1 is disposed at a center part in the thickness direction when viewing the box portion 41 from the end part fastener element 11*a* side (front side)(see FIG. 10), for example, and has a first accommodating portion 41*a*1 into which the first insert pin main body portion 32*a* and the second insert pin main body portion 33*a* of the insert pin portion 31 can be inserted and a second accommodating portion 41*a*2 which is disposed on the upper side and the lower side of the first accommodating portion 41*a*1 and in which a second raised portion 33*b* of the insert pin portion 31 can be inserted.

Further, an insertion groove (insertion slit) 42*b* through which the element attaching edge portion 2 of the cloth 5 to which the first element member 10 is attached is inserted is disposed on the left side side surface part (insert pin-facing side surface part) facing to the insert pin portion 31 in the box body portion 42 from the front end surface of the box body portion 42 rearward linearly and in a predetermined length. The insertion groove 42*b* communicates continuously to the insert pin accommodating portion 41*a*.

An accommodating space portion (accommodating opening portion) 49*a* as a thread accommodating portion accepting and accommodating the sewing threads of a component sewn portion 8 as described later is disposed on the box body portion 42 of Embodiment 1. The accommodating space portion 49*a* of the box body portion 42 is formed so as to penetrate the box body portion 42 in the upper and lower direction, and when viewing the accommodating space portion 49*a* from an upper side or a lower side, the fixing member 13 and the element attaching edge portion 2 of the cloth 5 are disposed so as to be exposed in the accommodating space portion 49*a*.

The accommodating space portion 49*a* has, in a plan view or in a bottom view of the box portion 41, a linear-shaped space portion formed from the right side side surface (cloth-facing side surface) contacting with the cloth 5 of the box body portion 42 with a constant length dimension along the width direction and a tip end space portion extending from a tip end part of the groove portion in the width direction and formed so as the length dimension to be larger than the space portion.

By forming the accommodating space portion 49*a* of the box body portion 42 is formed as above, the sewing threads of the component sewn portion 8 can be accommodated in the linear-shaped space portion and be stably protected. Further, when the box portion 41 is attached to the element attaching edge portion of the cloth 5 by using a sewing machine, a sewing needle can be easily passed into the tip end space portion of the accommodating space portion 49*a*. Therefore, it can be less likely to occur that, for example, sewing is prevented by a sewing needle being interfered with the box portion 41 and a sewing needle breaks.

It should be noted that, in Embodiment 1, a linear-shaped space portion in the accommodating space portion 49*a* of the box portion 41 can be formed, for example, so as the length dimension of the space portion to gradually increase as it separates from the tip end space portion. Thereby, since the sewing threads of the component sewn portion 8 can be less likely to interfere with the box portion 41, the sewing threads can be less likely to loosen, and the box portion 41 can be fixed firmly to the element attaching edge portion 2 of the cloth 5 with the component sewn portion 8.

An engaging protruded portion 43*a* disposed on the insert pin-facing side edge part of the box extending portion 43 and protruding frontward (toward the fastener element 11 side) in a plan view or in a bottom view of the box portion 41 is formed on the box extending portion 43 of Embodiment 1. The engaging protruded portion 43*a* of the box extending portion 43 is a part with which the J-shaped or hook-shaped first raised portion 32*b* disposed on the first insert pin divided body 32 of the insert pin portion 31 is hooked and engaged when the insert pin portion 31 is inserted and accommodated in the insert pin accommodating portion 41*a* of the box portion 41 (See FIG. 12). In Embodiment 1, a position of the insert pin portion 31 at which the first raised portion 32*b* of the insert pin portion 31 is engaged with the engaging protruded portion 43*a* of the box extending portion 43 becomes an insert pin insertion complete position at which the insert pin portion 31 is inserted into the box portion 41 at the deepest and can make the slider 50 sliding.

In the second element member 20 of Embodiment 1, the accommodating space portion (accommodating opening portion) 49*a* is formed on the box body portion 42 as described above, and the accommodating space portion (accommodating gap) 49*b* as a thread accommodating portion accepting and accommodating the sewing threads of the component sewn portion 8 is formed between the end part fastener element 11*a* and the box portion 41.

The fixing member 13 extends rearward further from the box body portion 42. In this case, the extending part 13*a* extending from the box body portion 42 of the fixing member 13 is cut with a predetermined length dimension. However, in the present invention, as in the case of the extending part 13*a* of the first element member 10, it is possible that the extending part 13*a* of the second element member 20 is secured long, a part of the extending part 13*a* is bent and the bent part is wrapped by a part on which terminal processing of the cloth 5 is conducted.

Further, in the second element member 20 of Embodiment 1, an exposed part of the fixing member 13 exposed at a gap between the fastener elements 11 adjacent to each other, an exposed part of the fixing member 13 exposed at a gap (accommodating space portion 49*b*) between the end part fastener element 11*a* and the box portion 41, an exposed part of the fixing member 13 exposed in the accommodating space portion 49*a* (accommodating opening portion) formed on the box portion 41 and an extending part 13*a* of the fixing member 13 extending rearward from the box body portion 42 are disposed at constant intervals in the length direction of the fixing member 13.

Therefore, in a case that the box portion 41 of Embodiment 1 is attached to the element attaching edge portion 2 of the cloth 5 by forming the component sewn portion 8 as described later, the sewing threads of the component sewn portion 8 are inserted and accommodated in the accommodating space portion (accommodating gap) 49*b* between the end part fastener element 11*a* and the box portion 41 and in the accommodating space portion (accommodating opening portion) 49*a* formed on the box portion 41. At the same time, the sewing threads of the component sewn portion 8 wrap the fixing member 13 exposed in the accommodating space portions 49*a*, 49*b* and the extending part 13*a* of the fixing member 13 extending to a rearward of the box body portion 42 while contacting with the outer peripheral surface of the fixing member 13, thereby the fixing member 13 can be supported at constant intervals. Thus, the box portion 41 is fixed to the element attaching edge portion 2 of the cloth 5.

The above-mentioned left side first element member 10 and the right side second element member 20 of Embodiment 1 are lined at a position adjacent to an outside of the width direction respectively with respect to each element attaching edge portion 2 of the left and right cloths 5 and fixed with a sewn portion for fixing (sewing line for fixing) 6. In this case, each of the left and right sewn portion for fixing 6 has an element sewn portion 7 fixing the element holding portion 15*a* of the first element member 10 or the second element member 20 to the element attaching edge portion 2 of the cloth 5 and a component sewn portion 8 fixing the component holding portion 15*b* of the first element member 10 or the second element member 20 to the element attaching edge portion 2 of the cloth 5.

Further in the case of Embodiment 1, the element sewn portion 7 and the component sewn portion 8 of the sewn portion for fixing 6 are formed continuously with one time's sewing by a zigzag stitch sewing machine and also formed so as to bend as zigzag-shaped with respect to the front and rear direction (length direction). With such a sewn portion for fixing 6 as above, the first element member 10 is fixed to the element attaching edge portion 2 in a state that the body portion 12*a* of each fastener elements 11 and the first insert pin main body portion 32*a* and the second insert pin main body portion 33*a* of the insert pin portion 31 are contacted with the element attaching edge portion 2 of the cloth 5 respectively.

Particularly in Embodiment 1, as shown in FIG. 2 for example, in a case that a region within which the insert pin portion 31 contacts directly with and is attached intermittently to the fixing member 13 with respect to the length direction of the first element member 10 is defined as a directly-attached region 38, the component sewn portion 8 of the sewn portion for fixing 6 is formed on the whole length direction of the directly-attached region 38. Here, the case that the insert pin portion 31 is attached intermittently means, though the first insert pin divided body 32 and the second insert pin divided body 33 are separated from each other, one insert pin portion 31 formed of the first insert pin divided body 32 and the second insert pin divided body 33 is attached to the fixing member 13. The directly-attached region 38 in this case means a region from a front end position contacting with the fixing member 13 of the first insert pin divided body 32 to a rear end position contacting with the fixing member 13 of the second insert pin divided body 33.

Further in this case, when a position (a front end position of the first insert pin divided body 32) corresponding to the front end edge on a near side to the element holding portion 15*a* (or the fastener element 11) in the above-mentioned directly-attached region 38 is referred to as a front end position 38*a* and a position (a rear end position of the second insert pin divided body 33) corresponding to the rear end edge on a far side from the element holding portion 15*a* (or the fastener element 11) in the directly-attached region 38 is referred to as a rear end position 38*b* with respect to the length direction of the first element member 10, the component sewn portion 8 of the sewn portion for fixing 6 is formed so as to extend continuously frontward from the directly-attached region 38 to a beyond the above-mentioned front end position 38*a* and also extend continuously rearward beyond the above-mentioned rear end position 38*b*. Here, the case that the component sewn portion 8 extends continuously beyond the front end position 38*a* or the rear end position 38*b* means that the sewing threads (upper thread and lower thread) are disposed continuously without breaks and the component sewn portion 8 is continuously formed.

With the above-mentioned sewn portion for fixing 6, the second element member 20 is fixed to the element attaching edge portion 2 in a state that the body portion 12*a* of each fastener element 11 and the box body portion 42 of the box portion 41 are contacted with the element attaching edge portion 2 of the cloth 5 respectively. Particularly in Embodiment 1, when the first element member 10 and the second element member 20 are fixed to the element attaching edge portion 2 of the cloth 5, a part of the element attaching edge portion 2 is inserted into and held at the insertion concave portion 12*e* of each fastener elements 11 and also inserted into and held at the concave groove portion 42*a* of the box body portion 42.

In Embodiment 1, as shown in FIG. 2 for example, and as in the case of the first element member 10, in the case that the region within which the box portion 41 is contacted directly with and attached intermittently to the fixing member 13 is referred to as a directly-attached region 48, the component sewn portion 8 of the sewn portion for fixing 6 is formed on the whole length direction of the directly-attached region 48 with respect to the length direction of the second element member 20. Here, the case that the box portion 41 is attached intermittently means though the box body portion 42 is partially divided by the accommodating space portion 49*a*, one box portion 41 formed of the box body portion 42 including an area of the accommodating space portion 49*a* and the box extending portion 43 is attached to the fixing member 13. The directly-attached region 48 in this case means a region of the length direction from the front end position contacting with the fixing member 13 of the box extending portion 43 to the rear end position contacting with the fixing member 13 of the box body portion 42. It should be noted that, in Embodiment 1, it is enough that the component sewn portion 8 is formed on at least a part of the directly-attached region 38 on the insert pin portion 31 side or the directly-attached region 48 on the box portion 41 side, preferably over the region of 90% or more in the length direction.

Further in this case, the component sewn portion 8 of the sewn portion for fixing 6 is formed so as to extend frontward from the directly-attached region 48 beyond the front end position 48*a* of the directly-attached region 48 and also extend rearward beyond the rear end position of the directly-attached region 48 with respect to the length direction of the second element member 20.

Here, the zigzag stitch sewing machine is a sewing machine capable of sewing a cloth with the lock stitches in a zigzag shape while swinging a sewing needle along a crossing direction crossing in a feed direction of a sewing machine. It should be noted that the swing of a sewing needle in the zigzag stitch sewing machine is often referred to as a zigzag swing. Such a zigzag stitch sewing machine is used and the sewing is conducted by setting, for example, a coordinate data of coordinate X (a position of the feed direction) which becomes a needle location and coordinate Y (a position of the crossing direction) on the zigzag stitch sewing machine, thereby the sewn portion for fixing 6 formed after sewing can be easily bent so as to be in a zigzag shape in the above-mentioned crossing direction with respect to the feed direction of the zigzag stitch sewing machine.

In Embodiment 1, the sewing threads of the sewn portion for fixing 6 formed by lock stitching has an upper thread (needle thread) running on a top surface (first surface) of the element attaching edge portion 2 and contacting with a top surface side half portion of the fixing member 13 and a lower thread (bobbin thread) running on a back surface (second surface) of the element attaching edge portion 2 and contacting with a back surface side half portion of the fixing member 13. In this case, since the sewn portion for fixing 6 is formed by lock stitching, the upper thread and the lower thread are disposed in a plane symmetrical position with each other.

In this case, a conventional and general sewing machine thread is used as the upper thread and the lower thread for the lock stitches. The upper thread and the lower thread for the lock stitches cross (interlace) with each other at piercing positions (a first piercing position 18*a* and a second piercing position 18*b* as described later) at which the sewn portion for fixing 6 pierces the element attaching edge portion 2 of the cloth 5 and a position contacting with an outer peripheral surface of the fixing member 13 as shown in FIGS. 3 and 4.

In Embodiment 1, the upper thread and the lower thread of the sewn portion for fixing 6 cross each other at a position between the upper thread running on the top surface of the element attaching edge portion 2 and the lower thread running on the back surface of the element attaching edge portion 2 with respect to the thickness direction. Particularly, the upper thread and the lower thread of Embodiment 1 cross each other at a position of a center part in the thickness direction in the element attaching edge portion 2. Thereby, a crossing part of the upper thread and the lower thread at the piercing position is protected by the element attaching edge portion 2 and can not be easily seen from an outside. It should be noted that the crossing position of the upper thread and the lower thread in the thickness direction can be easily changed by tension controlling of the upper thread and the lower thread in the zigzag stitch sewing machine.

The sewn portion for fixing 6 of Embodiment 1 is formed of stitches of the lock stitches in which the upper thread and the lower thread interlace by using the zigzag stitch sewing machine as described above. Thereby, the sewn portion for fixing 6 pierces the element attaching edge portion 2 of the cloth 5 and the upper thread and the lower thread can hold the fixing member 13 so as to wrap it while contacting with an outer peripheral surface of the fixing member 13 of the first element member 10 and the second element member 20. In this case, the upper thread and the lower thread of the sewn portion for fixing 6 hold exposed parts of the fixing member 13 exposed at constant intervals. Thus, the first element member 10 and the second element member 20 are easily and stably attached and fixed to the element attaching edge portions 2 of the cloths 5 with the sewn portion for fixing 6.

Further, the sewn portion for fixing 6 is formed by using a zigzag stitch sewing machine, thereby it can be effectively prevented that the upper thread and the lower thread of the element sewn portion 7 of the sewn portion for fixing 6 after sewing are disposed while overlapping so as to cross on the top surface (upper surface) and the back surface (lower surface) of the fastener element 11 with respect to the fastener element 11. In addition, it can be prevented that the upper thread and the lower thread of the component sewn portion 8 after sewing are disposed while overlapping the insert pin portion 31 and the box portion 41.

Thereby, it can be prevented that informalities such as loosening of the upper thread and the lower thread, deterioration of the smooth coupling (ease of coupling) of the element rows 3 and deterioration of slidability of the slider 50 caused by overlapping the upper thread and the lower thread of the sewn portion for fixing 6 with the fastener elements 11, the insert pin portion 31 and the box portion 41.

Particularly, the element sewn portion 7 of Embodiment 1 has a unit running area 17 within which the upper thread and the lower thread in the lock stitches run from an outer peripheral crossing position crossing on an outer peripheral surface of the fixing member 13 to a next outer peripheral crossing position crossing on the outer peripheral surface of the fixing member 13 with respect to one fastener element 11, and formed of stitches in the unit running area 17 being disposed repeatedly per fastener element 11 in the length direction. In this case, stitches in each unit running area 17 forming the element sewn portion 7 of Embodiment 1 has two by two piercing positions at which the element sewn portion 7 pierces the element attaching edge portion 2.

In Embodiment 1, a stitch pattern in the unit running area 17 is repeated not only in the element sewn portion 7 but also in the component sewn portion 8 at a same pitch, which fixes the insert pin portion 31 and the box portion 41 to the element attaching edge portion 2 of the cloth 5.

Specifically explained, in the first element member 10 of Embodiment 1, the accommodating space portion (accommodating gap) 39 accepting the sewing threads is disposed on the insert pin portion 31 as described above, thereby the exposed parts of the fixing member 13 are disposed over whole of the element holding portion 15*a* and the component holding portion 15*b* of the first element member 10 at constant intervals in the length direction. Further, also in the second element member 20, the accommodating space portions 49*a*, 49*b* (accommodating opening portion and accommodating gap) accepting the sewing threads are disposed on the box portion 41, and the exposed parts of the fixing member 13 are disposed over whole of the element holding portion 15*a* and the component holding portion 15*b* of the second element member 20 at constant intervals in the length direction.

Therefore, in the sewn portion for fixing 6, the constant zigzag-shaped stitch pattern with the lock stitches is repeated over whole of the element holding portions 15*a* and the component holding portions 15*b* of the first element member 10 and the second element member 20 at a same pitch, thereby the sewing threads (upper thread and lower thread) of the sewn portion for fixing 6 pierce the element attaching edge portion 2 of the cloth 5 at constant intervals and the exposed parts of the fixing member 13 disposed at constant intervals can be held with the sewing threads of the sewn portion for fixing 6. Thus, the first element member 10 and the second element member 20 are stably fixed to the element attaching edge portion 2 of the cloth 5.

In this case, also the extending part 13*a* of the fixing member 13 extending rearward from the second insert pin divided body 33 to be exposed in the first element member 10 and the extending part 13*a* of the fixing member 13 extending rearward from the box body portion 42 and exposed in the second element member 20 are fixed to the element attaching edge portions 2 of the cloths 5 with the zigzag-shaped lock stitches. It should be noted that, in the present invention, the above-mentioned extending parts 13*a* of the fixing member 13 do not have to be fixed to the element attaching edge portion 2 of the cloth 5 with the zigzag-shaped lock stitches.

Here, a unit running area 17 of the sewn portion for fixing 6 (element sewn portion 7 and component sewn portion 8) of Embodiment 1 is specifically explained. The upper thread and the lower thread of the sewn portion for fixing 6 of Embodiment 1 have, in each unit running area 17, a first running portion 17*a* disposed from the outer peripheral crossing position crossing the upper thread and the lower thread on the outer peripheral surface of the fixing member 13 to a first first piercing position 18*a*, a second running portion 17*b* disposed from the first piercing position 18*a* to a next second piercing position 18*b* and a third running portion 17*c* disposed from the second piercing position 18*b* to a next outer peripheral crossing position.

In this case, the first running portion 17*a* is formed of the upper thread (or lower thread) running from the above-mentioned outer peripheral crossing position to a position in the width direction corresponding to a side surface part of the fastener element 11 along the width direction (or an approximately width direction) and further running diagonally with respect to the width direction to the first piercing position 18*a*. A boundary part between a part running along the width direction and a part running diagonally with respect to the width direction of the first running portion 17*a* occasionally contacts with the body portion 12*a* of the fastener element 11. The second running portion 17*b* is formed of the upper thread (or lower thread) running along the length direction between the first piercing position 18*a* and the second piercing position 18*b*. The third running portion 17*c* is formed of the upper thread (or lower thread) running diagonally with respect to the width direction from the second piercing position 18*b* to a position in the width direction corresponding to the side surface part of the fastener element 11 and further running along the width direction (or approximately width direction) to the outer peripheral crossing position. In this case, a boundary part between a part running diagonally with respect to the width direction and a part running along the width direction of the third running portion 17*c* occasionally contacts with the body portion 12*a* of the fastener element 11.

In Embodiment 1, the first piercing position 18*a* and the second piercing position 18*b* at which the element sewn portion 7 pierces the element attaching edge portion 2 of the cloth 5 are formed so as to be separated from an inside side surface part (cloth-facing side surface part) of each fastener element 11 toward an inside of the cloth 5 in the width direction. That is, in the width direction of the element member, constant intervals are provided in the width direction between the first piercing position 18*a* and the second piercing position 18*b* of the element sewn portion 7 and a position of the side surface part of each fastener element 11. The first piercing position 18*a* and the second piercing position 18*b* of the component sewn portion 8 are also formed so as to be separated from the insert pin portion 31 or the box portion 41 toward an inside of the cloth 5, and constant intervals are provided in the width direction between the first piercing position 18*a* and the second piercing position 18*b* of the component sewn portion 8 and a position of the insert pin portion 31 or the box portion 41.

The positions of the first piercing position 18*a* and the second piercing position 18*b* of the sewn portion for fixing 6 are set as above, thereby it can be more stably prevented that the upper thread and the lower thread of the sewn portion for fixing 6 overlap the fastener element 11, the insert pin portion 31 and the box portion 41. Further, the interval in the width direction between the first piercing position 18*a* and the second piercing position 18*b* and the side end edge of the element attaching edge portion 2 can be secured large. Thus, strength of the element attaching edge portion 2 can be easily and stably secured and damages to the cloth 5 such that the cloth 5 is cut from the first piercing position 18*a* or the second piercing position 18*b* toward the side end edge of the element attaching edge portion 2 by being rubbed by the upper thread and the lower thread, for example, can be less likely to occur.

It should be noted that, in Embodiment 1, a dimension in the length direction in the unit running area 17 of the sewn portion for fixing 6 is set to be the same size both in the element sewn portion 7 and the component sewn portion 8. However, in the present invention, for example, in a case of changing a form or a size of the insert pin portion 31 and the box portion 41, it is possible that a dimension in the length direction in the unit running area 17 is made to be different between the element sewn portion 7 and the component sewn portion 8 in the fixing member 13 by changing a coordinate data set on the zigzag stitch sewing machine. Further, it is also possible that a dimension in the length direction is made to be different per unit running area 17 in the component sewn portion 8.

Further, in the slide fastener-attached clothing item 1 of Embodiment 1, an auxiliary sewn portion 9 to fasten the upper thread and the lower thread of the sewn portion for fixing 6 so as not to loosen is continuously formed along the length direction in an area between a position of the side surface part of each fastener element 11 in the width direction and piercing positions (first piercing position 18*a* and second piercing position 18*b*) of the sewn portion for fixing 6.

Particularly, in the case of Embodiment 1, in the left side first element member 10, the auxiliary sewn portion 9 is formed on whole of the sewn portion for fixing 6 (that is, element sewn portion 7 and component sewn portion 8). On the other hand, in the right side second element member 20, the auxiliary sewn portion is formed only on the element sewn portion 7 and is not formed on the component sewn portion 8.

The auxiliary sewn portion 9 of Embodiment 1 is formed linearly along the length direction of the element member with stitches of the lock stitch in which an auxiliary upper thread (needle thread) and an auxiliary lower thread (bobbin thread) interlace by using a sewing machine. Particularly, the auxiliary sewn portion 9 of Embodiment 1 is formed so as the auxiliary upper thread to cross over the upper thread of the sewn portion for fixing 6 and so as the auxiliary lower thread to cross over the lower thread of the sewn portion for fixing 6 respectively within a region overlapping the above-mentioned first running portion 17*a* and the third running portion 17*c* in the sewn portion for fixing 6.

The auxiliary sewn portion 9 is formed with the lock stitches as above, thereby the auxiliary sewn portion 9 can be easily and stably formed and the upper thread and the lower thread of the sewn portion for fixing 6 can be stably pressed (fastened). Further, by forming the auxiliary sewn portion 9, the upper thread and the lower thread of the sewn portion for fixing 6 can be pressed by the auxiliary upper thread and the auxiliary lower thread from upper and lower sides toward the element attaching edge portion 2 (in other words, toward an inside in the thickness direction).

Thus, the upper thread and the lower thread of the sewn portion for fixing 6 can be fastened with the auxiliary sewn portion 9 and tension can be added. Therefore, even when the loosening occurs on the upper thread and the lower thread of the sewn portion for fixing 6, the loosening can be eliminated. Also, it can be effectively prevented that the loosening occurs in the upper thread and the lower thread of the sewn portion for fixing 6.

It should be noted that, though the auxiliary sewn portion 9 of Embodiment 1 is formed linearly along the length direction with the lock stitches, as long as the auxiliary sewn portion 9 can press the upper thread and the lower thread of the sewn portion for fixing 6 toward the element attaching edge portion 2, the auxiliary sewn portion 9 can be formed with stitches other than the lock stitches such as multi thread chain stitches in the present invention.

The left side first element member 10 and the right side second element member 20 are respectively attached to the element attaching edge portions 2 of the left and right cloths 5 with the above-mentioned sewn portion for fixing 6 and the auxiliary sewn portion 9, thereby left and right element rows 3 are formed along the element attaching edge portions 2 of the left and right cloths 5. Further, the insert pin portion 31 of the first element member 10 is properly fixed on the element attaching edge portion 2 of the left side cloth 5 at a predetermined position so as to continue to a rear side of the element row 3 with the sewn portion for fixing 6 and the auxiliary sewn portion 9, and the box portion 41 of the second element member 20 is properly fixed on the element attaching edge portion 2 of the right side cloth 5 at a predetermined position so as to continue to the rear side of the element row 3. Thereby, a right feed separable rear end stop 30 having the left side insert pin portion 31 fixed to the cloth 5 and the right side box portion 41 fixed to the cloth 5 is formed on the rear end part of the slide fastener.

Figure 11:
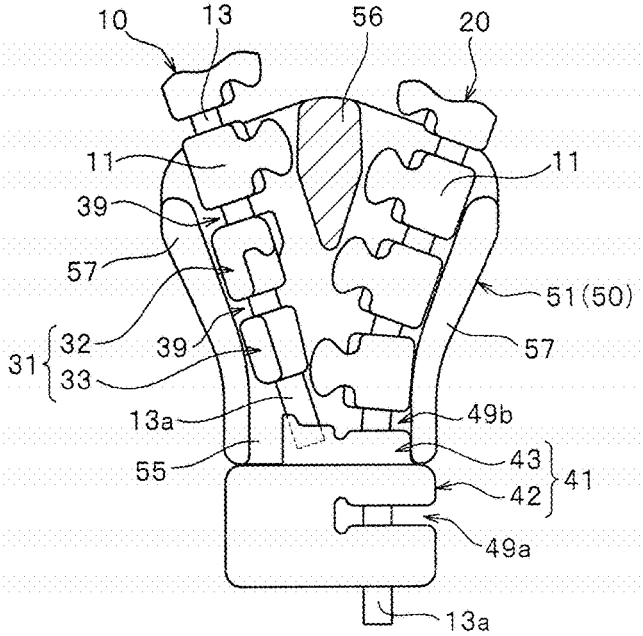
FIG. 11 is a schematic view illustrating an operation that the insert pin portion of the separable rear end stop passes into an element guide path and is inserted into an insert pin accommodating portion of the box portion.

The slider 50 of Embodiment 1 has, as schematically shown in FIGS. 1 and 11, a slider body 51 and a tab 52. Since the slider body 51 of Embodiment 1 is formed substantially the same as a conventional and general slider body, drawings of the detailed structure are omitted here. The slider body 51 has an upper blade 53, a lower blade 55 disposed so as to separate from and parallel to the upper blade 53, a connecting post 56 connecting between front end parts (shoulder mouth side end part) of the upper blade 53 and the lower blade 55, upper and lower flange portions 57 disposed on left and right side edge parts of the upper blade 53 and the lower blade 55 and a tab attaching portion 54 disposed on an upper surface of the upper blade 53.

Left and right shoulder mouths are formed on a front end part of the slider body 51 interposing a guide post and a rear mouth is formed on a rear end part of the slider body 51. An approximately Y-shaped element guide path communicating continuously through the left and right shoulder mouths and the rear mouth is formed between the upper blade 53 and the lower blade 55. Further, an insertion gap making the element attaching edge portion 2 of the cloth 5 inserted through is formed between the upper and lower flange portions 57 in the slider body 51.

Next, a manufacturing method of the slide fastener-attached clothing item 1 of Embodiment 1 having the separable rear end stop 30 as above is explained as follows.

First, a cloth 5 for clothing item, a left side first element member 10 and a right side second element member 20 are prepared. In the case of Embodiment 1, by injection-molding synthetic resin directly to one string-shaped fixing member 13, a plurality of fastener elements 11 having a predetermined shape are formed at a constant attaching pitch and an insert pin portion 31 or a box portion 41 is formed on the rear end part of the fixing member 13 at a predetermined position. Thus, the left side first element member 10 and the right side second element member 20 are manufactured.

In addition, other than the first element member 10 and the second element member 20, cloth 5 for clothing item which becomes a fastener attaching member 5 is manufactured by knitting or weaving. At this time, if waterproofness is preferably added to the cloth 5, for example, it is possible that synthetic resin is coated or a resin film is sealed on the knitted or woven cloth 5. Further, by folding a side edge part which becomes a cut end edge part in the cut left and right cloths 5 so as to be U-shaped, an element attaching edge portion 2 is formed. In this case, the element attaching edge portions formed respectively on a left and right pair of cloths 5 for a front body are provided at a position disposed so as to face to each other when manufacturing the clothing item.

Next, parts for composing clothing item are manufactured by using the first element member 10, the second element member 20 and the left and right cloths 5 (cloth 5 parts) cut in a predetermined shape and on which the element attaching edge portion 2 is formed.

Firstly, as a first sewing step, the first element member 10 and the second element member 20 are attached and fixed respectively to the element attaching edge portions 2 of the left and right cloths 5 by using a zigzag stitch sewing machine. At this time, by using the zigzag stitch sewing machine in which a coordinate data of a needle location is set, the sewing processing with the lock stitches is conducted on the first element member 10 and the element attaching edge portion 2 of the cloth 5 over so as to bend in a zigzag shape for the whole first element member 10. The sewn portion for fixing 6 formed with the zigzag stitch sewing machine is formed by repeating a zigzag-shaped constant stitch pattern to the whole sewn portion for fixing 6 (element sewn portion 7 and component sewn portion 8) at a same pitch.

The first element member 10 is attached and fixed to the element attaching edge portion 2 of the cloth 5 with the sewn portion for fixing 6. Thereby, the left side element row 3 is formed on the element attaching edge portion 2 of the left side cloth 5, and the insert pin portion 31 is fixed at a predetermined position so as to continue to the left side element row 3. Similarly, the second element member 20 is attached and fixed to the element attaching edge portion 2 of the cloth 5 with the sewn portion for fixing 6. Thereby, the right side element row 3 is formed on the element attaching edge portion 2 of the right side cloth 5, and the box portion 41 is fixed at a predetermined position so as to continue to the right side element row 3.

Next, as a second sewing step, sewing for forming the auxiliary sewn portion 9 is conducted on the element attaching edge portions 2 of the left and right cloths 5 on which the first element member 10 and the second element member 20 are fixed with the sewn portion for fixing 6 by using a lock stitch sewing machine with a single needle. Thereby, the auxiliary sewn portion 9 formed of the above-mentioned linear-shaped lock stitches can be stably formed at a predetermined position of the element attaching edge portions on which the sewn portion for fixing 6 is formed. Since the upper thread and the lower thread of the sewn portion for fixing 6 are pressed toward the element attaching edge portion 2 with the auxiliary sewn portion 9, the first element member 10 and the second element member 20 can be more tightly fixed to the left and right element attaching edge portions 2 respectively.

By conducting such an operation as above, left and right parts for composing clothing item in which the left and right first element member 10 and second element member 20 are attached to the element attaching edge portions 2 of the left and right cloths 5 respectively. Further in Embodiment 1, other than the above-mentioned left and right pair of parts for composing clothing item, parts for composing clothing item composing left and right sleeves and a back body in clothing item not shown in drawings are manufactured and prepared.

Then, a clothing item is composed by connecting each manufactured parts for composing clothing item each other by sewing, etc. Further, the slider 50 is attached slidably to the element row 3 formed on the element attaching edge portion 2 of the cloth 5 and a stopper not shown in Figures which prevents the slider 50 from dropping is provided on front end parts of the left and right element rows 3. Thus, the slide fastener-attached clothing item 1 having the separable rear end stop 30 as shown in FIG. 1 is stably manufactured.

In the slide fastener-attached clothing item 1 of Embodiment 1 manufactured as above, a part of the cloth 5 for clothing item not only configures clothing item but also functions as a fastener tape of a conventional slide fastener. Therefore, the slide fastener-attached clothing item 1 can have a function of a slide fastener in a state that a fastener tape which was an essential component for a conventional slide fastener is omitted. Thereby, manufacturing cost (particularly material cost) for the slide fastener-attached clothing item 1 can be decreased. Further, the slide fastener-attached clothing item 1 can be weight saved and softness of the clothing item can be improved.

Moreover, the separable rear end stop 30 is formed on the rear end part of the slide fastener and the separable rear end stop 30 can be operated similar to a conventional and general separable rear end stop 30. For example, when closing the slide fastener in a state that the left and right element rows 3 in the slide fastener are uncoupled and the first element member 10 and the second element member 20 are separated with each other, as shown in FIG. 11, the insert pin portion 31 of the separable rear end stop 30 is inserted from the left side shoulder mouth of the slider 50 into the element guide path, and further inserted and accommodated in the insert pin accommodating portion 41*a* of the box portion 41 via the element guide path of the slider 50.

Figure 12:
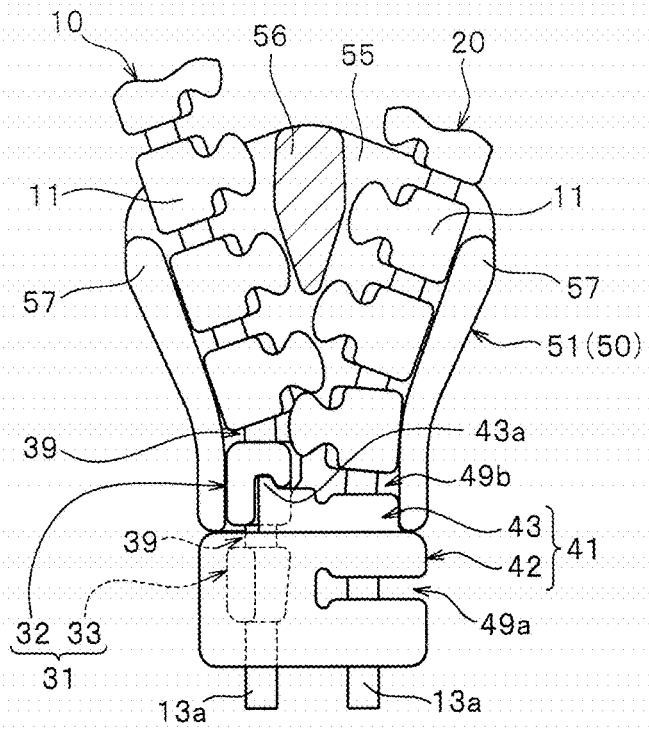
FIG. 12 is a schematic view illustrating a state that the insert pin portion of the separable rear end stop is inserted into the insert pin accommodating portion of the box portion.

At this time, as shown in FIG. 12, a J-shaped or hook-shaped first raised portion 32*b* provided on the insert pin portion 31 is hooked and engaged with the engaging protruded portion 43*a* of the box extending portion 43. Thereby, the insert pin portion 31 can be held at an insert pin insertion complete position that the insert pin portion 31 can not insert rearward any more. Then, by sliding the slider 50 frontward (closing direction), the left and right element rows 3 can be smoothly coupled.

It should be noted that, in the above-mentioned FIGS. 11 and 12 and the FIGS. 16, 18-21 and 23 as described later, the slider is shown in a cross-section and figures of the fastener tape and the sewn portion for fixing and the like are omitted to show a relationship between the fastener element, the separable rear end stop and the slider simply.

On the other hand, when uncoupling and separating the left and right element rows 3 in a state that the left and right element rows 3 are coupled and the slide fastener is closed, firstly, the slider 50 is slid rearward (separate direction) so as to contact with the box body portion 42 of the separable rear end stop 30. Thereby, the left and right element rows 3 can be separated as shown in FIG. 12. Then, the insert pin portion 31 is pulled diagonally in front and pulled out from the insert pin accommodating portion 41*a* of the box portion 41. Thus, since the first element member 10 and the second element member 20 are separated from each other, the left and right front placket parts of the clothing item 1 can be opened and separated.

In the slide fastener-attached clothing item 1 of Embodiment 1, as described above, the separable rear end stop 30 is formed of the insert pin portion 31 having the first insert pin divided body 32 and the second insert pin divided body 33 and a box portion 41 capable of inserting and accommodating the insert pin portion 31 therein. In such a separable rear end stop 30 of Embodiment 1 as above, whole length dimension of the separable rear end stop 30 can be relatively short. Thereby, it becomes possible that the separable rear end stop 30 has an appearance as a conventional stopper (often referred to as lower stopper) formed on the whole left and right element rows 3, for example. Thus, since the separable rear end stop 30 of Embodiment 1 can be looked smart or stylish, appearance quality of the separable rear end stop 30 can be improved.

Further, the insert pin portion 31 of Embodiment 1 is formed of two divided bodies of the first insert pin divided body 32 and the second insert pin divided body 33, and a J-shaped or a hook-shaped first raised portion 32*b* which engages with the engaging protruded portion 43*a* of the box portion 41 is formed on the first insert pin divided body 32.

Thereby, for example, in a state that the left and right element rows 3 are coupled, even when the left and right element rows 3 receive a lateral pulling force which pulls outward in the width direction respectively, an engaging state between the first raised portion 32*b* of the first insert pin divided body 32 and the engaging protruded portion 43*a* of the box portion 41 is maintained. At the same time, by these engagements, the insert pin portion 31 is less likely to be pulled out from the insert pin accommodating portion 41*a* of the box portion 41, and the state that the second insert pin divided body 33 is inserted into the insert pin accommodating portion 41*a* of the box portion 41 can be stably maintained.

Therefore, a coupling breakage that the left and right element rows 3 are forcibly and sequentially separated from the separable rear end stop 30 side without sliding of the slider 5 caused by the lateral pulling force can be less likely to occur. As a result, a slide fastener which has strong coupling strength with respect to the lateral pulling force (strength against lateral pulling) can be obtained, and informalities such as malfunction can be less likely to occur on the slide fastener.

Further, in the case of Embodiment 1, it is possible that, for example, after a desired function such as waterproofness or water-repellency is added to the cloth 5, the first element member 10 and the second element member 20 are directly attached to the cloth 5. Therefore, a high-quality slide fastener attached-clothing item 1 with waterproofness or water-repellency can be easily manufactured.

It should be noted that, in Embodiment 1, as described above, accommodating space portions (accommodating gaps) 39 are formed between the end part fastener element 11*a* and the first insert pin divided body 32, and between the first insert pin divided body 32 and the second insert pin divided body 33 of the first element member 10, and the fixing member 13 of the first element member 10 is exposed in the accommodating space portions 39. An accommodating space portion (accommodating opening portion) 49*a* is formed on the box body portion 42 of the second element member 20, and the fixing member 13 of the second element member 20 is exposed in the accommodating space portion 49*a*. Further, in the second element member 20, an accommodating space portion (accommodating gap) 49*b* is formed between the end part fastener element 11*a* and the box portion 41 of the second element member 20, and the fixing member 13 of the second element member 20 is exposed in the accommodating space portion 49*b*.

However, in the present invention, as long as the accommodating space portions 39, 49*a*, 49*b* formed on the insert pin portion 31 or the box portion 41 can accommodate the sewing threads of the sewn portion for fixing 6 as an accepting portion of the sewing threads, the fixing member 13 does not always need to be exposed in the accommodating space portions 39, 49*a*, 49*b*.

Figure 13:
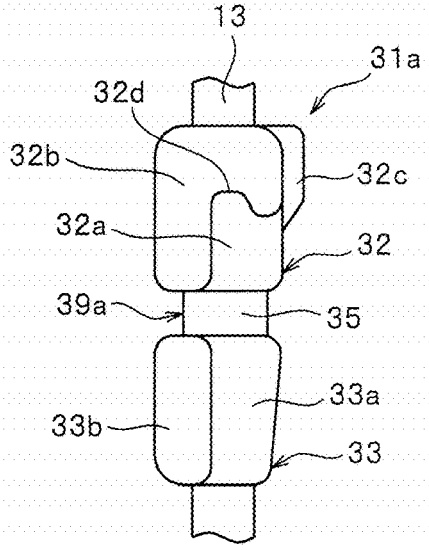
FIG. 13 is a plan view illustrating an insert pin portion according to modification example of Embodiment 1.
Figure 14:
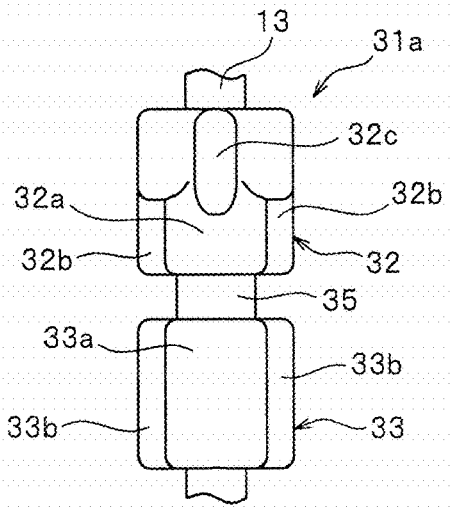
FIG. 14 is a side view illustrating the insert pin portion according to modification example of Embodiment 1.

For example, as an insert pin portion 31*a* according to modified Example of Embodiment 1 is shown in FIGS. 13 and 14, a connecting portion 35 made of synthetic resin and connecting the first insert pin divided body 32 and the second insert pin divided body 33 can be formed between the first insert pin divided body 32 and the second insert pin divided body 33 so as to wrap the fixing member 13. In this case, the connecting portion 35 of the insert pin portion 31*a* is formed so as the width dimension and the thickness dimension to be smaller than the ones of the first insert pin divided body 32 and the second insert pin divided body 33. Thereby, an accommodating space portion (accommodating concave portion) 39*a* capable of accepting and accommodating the sewing threads of the sewn portion for fixing 6 is formed in a concave shape between the first insert pin divided body 32 and the second insert pin divided body 33 along the outer peripheral surface of the connecting portion 35.

Also the insert pin portion 31*a* according to such a modification example as above can be stably fixed to the element attaching edge portion 2 of the cloth 5 with the component sewn portion 8 as explained in the above-mentioned Embodiment 1. In addition, since the first insert pin divided body 32 and the second insert pin divided body 33 are fixed with the connecting portion 35, rigidity of the insert pin portion 31*a* can be enhanced.

Thus, since the insert pin portion 31*a* is easily inserted into the slider 50 and the box portion 41 of the separable rear end stop 30, an insertion operability of the insert pin portion 31 is enhanced. Further, even when the left and right element rows 3 receives a lateral pulling force in a coupling state, since the insert pin portion 31 can be less likely to be pulled out from the insert pin accommodating portion 41*a* of the box portion 41, strength against lateral pulling can be more enhanced.

In the above-mentioned Embodiment 1, the exposed parts at which the fixing member 13 of the first element member 10 is exposed and the exposed parts at which the fixing member 13 of the second element member 20 is exposed are disposed at constant intervals in the length direction. However, in the present invention, for example, by employing different attaching pitches in the divided bodies forming the insert pin portion and in the fastener element 11 or displacing a position of an accommodating space portion (accommodating opening portion) formed at a box portion in the length direction in the front and rear direction, an interval (forming pitch) with which the exposed parts of the fixing member are provided can be intentionally changed.

Also in a case that the interval of the exposed parts of the fixing member is changed, by setting a coordinate data of the needle location in the zigzag stitch sewing machine forming the sewn portion for fixing properly, the exposed part of the fixing member can be properly held with the sewing threads of the sewn portion for fixing, and the first element member and the second element member can be stably fixed to the element attaching edge portion of the cloth.

Embodiment 2

Figure 15:
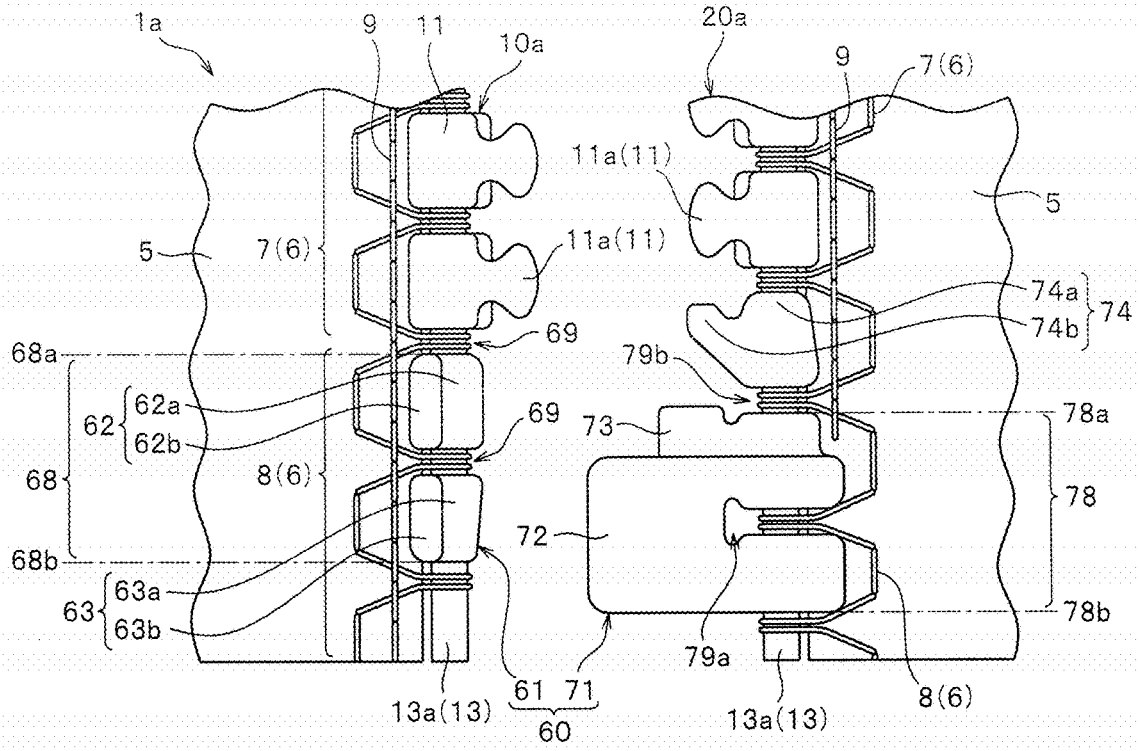
FIG. 15 is a plan view illustrating a main part of a slide fastener-attached product (clothing item) according to Embodiment 2 of the invention schematically.
Figure 16:
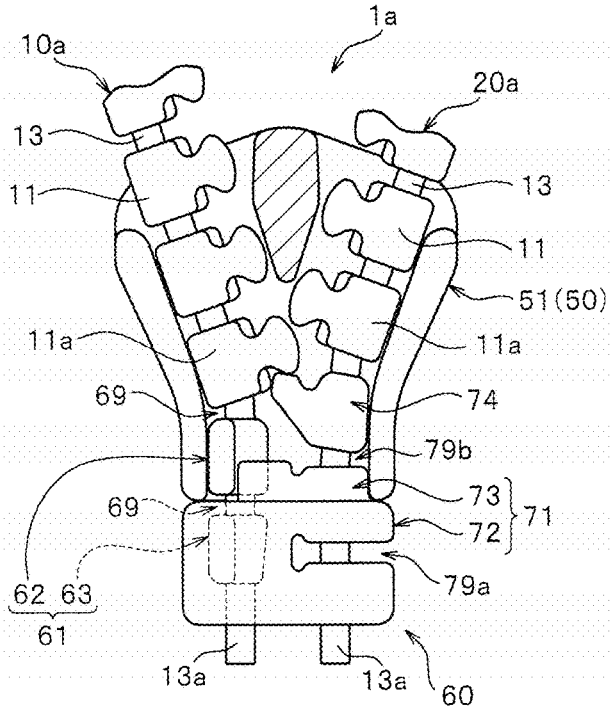
FIG. 16 is a schematic view illustrating a state that an insert pin portion of a separable rear end stop according to Embodiment 2 is inserted into an insert pin accommodating portion of a box portion.

FIG. 15 is a plan view illustrating a main part of a slide fastener-attached clothing item according to Embodiment 2 of the invention schematically. FIG. 16 is a schematic view illustrating a state that an insert pin portion of a separable rear end stop according to Embodiment 2 is inserted into an insert pin accommodating portion of a box portion.

In the slide fastener-attached clothing item 1*a* according to Embodiment 2, though a form of the separable rear end stop 60 is different from the one of the above-mentioned slide fastener-attached clothing item 1 of Embodiment 1, other structure is formed substantially the same as in the above-mentioned slide fastener-attached clothing item 1 of Embodiment 1.

Accordingly, in Embodiment 2, explanation of the parts and members having substantially the same components as the above-mentioned Embodiment 1 is omitted by using the same reference signs. Also in the explanations of Embodiment 3 or later as described later, the explanation of the parts and members having substantially the same components as previously-mentioned Embodiments is omitted by using the same reference signs.

In Embodiment 2, a separable rear end stop 60 disposed on a rear end part of the slide fastener has an insert pin portion 61 disposed on a component holding portion 15*b* of a left side first element member 10*a* and a box portion 71 disposed on a component holding portion 15*b* of a right side second element member 20*a*. In this case, the insert pin portion 61 and the box portion 71 are formed integrally to a fixing member 13 by injection-molding thermoplastic resin.

The left side insert pin portion 61 has a first insert pin divided body (front side insert pin divided body) 62 disposed on a rear side of and separated from an end part fastener element 11*a* and a second insert pin divided body (rear side insert pin divided body) 63 disposed on a rear side of and separated from the first insert pin divided body 62. The first insert pin divided body 62 and the second insert pin divided body 63 are disposed at the same attaching pitch as the one of the fastener element 11 and have an upper-lower symmetrical shape about a central position in an upper and lower direction as in Embodiment 1.

The first insert pin divided body 62 of Embodiment 2 has a first insert pin main body portion 62*a* which is hexahedral-shaped and inserting the fixing member 13 therein and a first raised portion 62*b* raised from an upper surface and a lower surface of the first insert pin main body portion 62*a* in the upper and lower direction. In this case, the first insert pin main body portion 62*a* is formed the same as the first insert pin main body portion 32*a* of the previously-mentioned Embodiment 1.

The first raised portion 62*b* is formed along a length direction and does not have an engaging portion engaging with a box body portion 72, different from the first raised portion 32*b* of the previously-mentioned Embodiment 1. The second insert pin divided body 63 has a hexahedral-shaped second insert pin main body portion 63*a* and a second raised portion 63*b* as in the first insert pin divided body 62, and formed substantially the same as the second insert pin divided body 33 of the previously-mentioned Embodiment 1.

In Embodiment 2, accommodating space portions (accommodating gaps) 69 as thread accommodating portions are formed between the end part fastener element 11*a* of the first element member 10*a* and the first insert pin divided body 62, and between the first insert pin divided body 62 and the second insert pin divided body 63 as in the previously-mentioned Embodiment 1, and the accommodating space portions 69 are disposed at constant intervals in the length direction of the fixing member 13. The fixing member 13 is exposed in the accommodating space portions 69. The fixing member 13 is disposed so as to extend rearward from the second insert pin divided body 63.

The right side box portion 71 has an upper-lower symmetrical shape about the central position in the upper and lower direction. The box portion 71 has a rectangular parallelepiped-shaped box body portion 72, a box extending portion 73 formed integrally to the box body portion 72 and extending frontward from the box body portion 72 while narrowing the thickness dimension and the width dimension and a box side engaging portion 74 disposed between the end part fastener element 11*a* and the box extending portion 73.

Insert pin accommodating portions capable of inserting and accommodating the insert pin 61 therein are disposed on the box body portion 72 and the box extending portion 73 of Embodiment 2 along the front and rear direction. An insertion groove inserting the element attaching edge portion 2 on the first element member 10*a* side is provided on a left side side surface part (insert pin-facing side surface part) facing to the insert pin in the box body portion 72.

The box body portion 72 of Embodiment 2 is formed substantially the same as the box body portion 42 of the previously-mentioned Embodiment 1, and an accommodating space portion (accommodating opening portion) 79*a* accepting and accommodating the sewing threads of the component sewn portion 8 is provided on the box body portion 72 on a right side half portion. The box extending portion 73 of Embodiment 2 is formed substantially the same as the box extending portion 43 of the previously-mentioned Embodiment 1 except that the engaging protruded portion 43*a* of the previously-mentioned Embodiment 1 is not formed.

The box side engaging portion 74 of Embodiment 2 has a body portion 74*a* inserting the fixing member 13 therein and a protruded portion 74*b* protruding from the body portion 74*a* toward the first element member 10*a* diagonally in front. In Embodiment 2, when the insert pin portion 61 is inserted and accommodated in the insert pin accommodating portion of the box portion 71, the box side engaging portion 74 is engaged with the end part fastener element 11*a* of the first element member 10*a*. A position of the insert pin portion 61 at which the box side engaging portion 74 is engaged with the end part fastener element 11*a* becomes an insert pin insertion complete position that the insert pin portion 61 is inserted into the box portion 71 at the deepest and can make the slider 50 sliding.

In the second element member 20*a* of Embodiment 2, the accommodating space portion (accommodating opening portion) 79*a* as the thread accommodating portion is formed on the box body portion 72 as described above, and accommodating space portions (accommodating gaps) 79*b* as thread accommodating portions are formed between the end part fastener element 11*a* and the box side engaging portion 74, and between the box side engaging portion 74 and the box body portion 72 and the box extending portion 73. The accommodating space portions 79*a*, 79*b* are disposed at constant intervals in the length direction of the fixing member 13. Further, the fixing member 13 is disposed so as to extend rearward from the box body portion 72.

In Embodiment 2, the left side first element member 10*a* and the right side second element member 20*a* are fixed to the element attaching edge portions 2 of the left and right cloths 5 with the sewn portions for fixing 6 having the element sewn portion 7 and the component sewn portion 8 in a zigzag shape. In this case, the sewn portion for fixing 6 is formed by repeating a constant zigzag-shaped stitch pattern at the same pitch as in the case of the previously-mentioned Embodiment 1. In addition, an auxiliary sewn portion 9 is formed so as to overlap the sewn portion for fixing 6 as in the above-mentioned Embodiment 1.

In Embodiment 2, with respect to the length direction of the first element member 10*a*, as shown in FIG. 15 for example, when a region within which the insert pin portion 61 contacts directly with and is attached intermittently to the fixing member 13 is defined as a directly-attached region 68, the component sewn portion 8 of the sewn portion for fixing 6 is formed on the whole length direction of the directly-attached region 68.

Further in this case, the component sewn portion 8 of the sewn portion for fixing 6 is, with respect to the length direction of the first element member 10*a*, formed so as to extend frontward from the directly-attached region 68 beyond the front end position 68*a* of the directly-attached region 68 and also extend rearward beyond the rear end position 68*b* of the directly-attached region 68.

Also regarding the second element member 20*a*, the component sewn portion 8 of the sewn portion for fixing 6 is, with respect to the length direction, formed on the whole length direction of the directly-attached region 78 within which the box portion 71 is contacted directly with and attached intermittently to the fixing member 13. Further, the component sewn portion 8 of the sewn portion for fixing 6 is formed so as to extend frontward from the directly-attached region 78 beyond the front end position 78*a* of the directly-attached region 78 and also extend rearward beyond the rear end position 78*b* of the directly-attached region 78.

Accordingly, also in Embodiment 2, with the above-mentioned sewn portion for fixing 6 and the auxiliary sewn portion 9, the left side insert pin portion 61 is properly fixed at a predetermined position so as to continue to a rear side of the element row 3, and the right side box portion 71 is properly fixed at a predetermined position so as to continue to the rear side of the element row 3.

In the slide fastener-attached clothing item 1*a* of Embodiment 2 having the separable rear end stop 60 with the above-mentioned insert pin portion 61 and the box portion 71, the same effect as in the slide fastener-attached clothing item 1 of the previously-mentioned 1 can be obtained.

Embodiment 3

Figure 17:
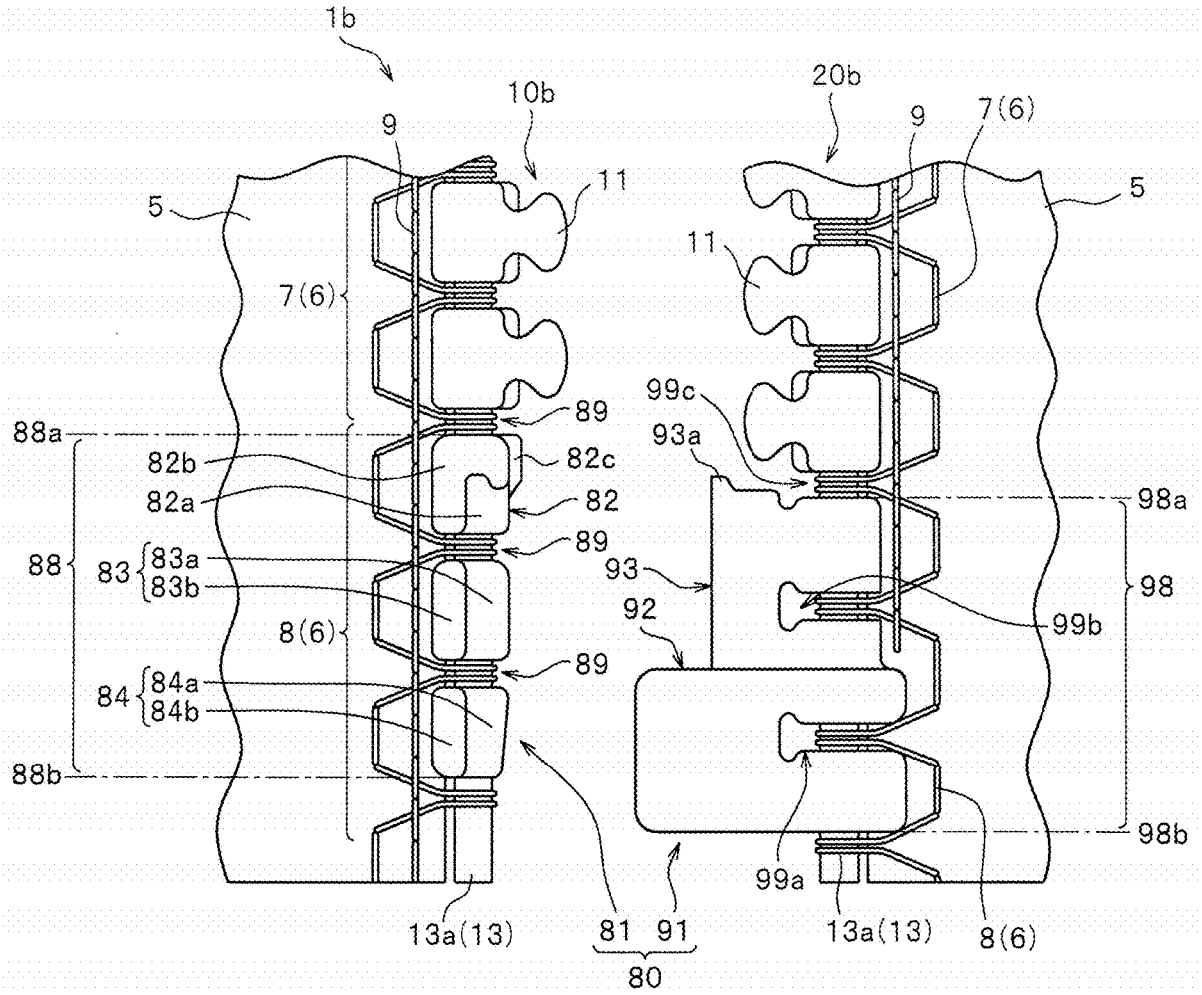
FIG. 17 is a plan view illustrating a main part of a slide fastener-attached product (clothing item) according to Embodiment 3 of the invention schematically.

FIG. 17 is a plan view illustrating a main part of a slide fastener-attached clothing item according to Embodiment 3 of the invention schematically.

In the slide fastener-attached clothing item 1*b* of Embodiment 3, a separable rear end stop 80 provided on a rear end part of the slide fastener has an insert pin portion 81 disposed on the component holding portion 15*b* of the left side first element member 10*b* and a box portion 91 disposed on the component holding portion 15*b* of the right side second element member 20*b*. In this case, the insert pin portion 81 and the box portion 91 are formed integrally to the fixing member 13 by injection-molding thermoplastic resin. The insert pin portion 81 and the box portion 91 of Embodiment 3 are formed longer than the insert pin portion 31 and the box portion 41 of the previously-mentioned Embodiment 1 in the length direction.

The left side insert pin portion 81 of Embodiment 3 has a first insert pin divided body (front side insert pin divided body) 82 disposed on a rear side of and separated from the end part fastener element 11*a* and a second insert pin portion divided body (central insert pin portion divided body) 83 and a third insert pin divided body (rear side insert pin divided body) 84 disposed separately on a rear side of the first insert pin divided body 82 at the same attaching pitch as the one of the fastener element 11. The first insert pin divided body 82 to the third insert pin divided body 84 have an upper-lower symmetrical shape about a central position in the upper and lower direction.

The first insert pin divided body 82 of Embodiment 3 has a hexahedral-shaped first insert pin main body portion 82*a* inserting the fixing member 13 therein, a first raised portion 82*b* raised from an upper surface and a lower surface of the first insert pin main body portion 82*a* and formed so as to appear as a J-shape or a hook-shape in a plan view or in a bottom view and a protruded piece portion 82*c* protruding from the first insert pin main body portion 82*a* toward the box portion 91. The first insert pin divided body 82 is formed substantially the same as the first insert pin divided body 32 of the previously-mentioned Embodiment 1.

The second insert pin divided body 83 and the third insert pin divided body 84 of Embodiment 3 have a second insert pin main body portion 83*a* or a third insert pin main body portion 84*a* inserting the fixing member 13 therein and a second raised portion 83*b* or a third raised portion 84*b* raised from the upper surface and the lower surface of the second insert pin main body portion 83*a* or the third insert pin main body portion 84*a* and formed along the length direction. In this case, the third insert pin divided body 84 of Embodiment 3 is formed substantially the same as the second insert pin divided body 33 of the previously-mentioned Embodiment 1. Further, the second insert pin main body portion 83*a* of the second insert pin divided body 83 has a constant width dimension.

In Embodiment 3, accommodating space portions (accommodating gaps) 89 as thread accommodating portions are formed between the end part fastener element 11*a* and the first insert pin divided body 82, between the first insert pin divided body 82 and the second insert pin divided body 83 and between the second insert pin divided body 83 and the third insert pin divided body 84 of the first element member 10*b*, and the accommodating space portions 89 are disposed at constant intervals in the length direction of the fixing member 13. The fixing member 13 is exposed in the accommodating space portions 89. The fixing member 13 is disposed so as to extend rearward from the third insert pin divided body 84.

The right side box portion 91 has an upper-lower symmetrical shape about a central position in the upper and lower direction. The box portion 91 has a rectangular parallelepiped-shaped box body portion 92 and a box extending portion 93 formed integrally to the box body portion 92 and extending frontward from the box body portion 92 while narrowing the thickness dimension and the width dimension. An insert pin accommodating portion capable of inserting and accommodating the insert pin portion 81 therein is provided on the box body portion 92 and the box extending portion 93 along the front and rear direction. An insert groove in which the element attaching edge portion 2 of the first element member 10*b* side is inserted is disposed on a left side side surface part (insert pin-facing side surface part) facing to the insert pin in the box body portion 92.

The box body portion 92 of Embodiment 3 is formed substantially the same as the box body portion 42 of the previously-mentioned Embodiment 1, and in the box body portion 92, an accommodating space portion (accommodating opening portion) 99*a* accepting and accommodating the sewing threads of the component sewn portion 8 is provided on a right side half portion.

The box extending portion 93 of Embodiment 3 is formed so as to extend frontward from the box body portion 92 further than a case of the box extending portion 43 of the previously-mentioned Embodiment 1. An engaging protruded portion 93*a* which is hooked and engaged with the first raised portion 82*a* of the first insert pin divided body 82 in the insert pin portion 81 is provided on the box extending portion 93. In addition, an accommodating space portion (accommodating opening portion) 99*b* which is the same as the accommodating space portion 99*a* formed on the box body portion 92 is provided on the box extending portion 93 of Embodiment 3, and the sewing threads of the component sewn portion 8 are inserted and accommodated in the accommodating space portion 99*b*.

Further in Embodiment 3, an accommodating space portion (accommodating gap) 99*c* as a thread accommodating portion is formed between the end part fastener element 11*a* and the box extending portion 93. The above-mentioned accommodating space portions 99*a*-99*c* provided in Embodiment 3 are disposed at constant intervals in the length direction of the fixing member 13. Further, the fixing member 13 is disposed so as to extend rearward from the box body portion 92.

Also in Embodiment 3, with a zigzag-shaped sewn portion for fixing 6 and an auxiliary sewn portion 9 which presses the sewn portion for fixing 6, the left side insert pin portion 81 is properly fixed at a predetermined position so as to continue to a rear side of the element row 3 and the right side box portion 91 is properly fixed at a predetermined position so as to continue to the rear side of the element row 3.

Particularly, the component sewn portion 8 of the sewn portion for fixing 6 is, with respect to the length direction of the first element member 10*b*, formed on the whole length direction of the directly-attached region 88 within which the insert pin portion 81 is contacted directly with and attached intermittently to the fixing member 13. Further, the component sewn portion 8 of the sewn portion for fixing 6 is formed so as to extend frontward from the directly-attached region 88 beyond the front end position 88*a* of the directly-attached region 88 and also extend rearward beyond the rear end position 88*b* of the directly-attached region 88.

Also regarding the second element member 20*b*, the component sewn portion 8 of the sewn portion for fixing 6 is, with respect to the length direction, formed on the whole length direction of the directly-attached region 98 within which the box portion 91 is contacted directly with and attached intermittently to the fixing member 13. Further, the component sewn portion 8 of the sewn portion for fixing 6 is formed so as to extend frontward from the directly-attached region 98 beyond the front end position 98*a* of the directly-attached region 98 and also extend rearward beyond the rear end position 98*b* of the directly-attached region 98.

The slide fastener-attached clothing item 1*b* of the above-mentioned Embodiment 3 can have, as in the slide fastener-attached clothing item 1 of the previously-mentioned Embodiment 1, a function of the slide fastener in a state that a fastener tape is omitted. Further, the left and right first element member 10*b* and second element member 20*b* can be properly and smoothly coupled and separated by the separable rear end stop 80. Moreover, the slide fastener attached-clothing item 1*b* can be easily manufactured by using the cloth 5 to which a desired function such as waterproofness or water-repellency is added.

Figure 18:
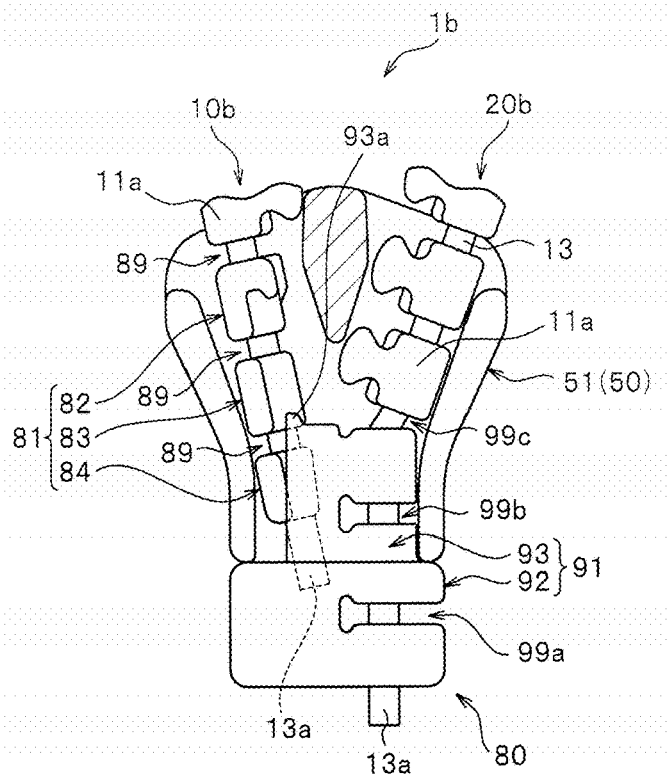
FIG. 18 is a schematic view illustrating an operation that an insert pin portion of the separable rear end stop according to Embodiment 3 passes into an element guide path and is inserted into an insert pin accommodating portion of the box portion.
Figure 19:
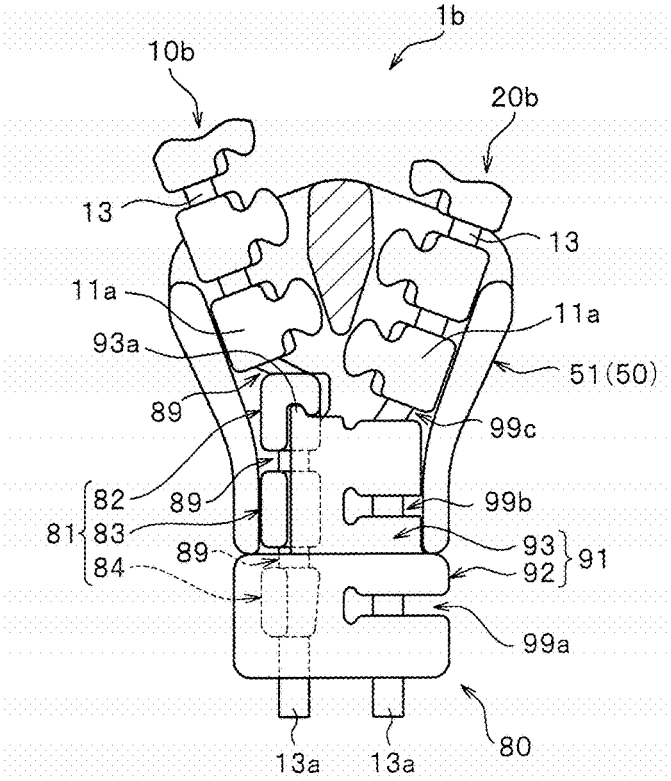
FIG. 19 is a schematic view illustrating a state that the insert pin portion of the separable rear end stop is inserted into the insert pin accommodating portion of the box portion.

Further, in the slide fastener-attached clothing item 1*b* of Embodiment 3, a separable rear end stop 80 is formed of an insert pin portion 81 having three divided bodies and a box portion 91 capable of inserting and accommodating the insert pin portion 81 therein as described above. In such a separable rear end stop 80 of Embodiment 3, the box extending portion 93 of the box portion 91 is formed longer in the length direction compared with a case of the separable rear end stop 30 of the previously-mentioned Embodiment 1. Thereby, since when the slider 50 is contacted with the box body portion 92, as shown in FIG. 18, the box extending portion 93 can be inserted into the element guide path of the slider 50 deeply, a posture of the slider 50 can be stable. As a result, as shown in FIGS. 18 and 19, the insert pin portion 81 can be smoothly and stably inserted and easily accommodated into the insert pin accommodating portion 41*a* of the box portion 91 via the element guide path of the slider 50.

Further in the separable rear end stop 80 of Embodiment 3, a length dimension of the insert pin portion 81 and the box portion 91 can make close to a length dimension of the insert pin and length dimensions of the box body/box pin in a general separable rear end stop having a conventional insert pin, box pin and box body. Therefore, since a user can handle the separable rear end stop 80 of Embodiment 3 approximately in the same manner as in the case of a conventional separable rear end stop, an operation of the separable rear end stop can be properly conducted without a feeling of strangeness.

Embodiment 4

Figure 20:
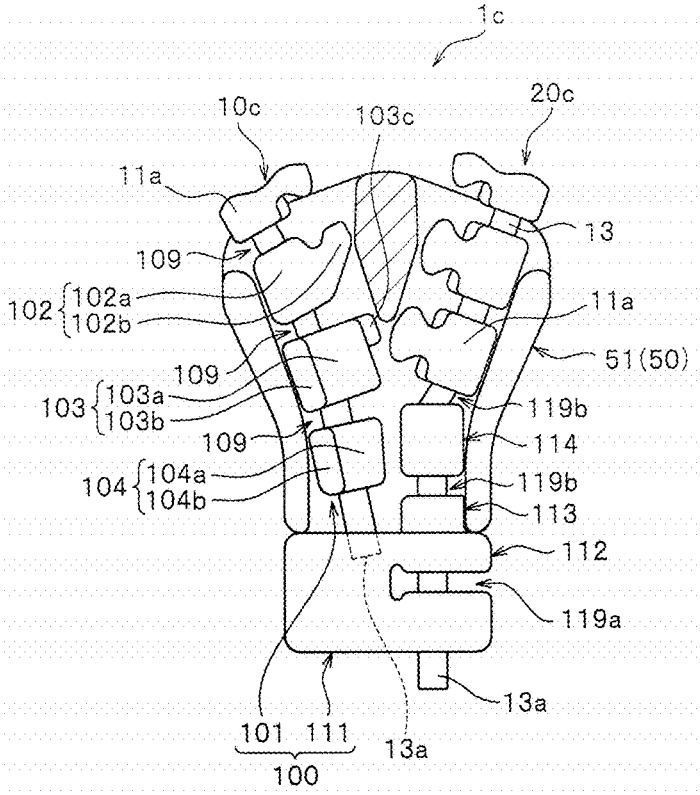
FIG. 20 is a schematic view illustrating a state that in the separable rear end stop according to Embodiment 4 of the invention, an insert pin portion is inserted into an insert pin accommodating portion of a box portion.
Figure 21:
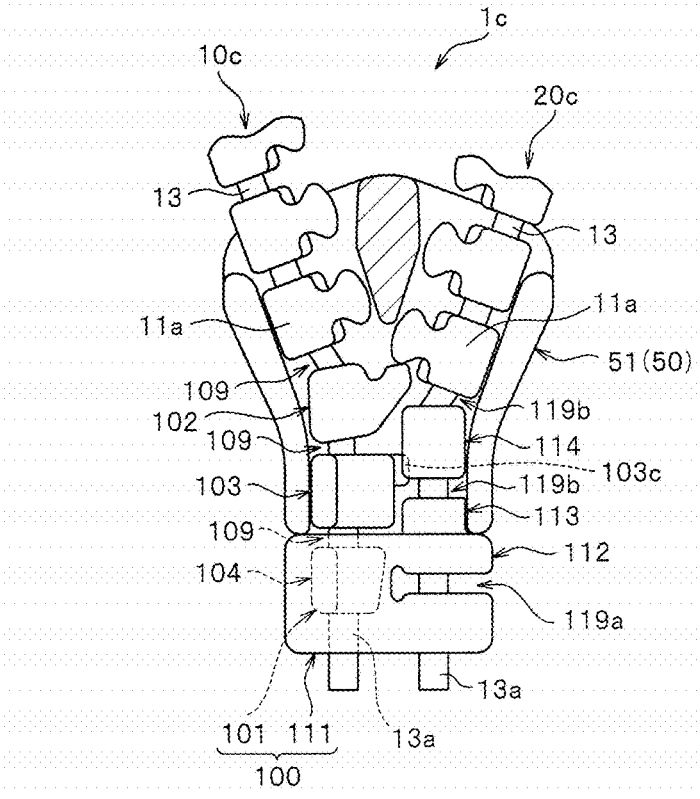
FIG. 21 is a schematic view illustrating a state that the insert pin portion of the separable rear end stop has been inserted into the insert pin accommodating portion of the box portion.

FIG. 20 is a schematic view illustrating a state that, in the separable rear end stop according to Embodiment 4 of the invention, the insert pin portion is inserted into the insert pin accommodating portion of the box portion. FIG. 21 is a schematic view illustrating a state that the insert pin portion of the separable rear end stop has been inserted into the insert pin accommodating portion of the box portion.

In the slide fastener-attached clothing item 1*c* of Embodiment 4, a separable rear end stop 100 provided on a rear end part of the slide fastener has an insert pin portion 101 disposed on the component holding portion 15*b* of a left side first element member 10*c* and a box portion 111 disposed on the component holding portion 15*b* of a right side second element member 20*c*. In this case, the insert pin portion 101 and the box portion 111 are formed integrally to the fixing member 13 by injection molding thermoplastic resin.

The left side insert pin portion 101 has a first insert pin divided body (front side insert pin divided body) 102 disposed on a rear side of and separated from the end part fastener element 11*a* and a second insert pin portion divided body (central insert pin portion divided body) 103 and a third insert pin divided body (rear side insert pin divided body) 104 disposed separately on the rear side of the first insert pin divided body 102 at the same attaching pitch as the one of the fastener element 11. The first insert pin divided body 102 to the third insert pin divided body 104 have an upper-lower symmetrical shape about a central position in the upper and lower direction.

The first insert pin divided body 102 of Embodiment 4 has a main body portion 102*a* inserting the fixing member 13 therein and a protruded portion 102*b* protruding diagonally frontward from the main body portion 102*a* toward the second element member 20*c*. The first insert pin divided body 102 is formed, as shown in FIG. 21, so as to be capable of engaging with the end part fastener element 11*a* of the second element member 20*c*.

The second insert pin divided body 103 of Embodiment 4 has a second insert pin main body portion 103*a* inserting the fixing member 13 therein, a second raised portion 103*b* raised from an upper surface and an lower surface of the second insert pin main body portion 103*a* and formed along the length direction and a protruded piece portion 103*c* protruding from the second insert pin main body portion 103*a* toward the box portion 111. In this case, the protruded piece portion 103*c* is formed so as to be able to be inserted into an insertion concave groove portion not shown in Figures and formed on the box divided body 114 of the box portion 111 as described later when the insert pin portion 101 is accommodated in the insert pin accommodating portion of the box 111.

The third insert pin divided body 104 has a third insert pin main body portion 104*a* inserting the fixing member 13 therein and a third raised portion 104*b* raised from the upper surface and the lower surface of the third insert pin main body portion 104*a* and formed along the length direction.

In this case, the second insert pin main body portion 103*a* and the third insert pin main body portion 104*a* are formed so as a width dimension to be larger than the ones of the second insert pin main body portion 83*a* and the third insert pin main body portion 84*a* in the previously-mentioned Embodiment 3. A box pin-facing side surface of the third insert pin main body portion 104*a* is formed as a sloped surface sloping with respect to the length direction so as the width dimension of the third insert pin main body portion 104*a* to gradually decrease rearward.

In Embodiment 4, accommodating space portions (accommodating gaps) 109 as thread accommodating portions are formed between the end part fastener element 11*a* and the first insert pin divided body 102, between the first insert pin divided body 102 and the second insert pin divided body 103 and between the second insert pin divided body 103 and the third insert pin divided body 104 of the first element member 10*c*, and the accommodating space portions 109 are disposed at constant intervals in the length direction of the fixing member 13. The fixing member 13 is exposed in the accommodating space portions 109. Further, the fixing member 13 is disposed so as to extend rearward from the third insert pin divided body 104.

The right side box portion 111 has an upper-lower symmetrical shape about a central position in an upper and lower direction. The box portion 111 has a box body portion 112 whose figure is rectangular parallelepiped-shape, a box extending portion 113 formed integrally to the box body portion 112 and extending frontward from the box body portion 112 while narrowing the thickness dimension and the width dimension and a box divided body 114 disposed between the end part fastener element 11*a* and the box extending portion 113 of the second element member 20*c*.

The box body portion 112 of Embodiment 4 is formed substantially the same as the box body portion 42 of the previously-mentioned Embodiment 1, and in the box body portion 112, an accommodating space portion (accommodating opening portion) 119*a* accepting and accommodating the sewing threads of the component sewn portion 8 is disposed on a right side half portion.

The box extending portion 113 of Embodiment 4 is formed so as the thickness dimension and the width dimension to narrower than the box body portion 112. Further, the box extending portion 113 is formed so as to wrap the fixing member 13 inside. The box divided body 114 of Embodiment 4 has a hexahedral (rectangular parallelepiped) shape wrapping the fixing member 13 inside and formed so as to have the same thickness dimension and the width dimension as the ones of the box extending portion 113. Further, an insertion concave groove portion not shown in Figures into which the above-mentioned protruded piece portion 103*c* of the second insert pin divided body 103 can be inserted is provided concavely on a left side side surface part (insert pin-facing side surface part) of the box divided body 114 along the length direction.

In Embodiment 4, accommodating space portions (accommodating gaps) 119*b* are formed between the end part fastener element 11*a* and the box divided body 114 and between the box divided body 114 and the box extending portion 113, and the accommodating space portions 119*b* are disposed at constant intervals in the length direction of the fixing member 13. The fixing member 13 is exposed in the above-mentioned accommodating space portions 119*a*, 119*b* provided on the box body portion 112. Further, the fixing member 13 is disposed so as to extend rearward from the box body portion 112.

Also in Embodiment 4, with a zigzag-shaped sewn portion for fixing 6 and an auxiliary sewn portion 9 which presses the sewn portion for fixing 6, the left side insert pin portion 101 is properly fixed at a predetermined position so as to continue to a rear side of the element row 3 and the right side box portion 111 is properly fixed at a predetermined position so as to continue to the rear side of the element row 3.

The component sewn portion 8 of the sewn portion for fixing 6 of Embodiment 4 is, as in the cases of the previously-mentioned Embodiments 1-3, with respect to the first element member 10*c* and the second element member 20*c*, formed on the whole length direction of the directly-attached region within which the insert pin portion 101 or the box portion 111 is contacted directly with and attached intermittently to the fixing member 13. Further, the component sewn portion 8 of the sewn portion for fixing 6 is formed so as to extend frontward from the directly-attached region beyond a front end position of the directly-attached region and also extend to a rearward beyond a rear end position of the directly-attached region.

In the slide fastener-attached clothing item 1*c* of Embodiment 4 having the above-mentioned separable rear end stop 100, the same effect as in the previously-mentioned slide fastener-attached clothing item 1*b* of Embodiment 3 can be obtained.

Embodiment 5

Figure 22:
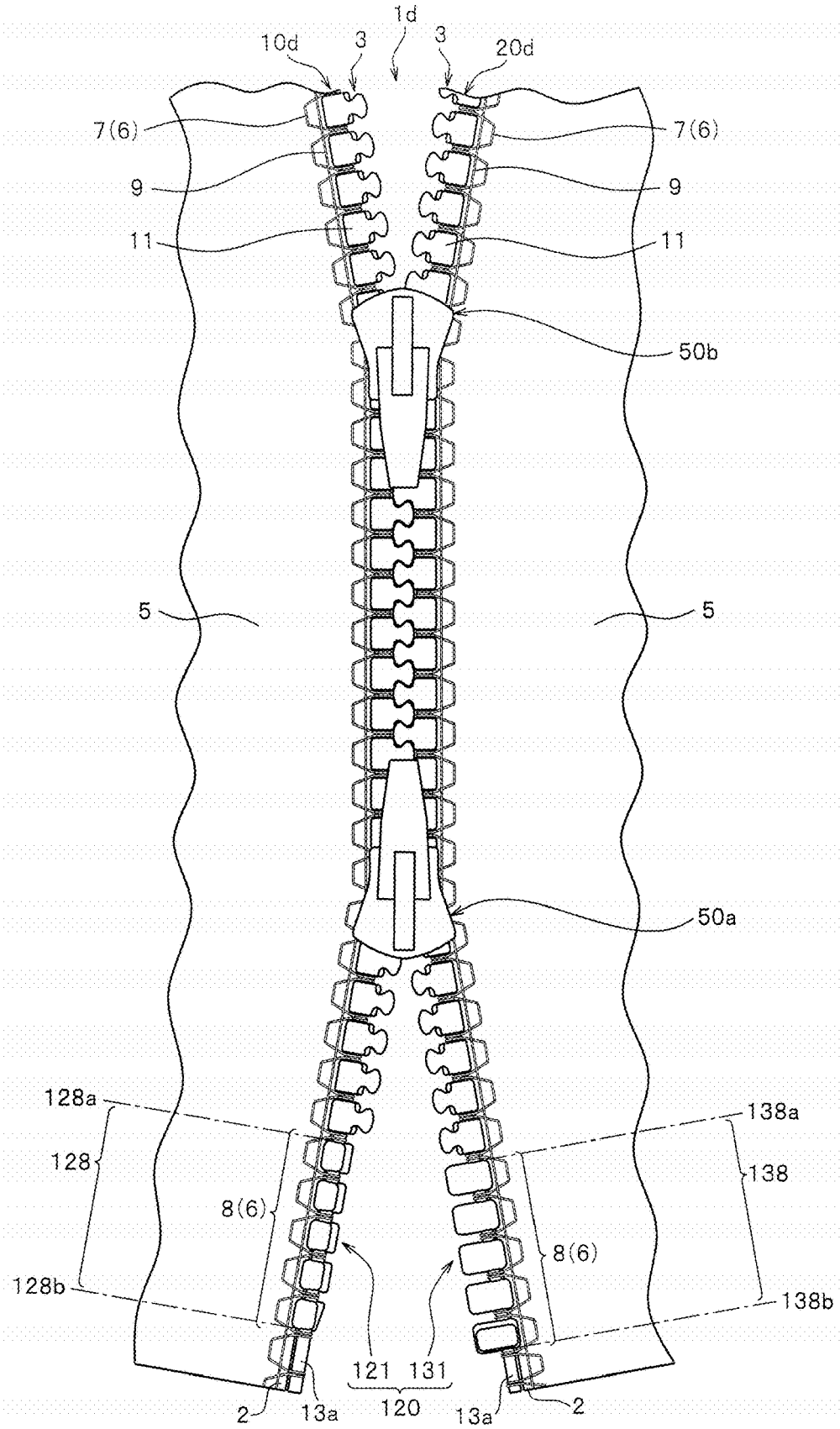
FIG. 22 is a plan view illustrating a main part of a slide fastener-attached product (clothing item) according to Embodiment 5 of the invention schematically.
Figure 23:
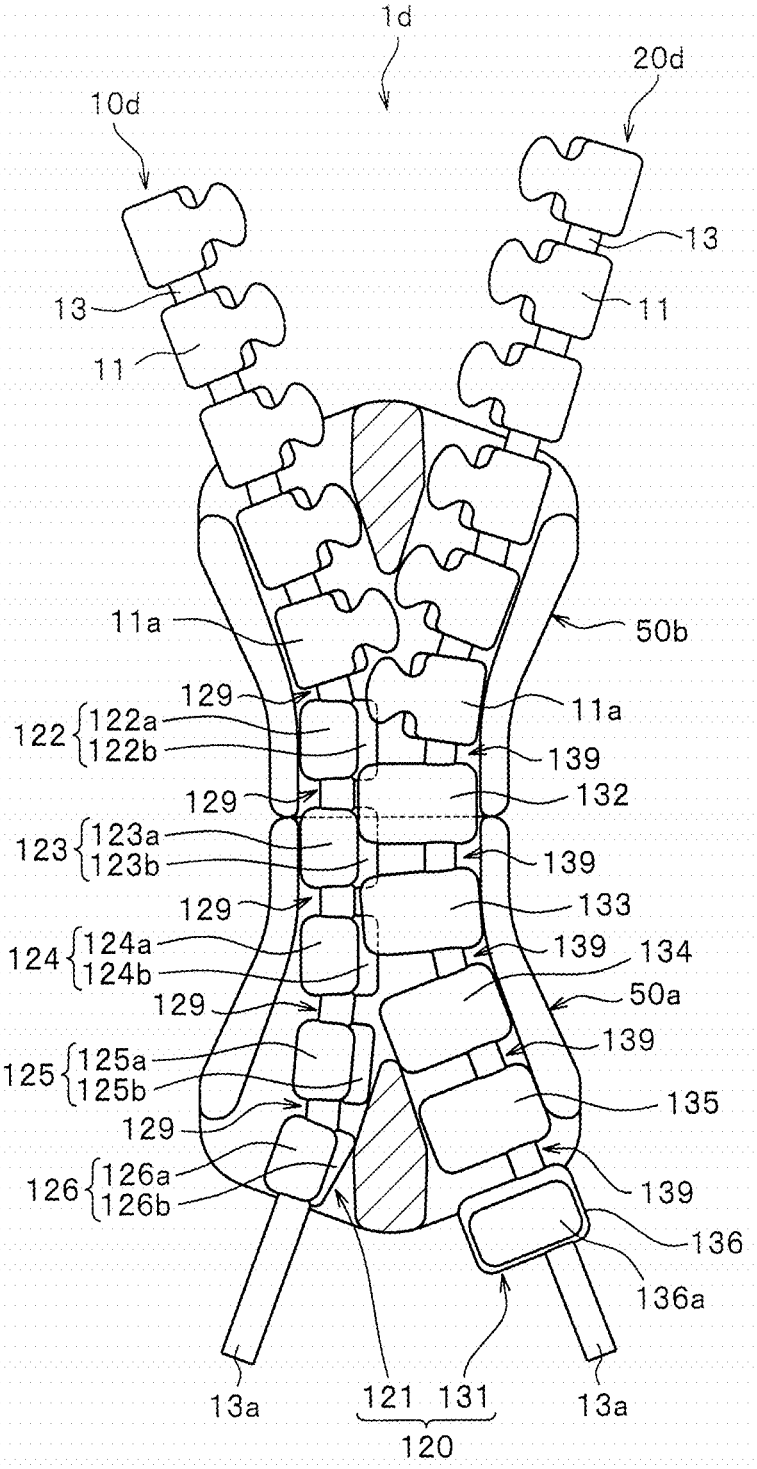
FIG. 23 is a schematic view illustrating a state that an insert pin portion of a separable rear end stop according to Embodiment 5 is inserted into two sliders.
Figure 24:
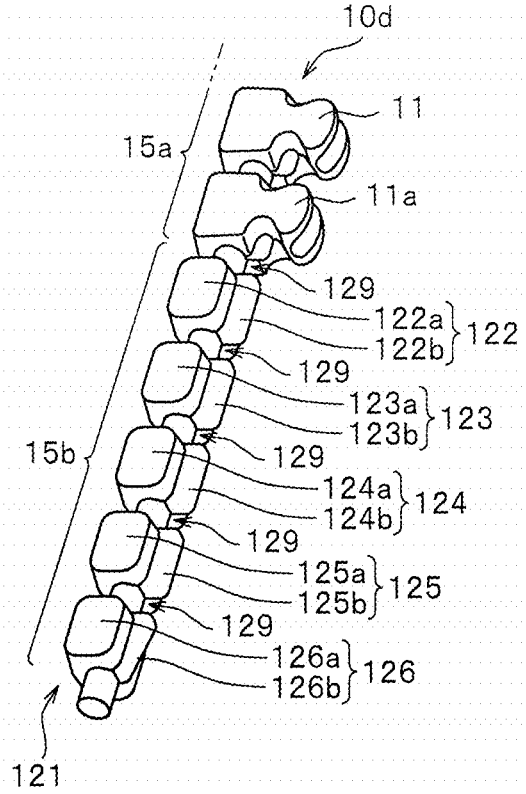
FIG. 24 is a perspective view illustrating the insert pin portion.
Figure 25:
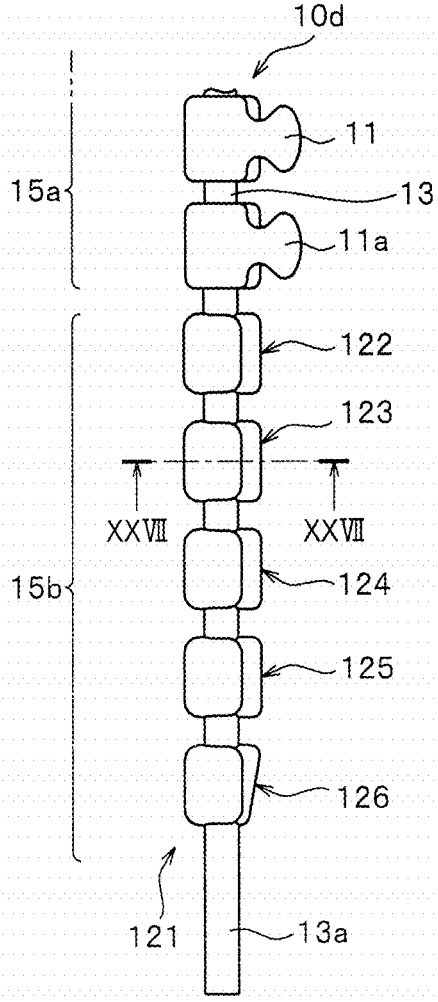
FIG. 25 is a plan view illustrating the insert pin portion.
Figure 26:
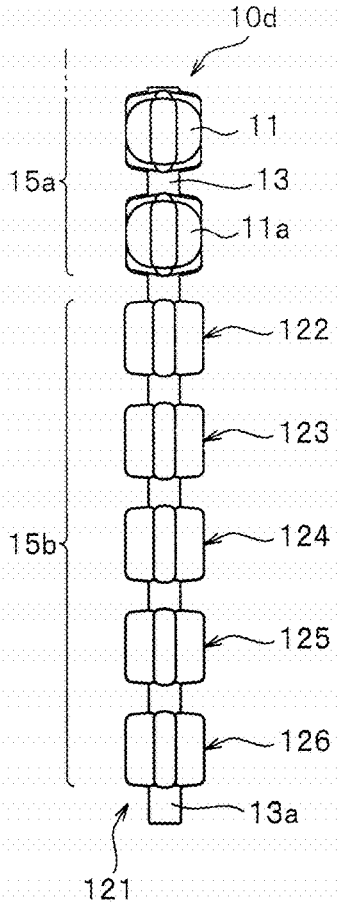
FIG. 26 is a side view illustrating the insert pin portion.
Figure 27:
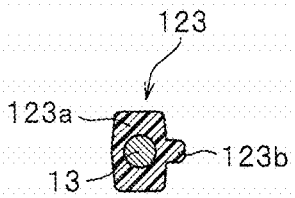
FIG. 27 is a cross-sectional view along the line XXVII-XXVII line shown in FIG. 25.

FIG. 22 is a plan view illustrating a main part of a slide fastener-attached clothing item according to Embodiment 5 of the invention schematically. FIG. 23 is a schematic view illustrating a state that an insert pin portion of the separable rear end stop is inserted into two sliders.

FIGS. 24-27 are a perspective view, a plan view, a side view and a cross-sectional view illustrating the insert pin portion of the separable rear end stop. FIGS. 28-31 are a perspective view, a plan view, a side view and a cross-sectional view illustrating a box portion of a separable rear end stop.

The slide fastener structured in the slide fastener-attached clothing item 1*d* of Embodiment 5 has a left and right pair of fastener stringer portions having left and right element rows formed of a first element member 10*d* and a second element member 20*d*, a rear side first slider 50*a* and a front side second slider 50*b* capable of coupling and separating the element rows 3 of the left and right fastener stringer portions and a separable rear end stop 120 disposed adjacent to a rear end part of the left and right element rows 3.

In this case, the first slider 50*a* and the second slider 50*b* have substantially the same structure as the slider 50 of the previously-mentioned Embodiment 1. Further, the first slider 50*a* and the second slider 50*b* are attached slidably to the element rows 3 in a posture to which each rear mouth is faced.

A separable rear end stop 120 of Embodiment 5 has an insert pin portion 121 and a box portion 131 which are disposed in a position facing to each other in the clothing item. Different from the separable rear end stops 30, 60, 80, 100 of the previously-mentioned Embodiments 1-4, the separable rear end stop 120 is formed as an open reverse separable rear end stop 120 without a box body portion into which can insert the insert pin portion 121.

Specifically explained, the separable rear end stop 120 of Embodiment 5 has an insert pin portion 121 disposed on a left side first element member 10*d* and fixed to the element attaching edge portion 2 of a left side cloth 5 and a box portion (box pin portion) 131 disposed on a right side second element member 20*d* and fixed to the element attaching edge portion 2 of a right side cloth 5. The insert pin portion 121 and the box portion 131 are formed integrally to respective fixing members 13 by injection-molding thermoplastic resin.

The left side insert pin portion 121 is formed of five insert pin divided bodies which are a first insert pin divided body 122—a fifth insert pin divided body 126. Each of the first insert pin divided body 122—the fifth insert pin divided body 126 is an upper-lower symmetrical shape about a central position in an upper and lower direction.

The first insert pin divided body 122—the fifth insert pin divided body 126 are disposed on a rear side of the end part fastener element 11*a* of the first element member 10*d* at the same attaching pitch as the one of the fastener element 11 at regular intervals. It should be noted that five insert pin divided bodies 122-126 forming the insert pin portion 121 are prescribed as the first insert pin divided body 122, the second insert pin divided body 123, the third insert pin divided body 124, the fourth insert pin divided body 125 and the fifth insert pin divided body 126 in order from the insert pin divided body nearest to the end part fastener element 11*a* rearward.

The first insert pin divided body 122—the fifth insert pin divided body 126 of Embodiment 5 have hexahedral insert pin main body portions 122*a*-126*a* inserting the fixing member 13 therein and projected piece portions 122*b*-126*b* projected from a box pin-facing side surface parts in the insert pin main body portions 122*a*-126*a* in the width direction respectively. In this case, each insert pin main body portion 122*a*-126*a* of the first insert pin divided body 122—the fifth insert pin divided body 126 has a same shape and size with each other. Thickness dimensions in the upper and the lower direction in the insert pin main body portions 122*a*-126*a* are set to be the same size as the one of the fastener element 11 of the first element member 10*d* so as to be able to be inserted into element guide paths of the first slider 50*a* and the second slider 50*b*.

Each of the projected piece portions 122*b*-126*b* of the first insert pin divided body 122—the fifth insert pin divided body 126 makes the thickness dimension smaller than the insert pin main body portions 122*a*-126*a* and is projected toward a right side from the insert pin main body portions 122*a*-126*a* via steps respectively.

Further, respective projected piece portions 122*b*-125*b* of the first insert pin divided body 122—the fourth insert pin divided body 125 are disposed along the length direction at a constant width dimension from the insert pin main body portions 122*a*-125*a* in a plan view or in a bottom view. On the other hand, the projected piece portion 126*b* of the fifth insert pin divided body 126 is formed as a shape which gradually decreases the width dimension from the insert pin main body portion 126*a* to a rearward in a plan view or in a bottom view.

In the insert pin portion 121 of Embodiment 5, accommodating space portions (accommodating gaps) 129 as thread accommodating portions are formed between the end part fastener element 11*a* and respective first insert pin divided body 122—fifth insert pin divided body 126 of the first element member 10*d*, and the accommodating space portions 129 are disposed at constant intervals in the length direction of the fixing member 13. The fixing member 13 is exposed in the accommodating space portions 129. Further, the fixing member 13 is disposed so as to extend rearward from the fifth insert pin divided body 126.

The right side box portion 131 of Embodiment 5 is formed as a box pin portion which is inserted into element guide paths of the first slider 50*a* and the second slider 50*b*. The box portion 131 is formed of five box divided bodies which are a first box divided body 132—a fifth box divided body 136. The first box divided body 132—the fifth box divided body 136 have an upper-lower symmetrical shape about a central position in the upper and lower direction respectively.

The first box divided body 132—the fifth box divided body 136 are disposed on a rear side of the end part fastener element 11*a* in the second element member 20*d* at the same attaching pitch as the one of the fastener element 11 at regular intervals. It should be noted that five box divided bodies 132-136 forming the box portion 131 are prescribed as the first box divided body 132, the second box divided body 133, the third box divided body 134, the fourth box divided body 135 and the fifth box divided body 136 in order from the box divided body nearest to the end part fastener element 11*a* rearward.

The first box divided body 132—the fifth box divided body 136 of Embodiment 5 have a hexahedral-shaped figure and the fixing member 13 is inserted into an inside of the first box divided body 132—the fifth box divided body 136 so as to penetrate in a front and rear direction. In this case, when the first slider 50*a* and the second slider 50*b* are held at a rear end position in which the insert pin portion 121 can be inserted, for example, the first box divided body 132—the forth box divided body 135 are disposed as box pin portions which insert the insert pin portion 121 into the element guide paths of the first slider 50*a* and the second slider 50*b*. Therefore, the thickness dimensions in the upper and lower direction of the first box divided body 132—the fourth box divided body 135 are set to be the same size as the one of the fastener element 11 of the second element member 20*d* so as to be able to be inserted into the element guide paths of the first slider 50*a* and the second slider 50*b*.

Figure 28:
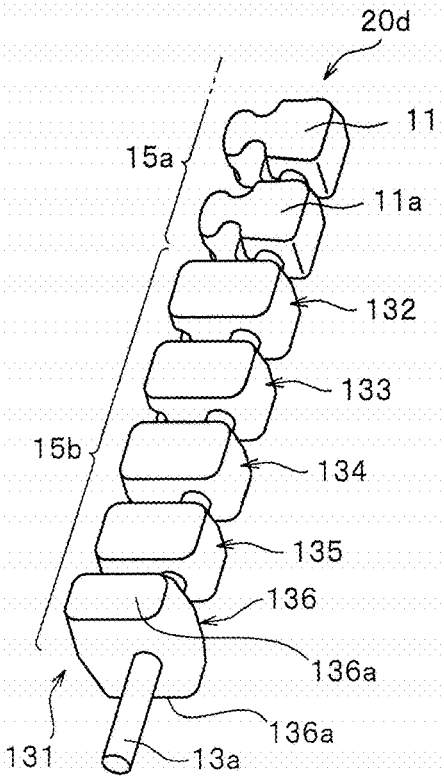
FIG. 28 is a perspective view illustrating a box portion of a separable rear end stop according to Embodiment 5.
Figure 29:
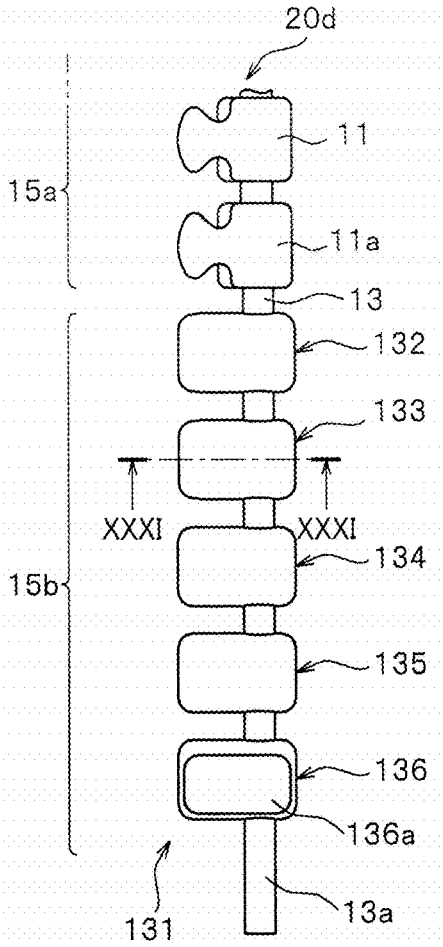
FIG. 29 is a plan view illustrating the box portion.
Figure 30:
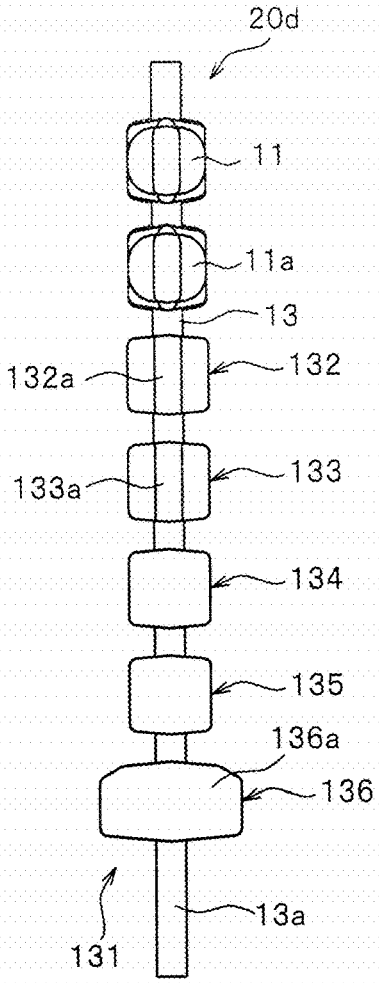
FIG. 30 is a side view illustrating the box portion.
Figure 31:
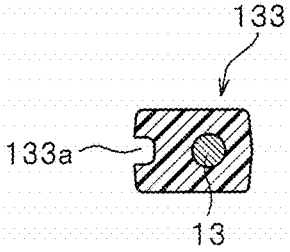
FIG. 31 is a cross-sectional view along the line XXXI-XXXI line shown in FIG. 29.

On the other hand, the fifth box divided body 136 is formed, as shown in FIGS. 28 and 30, so as the thickness dimension to be larger than the ones of the first box divided body 132—the fourth box divided body 135. In the fifth box divided body 136, upper and lower protruded portions 136*a* protruded in the upper and lower direction further than a thickness position (height position) of the upper surface and the lower surface of the first box divided body 132—the fourth box divided body 135 are formed as stopper portions 136*a* capable of contacting with shoulder mouth side end parts of the upper blade 53 and the lower blade 55 of the first slider 50*a* and stopping the first slider 50*a* in the box portion 131. Further, the fifth box divided body 136 has a shape gradually decreasing the length dimension toward a central position in the width direction so as to maintain a contacting state of the first slider 50*a* stably when the first slider 50*a* is contacted with.

In Embodiment 5, the first box divided body 132 and the second box divided body 133 have a same shape and size each other. Insertion concave groove portions 132*a*, 133*a* into which the projected piece portions 122*b*-126*b* of the first insert pin divided body 122—the fifth insert pin divided body 126 in the insert pin portion 121 can be inserted are formed on the insert pin-facing side surface parts of the first box divided body 132 and the second box divided body 133 at a center part of the thickness direction in the first box divided body 132 and the second box divided body 133 along the length direction.

For example, as shown in FIG. 23, the projected piece portions 122*b*-124*b* of the insert pin portion 121 are inserted into the insertion concave groove portions 132*a*, 133*a* of the first box divided body 132 and the second box divided body 133 and held, thereby a relative position of the insert pin portion 121 and the box portion 131 in the thickness direction can be adjusted, and a displacement of the relative position in the thickness direction in the upper and lower direction can be prevented.

The third box divided body 134 and the fourth box divided body 135 of Embodiment 5 are formed as a rectangular parallelepiped-shape and have a same shape and size with each other. It should be noted that, the insertion concave groove portion such as in the first box divided body 132 and the second box divided body 133 is not formed on the third box divided body 134 and the fourth box divided body 135. The fifth box divided body 136 of Embodiment 5 is formed so as to appear the same shape as the first box divided body 132—the fourth box divided body 135 in a plan view or in a bottom view.

In the box portion 131 of Embodiment 5, accommodating space portions (accommodating gaps) 139 as thread accommodating portions are formed between the end part fastener element 11*a* and respective first box divided body 132—fifth box divided body 136, and the accommodating space portions 139 are disposed at constant intervals in the length direction of the fixing member 13. The fixing member 13 is exposed in the accommodating space portions 139. Further, the fixing member 13 is disposed so as to extend rearward from the fifth box divided body 136.

In Embodiment 5, as in the previously-mentioned Embodiment 1 and others, the left side insert pin portion 121 is properly fixed at a predetermined position so as to continue to a rear side of the element row 3, and the right side box portion 131 is properly fixed at a predetermined position so as to continue the rear side of the element row 3, with the sewn portion for fixing 6 (element sewn portion 7 and component sewn portion 8) made by the zigzag-shaped lock stitches and the auxiliary sewn portion 9 formed to press the sewn portion for fixing 6.

Further, as shown in FIG. 22, the component sewn portion 8 of the sewn portion for fixing 6 of Embodiment 5 is, as in the cases of the previously-mentioned Embodiments 1-4, with respect to the first element member 10*d* and the second element member 20*d*, formed on the whole length direction of the directly-attached regions 128, 138 within which the insert pin portion 121 or the box portion 131 is contacted directly with and attached intermittently to the fixing member 13. Further, the component sewn portion 8 of the sewn portion for fixing 6 is formed so as to extend frontward from the directly-attached regions 128, 138 beyond the front end positions 128*a*, 138*a* of the directly-attached regions 128, 138 and also extend rearward beyond the rear end position 128*b*, 138*b* of the directly-attached regions 128, 138.

In the slide fastener-attached clothing item 1*d* of the above-mentioned Embodiment 5, an open reverse-type separable rear end stop 120 is formed on a rear end part of the slide fastener. Therefore, for example, as shown in FIG. 23, after the right side insert pin portion 121 is inserted into the first slider 50*a* and the second slider 50*b* to an insert pin insertion complete position deeply, the front side second slider 50*b* is slid frontward (element coupling direction), thereby the left and right element rows 3 can be coupled in order.

Then, by sliding the rear side first slider 50*a* frontward, the left and right element rows 3 coupled by the second slider 50*b* can be separated from the rear end part in order. It should be noted that, in the separable rear end stop 120 of Embodiment 5, the insert pin insertion complete position means a position at which the end part fastener element 11*a* of the left side first element member 10*d* approaches to or contacts with the end part fastener element 11*a* of the right side second element member 20*d*.

Further, in the slide fastener-attached clothing item 1*d* of Embodiment 5, as in the slide fastener-attached clothing item 1 of the previously-mentioned Embodiment 1 or others, a function of a slide fastener can be maintained without using a fastener tape. Moreover, the slide fastener attached-clothing item 1*d* can be easily formed by using the cloth 5 to which a desired function such as waterproofness or water-repellency is added.

Embodiment 6

Figure 32:
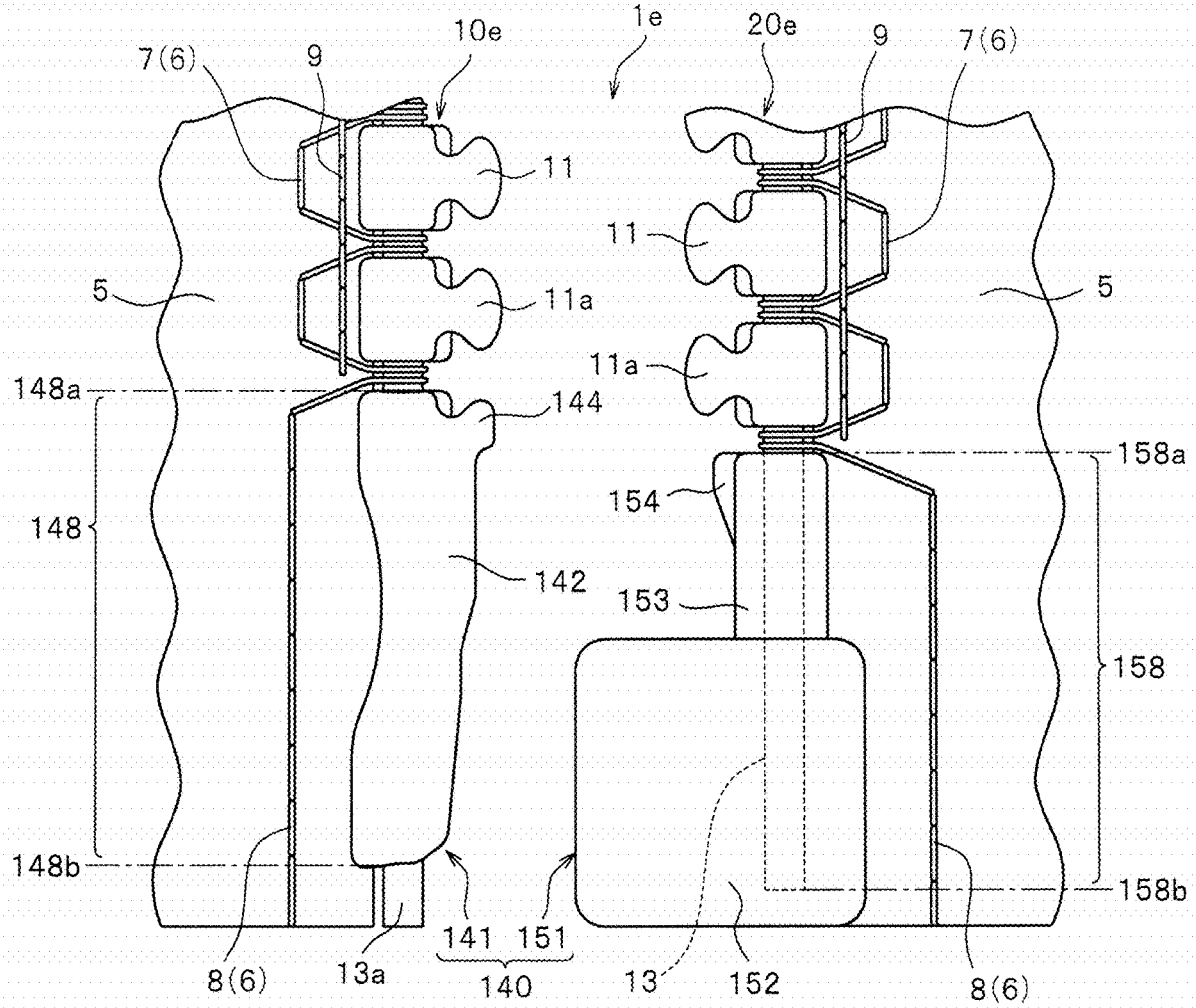
FIG. 32 a plan view illustrating a main part of a slide fastener-attached product (clothing item) according to Embodiment 6 of the invention schematically.
Figure 33:
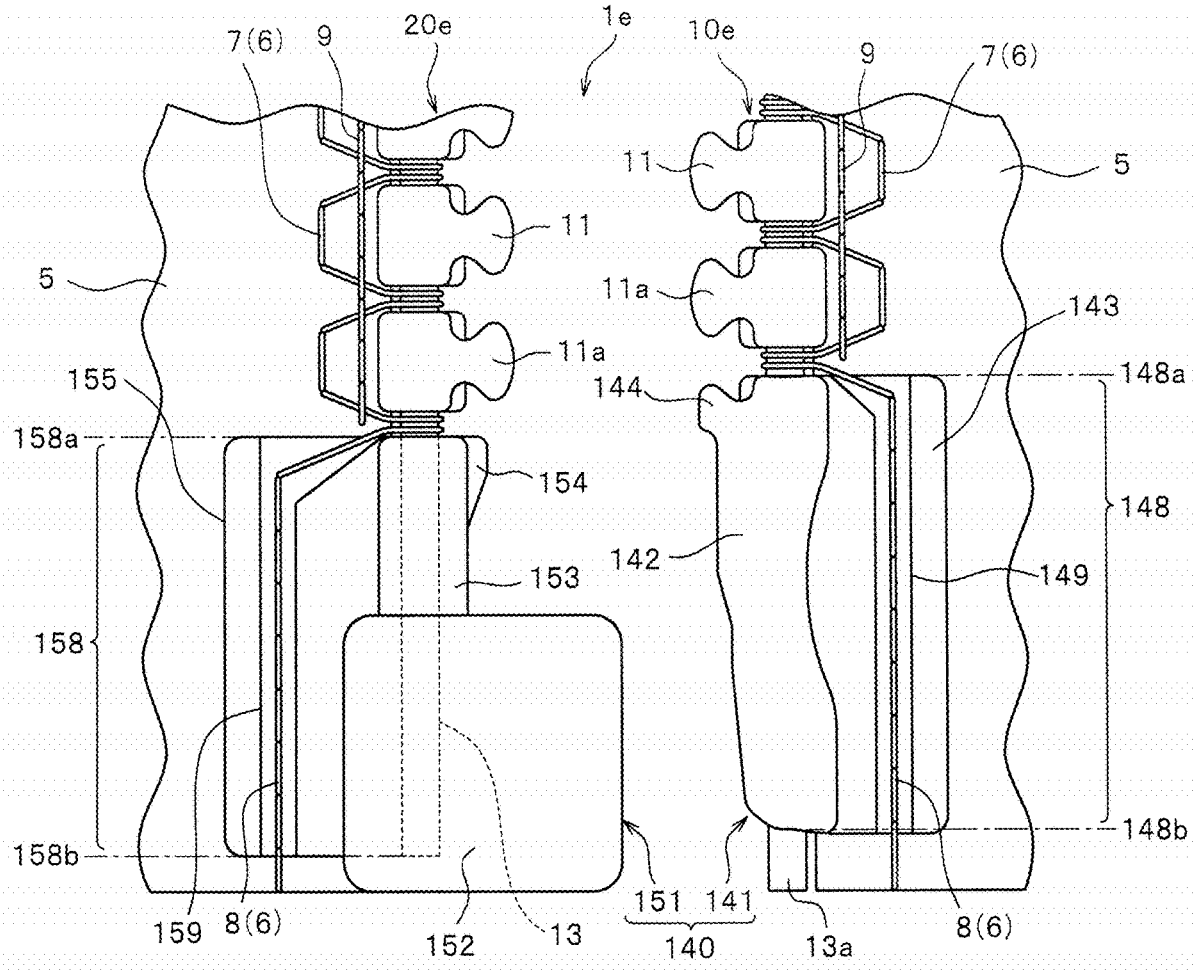
FIG. 33 is a bottom view illustrating a main part of a slide fastener-attached product (clothing item).
Figure 34:
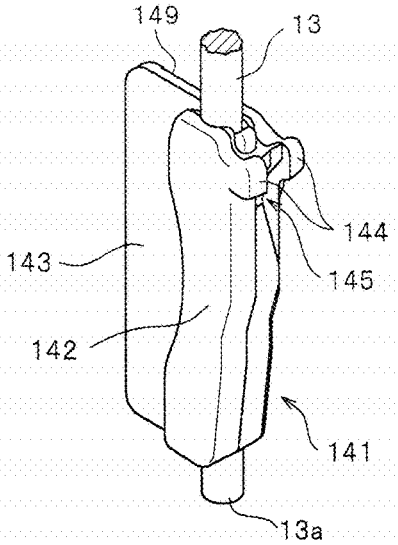
FIG. 34 is a perspective view illustrating an insert pin portion of a separable rear end stop according to Embodiment 6.
Figure 35:
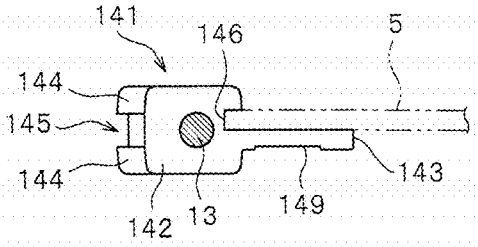
FIG. 35 is a front view viewing an insert pin portion from a fastener element side (front side).
Figure 36:
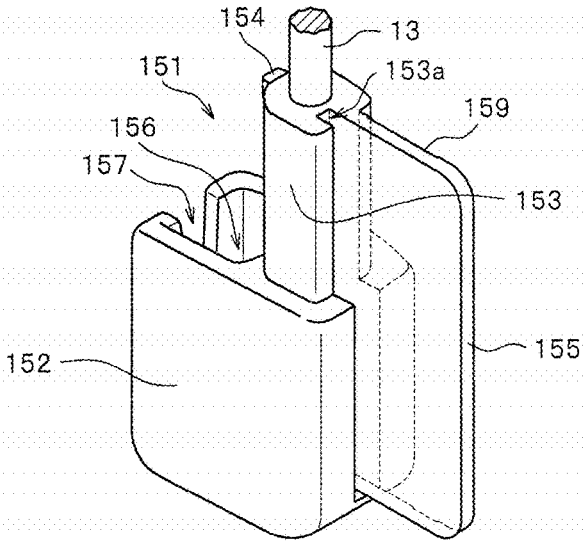
FIG. 36 is a perspective view illustrating a box portion of a separable rear end stop according to Embodiment 6.
Figure 37:
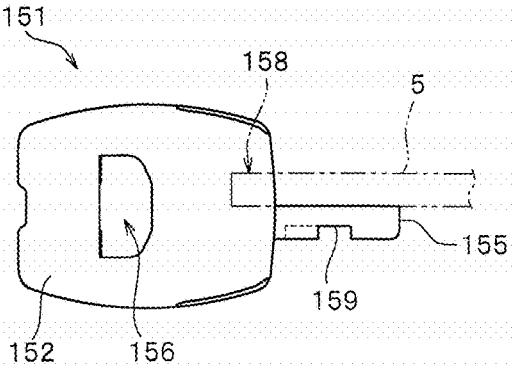
FIG. 37 is a rear view viewing a box portion from a rear side.

FIGS. 32 and 33 are a plan view and a bottom view illustrating a main part of a slide fastener-attached clothing item according to Embodiment 6 of the invention schematically. FIGS. 34 and 35 are a perspective view and a front view illustrating an insert pin portion of a separable rear end stop in a slider fastener. FIGS. 36 and 37 are a perspective view and a rear view illustrating a box portion of a separable rear end stop.

The slide fastener structured in the slide fastener-attached clothing item 1*e* of Embodiment 6 has a left and right pair of fastener stringer portions having element rows 3 formed of a first element member 10*e* and a second element member 20*e*, a slider not shown in Figures and capable of coupling and separating the left and right element rows 3 and a separable rear end stop 140 having an insert pin portion 141 and a box portion 151 disposed adjacent to rear end parts of the left and right element rows 3. In this case, the slider of Embodiment 6 has substantially the same structure as the slider 50 used in the previously-mentioned Embodiment 1.

The left side first element member 10*e* of Embodiment 6 has one string-shaped fixing member 13, a plurality of fastener elements fixed to the fixing member 13 at constant intervals and an insert pin portion 141 fixed to a rear end part of the fixing member 13. The right side second element member 20*e* has one string-shaped fixing member 13, a plurality of fastener elements 11 fixed to the fixing member 13 at constant intervals and a box portion 151 fixed to a rear end part of the fixing member 13. The first element member 10*e* and the second element member 20*e* are fixed to the element attaching edge portions 2 of the cloths 5 with the sewn portion for fixing 6 (element sewn portion 7 and component sewn portion 8).

The insert pin portion 141 and the box portion 151 of Embodiment 6 are formed integrally to the left and right fixing members 13 by injection-molding thermoplastic resin such as nylon. In this case, the insert pin portion 141 is fixed at a position in which the fixing member 13 extends rearward from the insert pin portion 141. It should be noted that, in the present invention, the insert pin portion 141 can be formed so as the fixing member 13 not to extend rearward.

The insert pin portion 141 of Embodiment 6 has an insert pin main body portion 142 wrapping the rear end part of the fixing member 13 along the fixing member 13 as a component main body portion of the insert pin portion 141, an insert pin fin portion 143 extending from a cloth-facing side surface part (left side side surface part) of the insert pin main body portion 142 in the width direction and disposed on a lower surface of the element attaching edge portion 2 of the cloth 5 and a coupling portion 144 disposed integrally to a front end part of the insert pin main body portion 142 and coupled with the end part fastener element 11*a* of the right side second element member 20*e*. An insert pin side concave portion 145 accepting a box side insertion piece portion 154 described later provided on the box portion 151 is formed on a box-facing side surface part (right side side surface part) of the insert pin main body portion 142 along the length direction.

The insert pin main body portion 142 of Embodiment 6 has a predetermined length dimension, and as shown in FIG. 35, is formed so as to insert the fixing member 13 therein at a center part of the thickness direction. A cloth-inserting concave groove portion 146 into which a part of the element attaching edge portion 2 of the cloth 5 can be inserted is formed on a cloth-facing side edge part (left side side edge part) of the insert pin main body portion 142 along the length direction.

In this case, the cloth-inserting concave groove portion 146 is disposed, with respect to the thickness direction of the insert pin portion 141, at a position displaced to an upper side of a central position in the thickness direction in the insert pin main body portion 142 and has a thickness dimension corresponding to the thickness of the cloth 5 to be inserted. The width dimension (groove depth dimension) of the cloth-inserting concave groove portion 146 can be arbitrarily changed within a range that the cloth-inserting concave groove portion 146 does not reach to the fixing member 13.

The insert pin fin portion 143 of Embodiment 6 is formed so as to have the same length dimension as the one of the insert pin main body portion 142. The insert pin fin portion 143 extends, with respect to the thickness direction of the insert pin portion 141, from a position displaced to a lower side of a central position in the thickness direction in the insert pin main body portion 142 toward an inside of the cloth 5 along the width direction.

One insert pin fin portion 143 is provided so as to displace (shifting) from a central position in the thickness direction as above, thereby the thickness dimension of one insert pin fin portion 143 can be larger than, for example, in a case that two of upper and lower insert pin fin portions are provided so as to interpose the element attaching edge portions 2 of the cloths 5. Thus, the insert pin fin portion 143 can have proper strength enough to endure usage stably. It should be noted that, in Embodiment 6, the width dimension of the insert pin fin portion 143 can be arbitrarily changed as far as sewing can be directly conducted on the insert pin fin portion 143.

An accommodating concave groove portion 149 as a thread accommodating portion accepting and accommodating the sewing threads of the sewn portion for fixing 6 (component sewn portion 8) formed when the first element member 10*e* is fixed to the element attaching edge portion 2 of the cloth 5 is provided concavely on the lower surface (opposite surface to a contacting surface with the cloth 5) of the insert pin fin portion 143 along the length direction. The accommodating concave groove portion 149 has a first concave groove portion (enlarged width concave groove portion) increasing a groove width dimension gradually to a frontward and a second concave groove portion (constant width concave groove portion) extending rearward from the first concave groove portion and having a constant groove width dimension.

The box portion 151 of Embodiment 6 has a box body portion (box body main body portion) 152 contacting with and stopping a slider and formed as a component main body portion wrapping the fixing member 13, a box pin portion (box pin main body portion) 153 extending frontward from the box body portion 152 and formed as a component main body portion wrapping the fixing member 13, a thin plate-shaped box side insertion piece portion 154 protruded from a front end part of the box pin portion 153 along the width direction and a box fin portion 155 extending from side edge parts of the box portion 151 and the box pin portion 153 in the width direction and disposed on a lower surface of the element attaching edge portion 2 of the cloth 5.

In this case, the box side insertion piece portion 154 is inserted and accommodated into the above-mentioned insert pin side concave portion 145 of the insert pin portion 141 when the insert pin portion 141 is inserted into the box body portion 152. Thereby, a position relationship (particularly a position relationship in the upper and lower direction) between the insert pin portion 141 and the box portion 151 can be stable.

The box body portion 152 of Embodiment 6 has a rectangular parallelepiped-figure or a cube-figure, and the fixing member 13 is fixed to and wrapped by a right side half portion (cloth side half portion) of the box body portion 152. An insert pin accommodating portion 156 inserting and accommodating the insert pin portion 141 therein is provided on a left side half portion (insert pin-facing side half portion) of the box body portion 152 rearward from a front end surface of the box body portion 152. The insert pin accommodating portion 156 is formed so as a part of the insert pin accommodating portion 156 to penetrate a rear wall part (bottom part) of the box body portion 152. An insertion groove 157 inserting the element attaching edge portion 2 on the first element member 10*e* side is provided on the left side side surface part (insert pin-facing side surface part) of the box body portion 152.

The box pin portion 153 of Embodiment 6 has a shape whose cross section perpendicular to the length direction appears as an approximately C-shape and is formed integrally to the box body portion 152. The box pin portion 153 extends frontward from the box body portion 152 so as to decrease the thickness dimension and the width dimension and formed so as to be able to be inserted into an element guide path of a slider when the slider is contacted with the box body portion 152.

A cloth-inserting concave groove portion 153*a* into which a part of the element attaching edge portion 2 of the cloth 5 can be inserted is formed on a cloth-facing side edge part (right side side edge part) of the box body portion 152 and the box pin portion 153 along the length direction. The cloth-inserting concave groove portion 153*a* is formed, with respect to the thickness direction of the box portion 151, at a position displaced to an upper side of a central position in the thickness direction in the box body portion 152 and the box pin portion 153.

The box fin portion 155 of Embodiment 6 is extending, with respect to the thickness direction of the box portion 151, from a position displaced to a lower side of a central position in the thickness direction in the box body portion 152 toward an inside of the cloth 5 along the width direction. Thereby, the box fin portion 155 can have proper strength stably as in the case of the insert pin fin portion 143. It should be noted that the width dimension of the box fin portion 155 can be arbitrarily changed as far as sewing can be directly conducted on the box fin portion 155.

An accommodating concave groove portion 159 as a thread accommodating portion accepting and accommodating the sewing threads of the sewn portion for fixing 6 (component sewn portion 8) formed when the second element member 20*e* is fixed to the element attaching edge portion 2 of the cloth 5 is provided concavely on the lower surface of the box fin portion 155 along the length direction. The accommodating concave groove portion 159 has a first concave groove portion (enlarged width concave groove portion) increasing a groove width dimension gradually frontward and a second concave groove portion (constant width concave groove portion) extending rearward from the first concave groove portion and having a constant groove width dimension.

In Embodiment 6, the left side first element member 10*e* having the insert pin portion 141 and the right side second element member 20*e* having the box portion 151 are, with respect to respective element attaching edge portions 2 of the left and right cloths 5, lined at a position adjacent to respective outsides in the width direction and fixed with the sewn portion for fixing 6 formed by a sewing machine in a state that the insert pin fin portion 143 of the insert pin portion 141 and the box fin portion 155 of the box portion 151 are overlapped to the element attaching edge portions 2 from a lower surface side. Further in this case, the insert pin portion 141 and the box portion 151 are fixed to the element attaching edge portions 2 of the cloths 5 in a state that a part of the element attaching edge portion 2 of the cloth 5 is inserted into the cloth-inserting concave groove portion 146 of the insert pin portion 141 and the cloth-inserting concave groove portion 153*a* of the box portion 151.

In the case of Embodiment 6, the left and right sewn portions for fixing 6 have an element sewn portion 7 fixing the element holding portion 15*a* of the first element member 10*e* and the second element member 20*e* to the element attaching edge portion 2 of the cloth 5 and a component sewn portion 8, and a component holding portion 15*b* in which the insert pin portion 141 of the first element member 10*e* is disposed and a component holding portion 15*b* in which the box portion 151 of the second element member 20*e* is disposed are fixed to the element attaching edge portions 2 of the cloths 5 with the component sewn portion 8 of the sewn portion for fixing 6.

The element sewn portion 7 in the sewn portion for fixing 6 of Embodiment 6 is formed of the lock stitches bending in a zigzag shape as the element sewn portion 7 of the previously-mentioned Embodiment 1. An auxiliary sewn portion 9 pressing the element sewn portion 7 toward the cloth 5 is formed on the element sewn portion 7.

On the other hand, the component sewn portion 8 in the sewn portion for fixing 6 of Embodiment 6 is not formed so as to bend in a zigzag shape as the element sewn portion 7, although it is formed continuously from the element sewn portion 7. The component sewn portion 8 is formed linearly along the length direction by sewing the element attaching edge portion 2 of the cloth 5 and the insert pin fin portion 143 (or the box fin portion 155 of the box portion 151) of the insert pin portion 141 overlapped to the element attaching edge portion 2 together with the lock stitches using a sewing machine.

In this case, it is preferable that the component sewn portion 8 is formed by reverse stitching, thereby fraying on an end part of the component sewn portion 8 can be less likely to occur. The insert pin portion 141 and the box portion 151 are sewn to the element attaching edge portion 2 of the cloth 5 with the linear-shaped component sewn portion 8, thereby the insert pin portion 141 and the box portion 151 can be easily and stably fixed.

Particularly in Embodiment 6, sewing is conducted by piercing a sewing needle of a sewing machine through the accommodating concave groove portion 149 of the insert pin fin portion 143 or the accommodating concave groove portion 159 of the box fin portion 155, thereby the component sewn portion 8 can be formed and accommodated in the accommodating concave groove portions 149, 159.

In this case, in the insert pin fin portion 143 and the box fin portion 155, since the thickness of a part at which the accommodating concave groove portions 149, 159 are formed is thin, a sewing needle can easily pierce the thin part. As a result, it can be prevented or suppressed that breakage occurs on the insert pin fin portion 143 or the box fin portion 155 caused by the piercing of a sewing needle. Further, the component sewn portion 8 is accommodated in the accommodating concave groove portion 149, 159 of the insert pin fin portion 143 or the box fin portion 155, thereby a flange portion 57 of the slider becomes less likely to contact with the component sewn portion 8 and thread breakage can be less likely to occur on the component sewn portion 8.

In Embodiment 6, with respect to the element attaching edge portions 2 of the left and right cloths 5, the insert pin portion 141 and the box portion 151 are fixed at a position in which the element attaching edge portion 2 of the cloths 5 extends rearward from each of the insert pin fin portion 143 of the insert pin portion 141 and the box fin portion 155 of the box portion 151 and a part of the element attaching edge portion 2 is exposed. It should be noted that the insert pin portion 141 and the box portion 151 may be fixed to the element attaching edge portions 2 of the left and right cloths 5 so as positions of a rear end edge of the element attaching edge portions 2 of the left and right cloths 5 and positions of respective rear end edge of the insert pin fin portion 143 of the insert pin portion 141 and the box fin portion 155 of the box portion 151 to be adjusted.

Further in the case of Embodiment 6, with respect to the length direction of the first element member 10*e*, the component sewn portion 8 of the sewn portion for fixing 6 is formed on the whole length direction of the directly-attached region 148 within which the insert pin portion 141 is contacted directly with and attached continuously to the fixing member 13. Further, the component sewn portion 8 of the sewn portion for fixing 6 is formed so as to extend frontward from the directly-attached region 148 beyond the front end position 148*a* of the directly-attached region 148 and also extend rearward beyond the rear end position 148*b* of the directly-attached region 148.

Further, with respect to the second element member 20*e*, the component sewn portion 8 of the sewn portion for fixing 6 is formed on the whole length direction of the directly-attached region 158 within which the box portion 151 is contacted directly with and attached continuously to the fixing member 13. Further, the component sewn portion 8 of the sewn portion for fixing 6 is formed so as to extend frontward from the directly-attached region 158 beyond the front end position 158*a* of the directly-attached region 158 and also extend rearward beyond the rear end position 158*b* of the directly-attached region 158.

It should be noted that, in Embodiment 6, the element sewn portion 7 and the component sewn portion 8 of the sewn portion for fixing 6 are formed continuously by one time lock stitching with a sewing machine. However, in the present invention, the element sewn portion land the component sewn portion 8 of the sewn portion for fixing 6 may be formed not continuously but independently by separating from each other.

As the slide fastener-attached clothing item 1 of the previously-mentioned Embodiment 1, in the slide fastener-attached clothing item 1*e* of the above-mentioned Embodiment 6, a function of the slide fastener can be maintained without a fastener tape. Further, since the separable rear end stop 140 is formed on a rear end part of the slide fastener, the left and right first element member 10*e* and second element member 20*e* can be properly and smoothly coupled and separated. Moreover, the slide fastener attached-clothing item 1*e* can be easily formed by using the cloth 5 to which a desired function such as waterproofness or water-repellency is added.

It should be noted that, in the above-mentioned Embodiment 6, the insert pin portion 141 of the first element member 10*e* and the box portion 151 of the second element member 20*e* are formed by overlapping and sewing the insert pin fin portion 143 of the insert pin portion 141 or the box fin portion 155 of the box portion 151 with the element attaching edge portions 2 of the cloths 5. However, in the present invention, the insert pin fin portion 143 of the insert pin portion 141 or the box fin portion 155 of the box portion 151 may be formed by overlapping and sewing to the element attaching edge portions 2 of the cloths 5 from an upper surface side.

In the above-mentioned Embodiment 6, the insert pin fin portion 143 of the insert pin portion 141 or the box fin portion 155 of the box portion 151 are sewn to the element attaching edge portions 2 of the cloth 5 with the component sewn portion 8 formed with linear-shaped lock stitches. However, in the present invention, the stitch of the component sewn portion 8 is not limited to the linear-shaped lock stitches, but, for example, may be formed with zigzag-shaped stitches, box sewing stitches (lock stitches appearing as a rectangular shape in a plan view) and chain stitches. In this case, a thread accepting portions formed to accommodate the sewing threads of the component sewn portion 8 on the insert pin fin portion 143 of the insert pin portion 141 and the box fin portion 155 of the box portion 151 are formed of accommodating concave portions (accommodating concave groove portions and the like) having a shape corresponding to a type and a form of the stitches of the component sewn portion 8.

Further in the above-mentioned Embodiment 6, accommodating concave groove portions 149, 159 as thread accepting portions accommodating the sewing threads of the component sewn portion 8 are provided on the insert pin fin portion 143 of the insert pin portion 141 and the box fin portion 155 of the box portion 151 along the length direction. However, in the present invention, instead of such accommodating concave groove portions 149, 159 (or together with the accommodating concave groove portions 149, 159), a plurality of penetrating hole portions as thread accepting portions penetrating the insert pin fin portion 143 or the box fin portion 155 in the thickness direction and capable of inserting the sewing threads of the component sewn portion 8 may be provided in advance at a position in which the lock stitches of the component sewn portion 8 pierce the insert pin fin portion 143 or the box fin portion 155 so as to be along with a forming position of the component sewn portion 8. Such a plurality of penetrating hole portions as thread accepting portions are formed in advance on the insert pin fin portion 143 or the box fin portion 155, thereby a sewing needle does not have to be pierced into the insert pin fin portion 143 and the box fin portion 155 directly when sewing, which enables less occurrence of breakages on the insert pin fin portion 143 and the box fin portion 155.

Though the separable rear end stop 140 of the above-mentioned Embodiment 6 is formed as a normal-type separable rear end stop having the insert pin portion 141 and the box portion 151 on which the insert pin accommodating portion 156 is formed, a so-called open reverse-type bottom end stop can be provided on a rear end part of the slide fastener in Embodiment 6, by forming a box pin-shaped box portion having a stopper portion instead of the above-mentioned box portion 151.

In the slide fastener-attached clothing item 1, 1*a*-1*e* of the previously-mentioned Embodiments 1-6, at least element holding portions 15*a* of the first element members 10, 10*a*-10*e* and the second element members 20, 20*a*-20*e* are fixed firmly to the element attaching edge portions 2 of the cloths 5 with the zigzag-shaped sewn portions for fixing 6 formed with the zigzag stitch sewing machine and the auxiliary sewn portions 9 formed with the lockstitch sewing machine.

However, in the present invention, it is also possible that, without forming the above-mentioned auxiliary sewn portions 9 formed with the lockstitch sewing machine, at least element holding portions 15*a* of the first element members 10, 10*a*-10*e* and the second element members 20, 20*a*-20*e* are fixed to the element attaching edge portions 2 of the cloths 5 only with the zigzag-shaped sewn portions for fixing 6.

In this case, it is preferable to use a welded thread (also referred to as a fusible thread) having a core-sheath structure instead of a normal sewing machine thread as in the previously-mentioned Embodiment 1 for at least one of the upper thread (needle thread) and the lower thread (bobbin thread) forming the zigzag-shaped sewn portion for fixing 6. In the welded thread having the core-sheath structure, a core of the welded thread is formed of a fiber material which does not melt even when it is heated to more than a predetermined temperature, or a fiber material which has a heat shrinkability shrunk by heating. A sheath of the welded thread is formed of a fiber material having a heat fusibility melted by heating to more than a predetermined temperature.

In a case that such a welded thread having a core-sheath structure is used as at least one of the upper thread and the lower thread of the sewn portion for fixing 6, even when the auxiliary sewn portion 9 as in the case of the previously-mentioned Embodiment 1 and others is not formed, the first element members 10, 10*a*-10*e* and the second element members 20, 20*a*-20*e* can be firmly fixed with the sewn portion for fixing 6 by heat processing after forming the sewn portion for fixing 6. Moreover, it can be effectively prevented that the upper thread and the lower thread of the sewn portion for fixing 6 loosen.

Further in the present invention, it is also possible that, without forming the above-mentioned auxiliary sewn portion 9 formed with the lockstitch sewing machine, a transparent film member (tape member) for fixing the sewn portion for fixing 6 formed in a zigzag shape to the element attaching edge portion 2 of the cloth 5 is applied on the sewn portion for fixing 6. The film member can also be referred to as a thread-fixing film member for fixing the sewing threads of the sewn portion for fixing 6. In this case, the film member is applied to at least one surface of the top surface and the back surface of the element attaching edge portion 2 so as to cover at least a part of the sewn portion for fixing 6 including the first piercing position 18*a* and the second piercing position 18*b* of the sewn portion for fixing 6.

Thereby, at least one of the upper thread and the lower thread of the sewn portion for fixing 6 can be firmly fixed to the element attaching edge portion 2. Accordingly, even when the above-mentioned auxiliary sewn portion 9 is not formed on the sewn portion for fixing 6, the element member can be firmly fixed with the sewn portion for fixing 6. It should be noted that, it is possible that instead of applying the film member as above, the upper thread and the lower thread of the sewn portion for fixing 6 is bonded and firmly fixed to the element attaching edge portion 2 by applying or coating an adhesive agent in the range in which the film member is applied.

In the previously-mentioned Embodiments 1-6, the zigzag-shaped sewn portion for fixing 6 is formed, as shown in FIG. 2 and others, by repeating a unit running area 17 having a predetermined stitch pattern in which a part formed on the inner side of the fastener element 11 in the cloth 5 appears as an isosceles trapezoidal shape.

However, in the present invention, a shape (stitch pattern) of the unit running area 17 formed on the sewn portion for fixing 6 is not limited thereto, and for example, as far as the sewn portion for fixing 6 pierces the element attaching edge portion 2 of the cloth 5 at a position separated from the fastener element 11 on an inner side of the cloth 5 and the sewn portion for fixing 6 can support the fixing member 13 so as to wrap it, other shapes can be adopted.

Further in the present invention, for example, it is possible that a piercing position at which the sewn portion for fixing 6 pierces the element attaching edge portion 2 is separated wider from the cloth-facing side surface part of the fastener element 11 toward an inside of the cloth 5 than in the case of Embodiment 1 and others. In this case, in each unit running area 17 of the sewn portion for fixing 6, the sewn portion for fixing 6 can be formed in a zigzag shape in a form that the number of the piercing positions at which the sewn portion for fixing 6 pierces the element attaching edge portion 2 is not two as shown in FIG. 2 but one. Also, in each unit running area 17, the number of the piercing positions at which the sewn portion for fixing 6 pierces the element attaching edge portion 2 can increase, for example, to three or more.

In the above-mentioned Embodiments 1-6, the element attaching edge portion 2 is formed by folding a side edge part of the cloth 5 in a U-shape, thereby strength of the element attaching edge portion 2 is enhanced. Further, in a case that fraying occurs on a cut end edge (side end edge) of the cloth 5, fraying can be made unseen by hiding fraying on a rear surface side of the element attaching edge portion 2.

However, in the present invention, the element attaching edge portion 2 may be formed in a state of being straightened in the width direction without folding the side edge part of the cloth 5 in a U-shape. In a case that the element attaching edge portion 2 is formed by straightening the side edge part of the cloth 5 in the width direction, strength of the straight-formed element attaching edge portion 2 can be stably enhanced by immersing a reinforcement agent in the side edge part of the cloth 5 or applying a reinforcement film member made of synthetic resin to the side edge part of the cloth 5 so as to wrap the side edge part inside.

In this case, the reinforcement agent to impregnate the cloth 5 is a curable adhesive, and the reinforcement agent such as single curable adhesive, two-pack curable adhesive, instant adhesive, hot melt adhesive, emulsion adhesive, or light curing adhesive which cures by ultraviolet ray or electron beam can be used. The reinforcement film member to be applied on the cloth 5 is a film-type member which can enhance the strength of the cloth 5 by applying. It is preferable to use a film member having low elasticity or no elasticity as the reinforcement film member.

Also by reinforcing the element attaching edge portion 2 by immersing the reinforcement agent or applying the reinforcement film member, even when the upper thread and the lower thread of the sewn portion for fixing 6 pierce the element attaching edge portion 2, for example, since the element attaching edge portion 2 can be less likely to be cut by the upper thread and the lower thread, durability of the element attaching edge portion 2 can be enhanced.

Further, since the element member is firmly fixed to the element attaching edge portion 2 in a straightened state, a position and a posture of each element fixed to the element attaching edge portion 2 can be stable. Moreover, fraying of the threads can be less likely to occur on the side end edge of the element attaching edge portion 2 by immersing the reinforcement agent or applying the reinforcement film member to the element attaching edge portion 2.

REFERENCE SIGNS LIST

1, 1*a*, 1*b* Slide fastener-attached clothing item (Slide fastener-attached product)
1*c*, 1*d*, 1*e* Slide fastener-attached clothing item
2 Element attaching edge portion
3 Element row
5 Fastener attached member (cloth)
6 Sewn portion for fixing (sewing line for fixing)
7 Element sewn portion
8 Component sewn portion
9 Auxiliary sewn portion
10, 10*a* First element member
10*b*, 10*c* First element member
10*d*, 10*e* First element member
11 Fastener element
11*a* End part fastener element
12*a* Body portion
12*b* Neck portion
12*c* Coupling head portion
12*d* Protruded piece portion
12*e* Insertion concave portion
12*f* Concave groove portion
13 Fixing member (Core string member)
13*a* Extending part
15*a* Element holding portion
15*b* Component holding portion
17 Unit running area
17*a* First running portion
17*b* Second running portion
17*c* Third running portion
18*a* First piercing position
18*b* Second piercing position
20, 20*a* Second element member
20*b*, 20*c* Second element member
20*d*, 20*e* Second element member
30 Separable rear end stop
31, 31*a* Insert pin portion
32 First insert pin divided body (front side insert pin divided body)
32*a* First insert pin main body portion
32*b* First raised portion
32*c* Protruded piece portion
32*d* Engaging portion
33 Second insert pin divided body (Rear side insert pin divided body)
33*a* Second insert pin main body portion
33*b* Second raised portion
35 Connecting portion
38 Directly-attached region
38*a* Front end position of directly-attached region
38*b* Rear end position of directly-attached region
39 Accommodating space portion (accommodating gap)
39*a* Accommodating space portion (Accommodating concave portion)
41 Box portion
41*a* Insert pin accommodating portion
41*a*1 First accommodating portion
41*a*2 Second accommodating portion
42 Box body portion
42*a* Concave groove portion
42*b* Insertion groove (Insertion slit)
43 Box extending portion
43*a* Engaging protruded portion
48 Directly-attached region
48*a* Front end position of directly-attached region
48*b* Rear end position of directly-attached region
49*a* Accommodating space portion (Accommodating opening portion)
49*b* Accommodating space portion (accommodating gap)
50 Slider
50*a* First slider
50*b* Second slider
51 Slider body
52 Tab
53 Upper blade
54 Tab attaching portion
55 Lower blade
56 Connecting post
57 Flange portion
60 Separable rear end stop
61 Insert pin portion
62 First insert pin divided body
62*a* First insert pin main body portion
62*b* First raised portion
63 Second insert pin divided body
63*a* Second insert pin main body portion
63*b* Second raised portion
68 Directly-attached region
68*a* Front end position of directly-attached region
68*b* Rear end position of directly-attached region
69 Accommodating space portion (accommodating gap)
71 Box portion
72 Box body portion
73 Box extending portion
74 Box side engaging portion
74*a* main body portion
74*b* Protruded portion
78 Directly-attached region
78*a* Front end position of directly-attached region
78*b* Rear end position of directly-attached region
79*a* Accommodating space portion (Accommodating opening portion)
79*b* Accommodating space portion (accommodating gap)
80 Separable rear end stop
81 Insert pin portion
82 First insert pin divided body (Front side insert pin divided body)
82*a* First insert pin main body portion
82*b* First raised portion
82*c* Protruded piece portion
83 Second insert pin divided body (Central insert pin divided body)
83*a* Second insert pin main body portion
83*b* Second raised portion
84 Third insert pin divided body (Rear side insert pin divided body)
84*a* Third insert pin main body portion
84*b* Third raised portion
88 Directly-attached region
88*a* Front end position of directly-attached region
88*b* Rear end position of directly-attached region
89 Accommodating space portion (accommodating gap)
91 Box portion
92 Box body portion
93 Box extending portion
93*a* Engaging protruded portion

98 Directly-attached region
98*a* Front end position of directly-attached region
98*b* Rear end position of directly-attached region
99*a*, 99*b* Accommodating space portion (Accommodating opening portion)
99*c* Accommodating space portion (accommodating gap)
100 Separable rear end stop
101 Insert pin portion
102 First insert pin divided body (Front side insert pin divided body)
102*a* Main body portion
102*b* Protruded portion
103 Second insert pin divided body (Central insert pin divided body)
103*a* Second insert pin main body portion
103*b* Second raised portion
103*c* Protruded piece portion
104 Third insert pin divided body (Rear side insert pin divided body)
104*a* Third insert pin main body portion
104*b* Third raised portion
109 Accommodating space portion (accommodating gap)
111 Box portion
112 Box body portion
113 Box extending portion
114 Box divided body
119*a* Accommodating space portion (Accommodating opening portion)
119*b* Accommodating space portion (accommodating gap)
120 Separable rear end stop
121 Insert pin portion
122 First insert pin divided body
122*a* Insert pin main body portion
122*b* Projected piece portion
123 Second insert pin divided body
123*a* Insert pin main body portion
123*b* Projected piece portion
124 Third insert pin divided body
124*a* Insert pin main body portion
124*b* Projected piece portion
125 Fourth insert pin divided body
125*a* Insert pin main body portion
125*b* Projected piece portion
126 Fifth insert pin divided body
126*a* Insert pin main body portion
126*b* Projected piece portion
128 Directly-attached region
128*a* Front end position of directly-attached region
128*b* Rear end position of directly-attached region
129 Accommodating space portion (accommodating gap)
131 Box portion (Box pin portion)
132 First box divided body
132*a* Insertion concave groove portion
133 Second box divided body
133*a* Insertion concave groove portion
134 Third box divided body
135 Fourth box divided body
136 Fifth box divided body
136*a* Protruded portion (Stopper portion)
138 Directly-attached region
138*a* Front end position of directly-attached region
138*b* Rear end position of directly-attached region
139 Accommodating space portion (accommodating gap)
140 Separable rear end stop
141 Insert pin portion
142 Insert pin main body portion
143 Insert pin fin portion
144 Coupling portion
145 Insert pin side concave portion
146 Cloth-inserting concave groove portion
148 Directly-attached region
148*a* Front end position of directly-attached region
148*b* Rear end position of directly-attached region
149 Accommodating concave groove portion
151 Box portion
152 Box body portion (Box body main body portion)
153 Box pin portion (Box pin main body portion)
153*a* Cloth-inserting concave groove portion
154 Box side insertion piece portion
155 Box fin portion
156 Insert pin accommodating portion
157 Insertion groove
158 Directly-attached region
158*a* Front end position of directly-attached region
158*b* Rear end position of directly-attached region
159 Accommodating concave groove portion

The invention claimed is:

1. A slide fastener-attached product comprising:

a first element member in which fastener elements and an insert pin portion forming a separable rear end stop for a slide fastener are attached to a fixing member, a second element member in which fastener elements and a box portion forming the separable rear end stop are attached to a fixing member, and fastener attached members having a pair of element attaching edge portions to which a pair of the first element member and the second element member are attached in a position facing to each other, wherein the first element member and the second element member have element holding portions in which the fastener elements are attached to the fixing member and component holding portions in which the insert pin portion or the box portion is attached to the fixing member with respect to a length direction of the fixing member, at least the component holding portions of the first element member and the second element member are fixed to the element attaching edge portions with component sewn portions formed of sewing threads and piercing the fastener attached members, and the first element member and the second element member are fixed to the element attaching edge portions at a position along the element attaching edge portion at an outside of the element attaching edge portion in a width direction.

2. The slide fastener-attached product according to claim 1 wherein:

the component sewn portion is formed in at least a part of a directly-attached region within which the insert pin portion or the box portion is attached directly to the fixing member with respect to the length direction.

3. The slide fastener-attached product according to claim 1 wherein:

the component sewn portion is disposed so as to extend continuously to an element holding portion side beyond a position corresponding to an end edge on a near side to the element holding portion of a directly-attached region within which the insert pin portion or the box portion is attached directly to the fixing member with respect to the length direction.

4. The slide fastener-attached product according to claim 1 wherein:

the fixing member has an extending part extending from the insert pin portion or the box portion in a direction away from the element holding portion in the length direction.

5. The slide fastener-attached product according to claim 4 wherein:

the component sewn portion is disposed so as to extend continuously to an opposite side to the element holding portion side beyond a position corresponding to an end edge on a far side from the element holding portion of a directly-attached region within which the insert pin portion or the box portion is attached directly to the fixing member with respect to the length direction.

6. The slide fastener-attached product according to claim 1 wherein:

the insert pin portion and the box portion have thread accommodating portions accepting and accommodating the sewing threads of the component sewn portion, and the component sewn portion is formed so as at least a part of the sewing threads of the component sewn portion to be accommodated in the thread accommodating portion of the insert pin portion or the box portion.

7. The slide fastener-attached product according to claim 1 wherein:

the component holding portion of the first element member or the second element member is fixed to the element attaching edge portion with the sewing threads of the component sewn portion holding the fixing member disposed on the component holding portion, or holding a part of the insert pin portion or the box portion.

8. The slide fastener-attached product according to claim 7 wherein:

the insert pin portion or the box portion has at least two divided bodies which are divided, and the sewing threads of the component sewn portion are accommodated in a gap or a concave portion formed between the divided bodies.

9. The slide fastener-attached product according to claim 1 wherein:

the component holding portion is fixed to the element attaching edge portion with the sewing threads of the component sewn portion penetrating and sewing directly the insert pin portion or the box portion to the element attaching edge portion.

10. The slide fastener-attached product according to claim 9 wherein:

the insert pin portion or the box portion has a component main body portion wrapping the fixing member along the fixing member and a fin portion extending from the component main body portion in a width direction and disposed on one surface of the element attaching edge portion, an accommodating concave groove portion or an accommodating concave portion accommodating the sewing threads of the component sewn portion is disposed, or a hole portion which makes the sewing threads passed through and penetrated into the fin portion is disposed in advance on the fin portion, and the fin portion is sewn to the element attaching edge portion.

11. The slide fastener-attached product according to claim 1 wherein:

the fastener elements and the insert pin portion or the box portion are formed of synthetic resin and formed integrally to the fixing member in a predetermined shape, and a plurality of the fastener elements are formed independently and disposed on the fixing member respectively at regular intervals.

12. The slide fastener-attached product according claim 1 wherein:

the element holding portions of the first element member and the second element member are fixed directly to the element attaching edge portions with element sewn portions piercing the fastener attached members.

13. The slide fastener-attached product according to claim 12 wherein:

the element sewn portion and the component sewn portion are formed continuously to be bent in a zigzag shape with respect to the length direction of the fixing member, the element sewn portion is formed of the sewing threads repeating a predetermined stitch pattern per fastener element, and the component sewn portion is formed by repeating the stitch pattern in the element sewn portion.

14. The slide fastener-attached product according to claim 12 wherein:

the element sewn portion is formed to be bent in a zigzag shape with respect to the length direction of the fixing member, and the component sewn portion is formed linearly.

15. The slide fastener-attached product according to claim 1 wherein:

the box portion has at least a box body portion which has an insert pin accommodating portion capable of inserting and accommodating the insert pin portion therein and stops a slider by contacting, and the slider is slidably attached to an element row formed of the fastener elements in a posture that a rear mouth of the slider faces to the box body portion.

16. The slide fastener-attached product according to claim 1 wherein:

a first slider and a second slider are slidably attached to element rows formed of the fastener elements in a posture that rear mouths of respective sliders face to each other, and the box portion has a box pin portion inserted into the first slider and the second slider and a stopper portion which stops either the first slider or the second slider by contacting.

17. An element member comprising:

a fixing member, fastener elements attached to the fixing member, and an insert pin portion or a box portion which is disposed so as to continue to element rows formed of the fastener elements and forms a separable rear end stop for a slide fastener, wherein:

the fastener elements and the insert pin portion or the box portion are fixed to the fixing member, the fixing member is formed of a string-shaped member and wrapped with the fastener elements, and a component holding portion in which the insert pin portion or the box portion is fixed to the fixing member has a structure able to be fixed with a component sewn portion formed of sewing threads and piercing a fastener attached member.

18. The element member according to claim 17 wherein:
the insert pin portion or the box portion has a thread accommodating portion capable of accepting and accommodating the sewing threads sewing the insert pin portion or the box portion to the fastener attached member.

19. The element member according to claim 17 wherein:
the fixing member has an extending part extending from the insert pin portion or the box portion in a direction away from the fastener element in a length direction.

20. The element member according to claim 18 wherein:
the insert pin portion or the box portion has at least two divided bodies which are divided, and
a gap or a concave portion as the thread accommodating portion capable of inserting and accommodating the sewing threads therein is disposed between the divided bodies adjacent to each other in the length direction of the fixing member.

21. The element member according to claim 18 wherein:
the insert pin portion or the box portion has a component main body portion wrapping the fixing member along the fixing member and a fin portion extending from the component main body portion in a width direction.

22. The element member according to claim 21 wherein:
an accommodating concave groove portion or an accommodating concave portion as the thread accommodating portion accommodating the sewing threads of the component sewn portion is disposed, or a hole portion which makes the sewing threads passed through and penetrated into the fin portion is disposed in advance on the fin portion.

23. An element member comprising:
a fixing member,
fastener elements attached to the fixing member, wherein the fixing member is formed of a string-shaped member and wrapped with the fastener elements, and
an insert pin portion or a box portion which is disposed so as to continue to element rows formed of the fastener elements and forms a separable rear end stop for a slide fastener, wherein:
the fastener elements and the insert pin portion or the box portion are fixed to the fixing member, and
the insert pin portion or the box portion has a thread accommodating portion capable of accepting and accommodating sewing threads sewing the insert pin portion or the box portion to a fastener attached member.

24. The element member according to claim 23 wherein:
the fixing member has an extending part extending from the insert pin portion or the box portion in a direction away from the fastener element in a length direction.

25. The element member according to claim 23 wherein:
the insert pin portion or the box portion has at least two divided bodies which are divided, and
a gap or a concave portion as the thread accommodating portion capable of inserting and accommodating the sewing threads therein is disposed between the divided bodies adjacent to each other in the length direction of the fixing member.

26. The element member according to claim 23 wherein:
the insert pin portion or the box portion has a component main body portion wrapping the fixing member along the fixing member and a fin portion extending from the component main body portion in a width direction.

27. The element member according to claim 26 wherein:
an accommodating concave groove portion or an accommodating concave portion as the thread accommodating portion accommodating the sewing threads of a component sewn portion is disposed, or a hole portion which makes the sewing threads passed through and penetrated into the fin portion is disposed in advance on the fin portion.

28. A manufacturing method of a slide fastener-attached product comprising:
forming a first element member in which fastener elements and an insert pin portion forming a separable rear end stop for a slide fastener are attached to a fixing member and having an element holding portion in which the fastener elements are attached to the fixing member and a component holding portion in which the insert pin portion is attached to the fixing member with respect to a length direction of the fixing member;
forming a second element member in which fastener elements and a box portion forming the separable rear end stop are attached to a fixing member and having an element holding portion in which the fastener elements are attached to the fixing member and a component holding portion in which the box portion is attached to the fixing member with respect to the length direction of the fixing member;
forming fastener attached members having a pair of element attaching edge portions in a position facing to each other; and
forming element sewn portions for fixing including component sewn portions piercing the fastener attached members and fixing the first element member and the second element member to the element attaching edge portions with the element sewn portions for fixing at a position along the element attaching edge portion at an outside of the element attaching edge portion in a width direction by conducting a sewing processing on the first element member, the second element member and the corresponding element attaching edge portions of the fastener attached members by using a sewing machine.

* * * * *